US005938527A

United States Patent [19]

Oshima et al.

[11] Patent Number: 5,938,527

[45] Date of Patent: Aug. 17, 1999

[54] AIR VENTILATION OR AIR SUPPLY SYSTEM

[75] Inventors: Takeharu Oshima; Satoru Kotoh; Akira Doi; Yachiyo Imamura; Isao Tachibana; Shigeki Kobayashi, all of Tokyo, Japan

[73] Assignee: Mitsubishi Denki Kabushiki Kaisha, Tokyo, Japan

[21] Appl. No.: 08/972,396

[22] Filed: Nov. 18, 1997

[30] Foreign Application Priority Data

| | | | |
|---|---|---|---|
| Nov. 20, 1996 | [JP] | Japan | 8-309331 |
| Oct. 27, 1997 | [JP] | Japan | 9-294106 |

[51] Int. Cl.[6] ..... F24F 7/013

[52] U.S. Cl. ..... 454/344; 454/303

[58] Field of Search ..... 454/300, 302, 454/303, 304, 311, 312, 230, 234, 354, 353, 344

[56] References Cited

U.S. PATENT DOCUMENTS

| | | | |
|---|---|---|---|
| 2,418,266 | 4/1947 | Kurth et al. | 454/311 |
| 2,843,036 | 7/1958 | Quick | 454/344 |
| 3,072,041 | 1/1963 | Downing | 454/353 X |
| 3,433,145 | 3/1969 | Daly et al. | 454/353 X |
| 4,798,518 | 1/1989 | Holzberger et al. | 454/230 X |
| 5,078,574 | 1/1992 | Olsen | 454/230 X |

FOREIGN PATENT DOCUMENTS

| | | | |
|---|---|---|---|
| 59-116738 | 8/1984 | Japan . | |
| 60-218545 | 11/1985 | Japan . | |
| 1-210740 | 8/1989 | Japan | 454/354 |
| 2-31294 | 7/1990 | Japan . | |
| 6-280800 | 10/1994 | Japan . | |

*Primary Examiner*—Harold Joyce
*Attorney, Agent, or Firm*—Leydig, Voit & Mayer, Ltd.

[57] ABSTRACT

An air ventilation or supply system includes a blower for generating a primary flow and an induction nozzle for inducing a secondary flow produced by entrainment of the primary flow. An inlet of the blower and an inlet for the induction nozzle are adjacent each other.

23 Claims, 37 Drawing Sheets

FIGURE 28 (a)
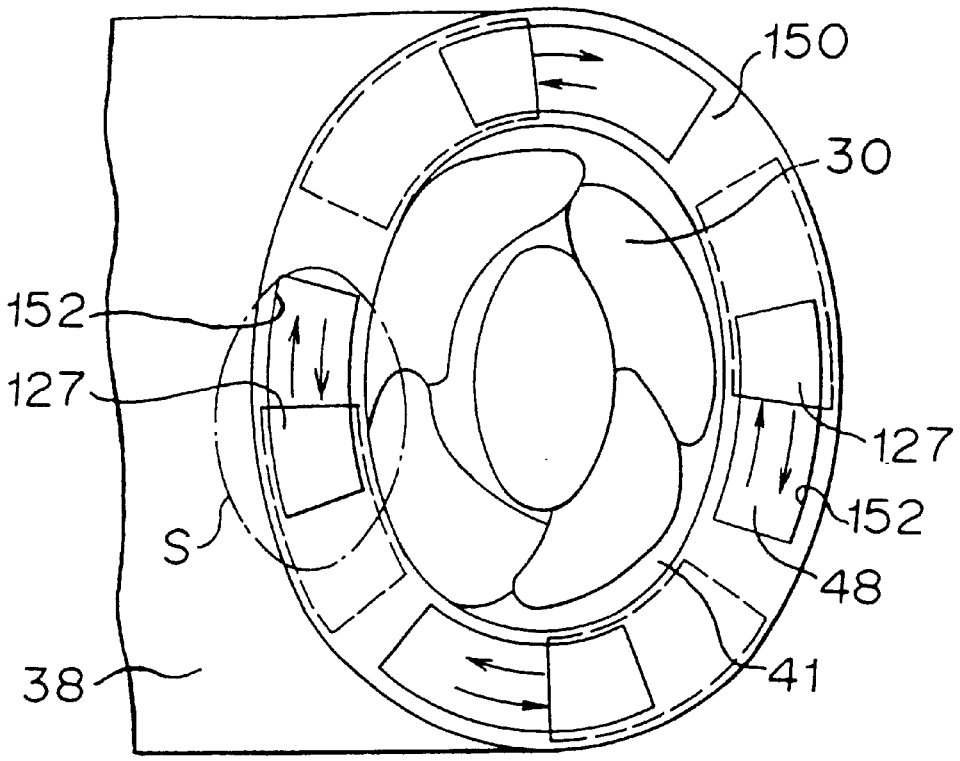
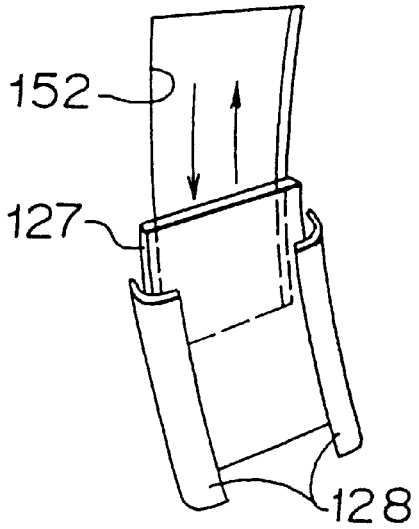
FIGURE 28 (b)

FIGURE 53 (a)
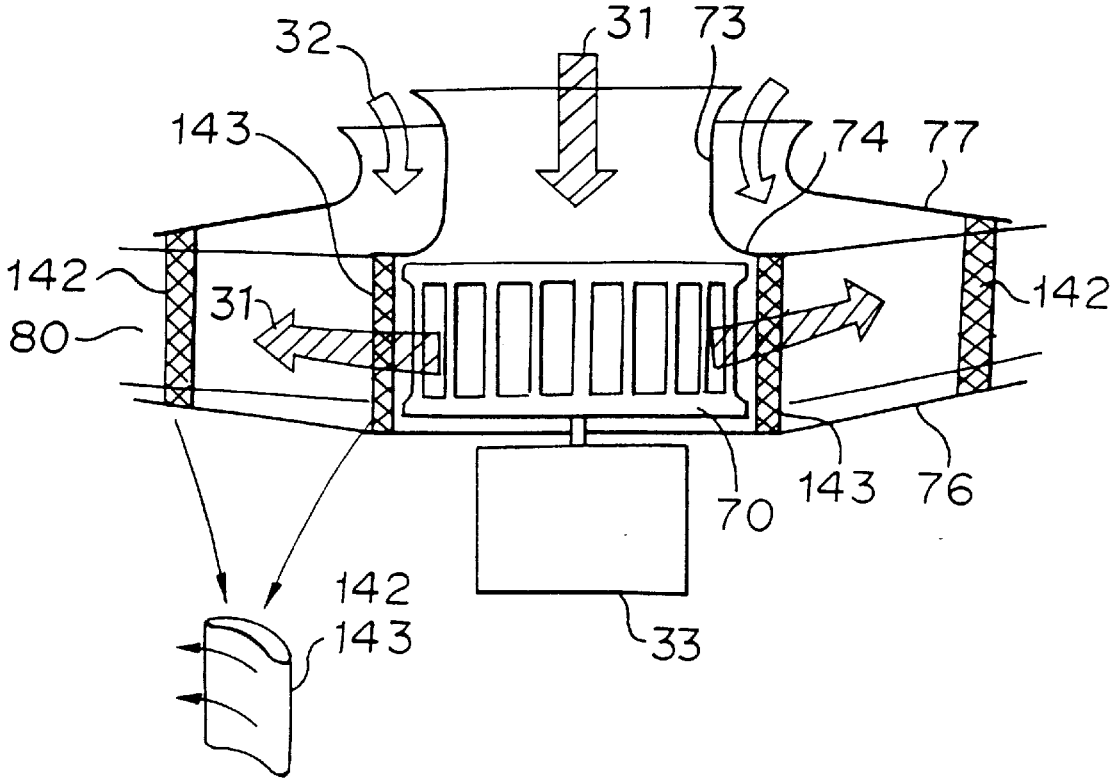
FIGURE 53 (b)
FIGURE 54
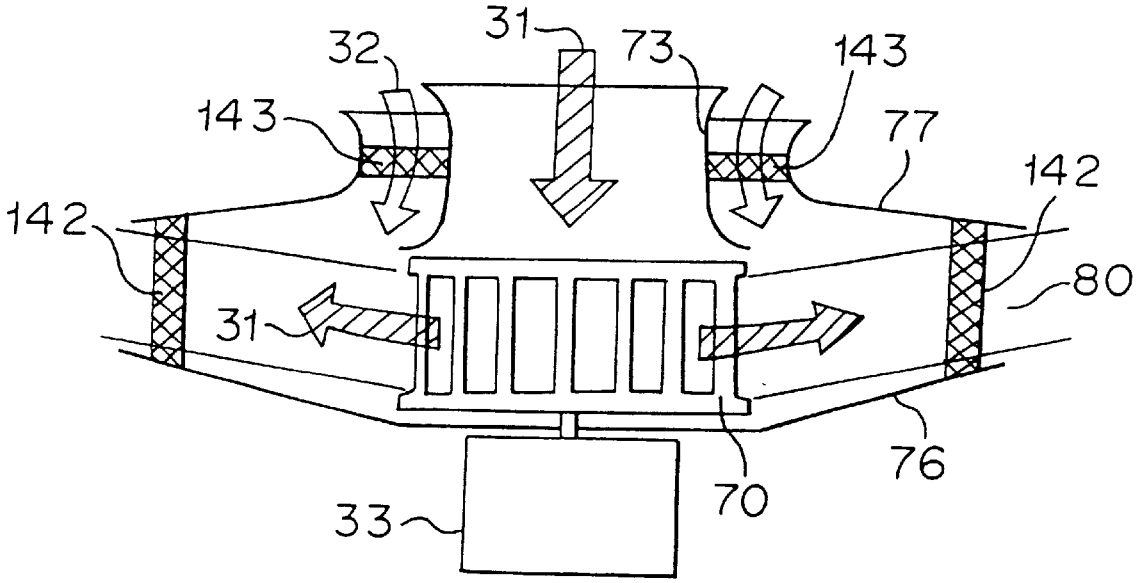

AIR VENTILATION OR AIR SUPPLY SYSTEM

BACKGROUND OF THE INVENTION

The present invention relates to an air ventilation or air supply system which is used for air supply or air ventilation in mainly houses, atria and gymnasiums.

As systems using induction effect, there have been proposed an arrangement wherein the induction effect of fresh air is utilized to exhaust contaminated air, and another arrangement wherein fresh air is compressed to form a high velocity jet, a venturi and an orifice are combined to promote the induction effect so as to increase ventilation airflow rate, and the Coanda effect is utilized. As an example of the former prior art, there have been an arrangement which has been disclosed in e.g. JP-A-60-218545, and which is constituted so that the induction effect of fresh air is utilized to exhaust contaminated air. In FIG. 59, there is shown a schematic view of such a type of air ventilation or air supply system.

In this figure, reference numeral 1 designates a wall for partitioning an indoor side 2 and an outdoor side 3. Reference numeral 4 designates a range which is arranged in the indoor side 2, and produces contaminated air. Reference numeral 6 designates a range hood which is arranged above the range 4. Reference numeral 7 designates an exhaust duct which passes through the wall 1, and which has one end connected to the hood 6. Reference numeral 8 designates a blower which is arranged in the outdoor side 3. Reference numeral 9 designates an air supply duct which has one end connected to the blower 8, and has an intermediate portion connected to the exhaust duct 7. Reference numeral 10 designates outdoor air.

In operation, when the blower 8 is driven, the outdoor air 8 in the outside 3 is supplied into the air supply duct 10. By the air blowing through the air supply duct 9, the contaminated air 5 from the range 4 is inspired into the air supply duct 9 through the hood 6 and the exhaust duct 7 and exhausted therefrom.

In such an arrangement, only a small part of the air supply capability (air supply volume) of the blower 8 is utilized for exhaustion of the contaminated air 5 from the indoor side 2 to the outdoor side 3. A large part of the air supply capability is utilized to inspire the fresh air 10 in the outdoor side 3 and lead it into the outdoor side 3 through the air supply duct 9.

In FIG. 60, there is shown a schematic view of a conventional air ventilation or air supply system using compressed air, which has been disclosed in e.g. JP-A-6-280800.

In this figure, reference numeral 11 designates a connecting pipe which has one end connected to a blower 8. Reference numeral 12 designates a pressure chamber which is connected to the other end of the connecting pipe. Reference numeral 13 designates a venturi which passes through the pressure chamber 12, and which has a conical portion 14 and a cylindrical portion 15 smoothly coupled together to provide a flare shape. Reference numeral 16 designates an orifice which provides an annular space 17 between the conical portion 14 and itself, and which has a central portion formed in a hollow shape and communicated with an indoor side 2 and the inside of the venturi 13.

In operation, when a primary air 18 pressured by the blower 8 is led into the pressure chamber 12, the velocity of the primary air 18 is increased while the flow of the primary air (primary flow) is passing through the annular space 17, and the primary air is blown out into the venturi 13 toward an outlet 19. As a result, the induction effect is generated in the venturi 13 and in the orifice 16 to inspire indoor air 20 from an inlet 21, causing the indoor air to be exhausted from the outlet 19 into an outdoor side 3 after the indoor air has passed through the orifice 16 and the venturi 13.

In such an arrangement, only a small part of the pressurization capability of the blower 8 is utilized for exhaustion of the indoor air 20 into the outdoor side 3. A large part of the pressurization capability is utilized to lead out the fresh air into the outside 3 from the pressure chamber 12 through the annular space 17 and the outlet 19.

Since the conventional air ventilation or air supply systems using the induction effect have been constructed as stated earlier, the former prior art has created a problem in that exhaust performance can not be obtained in a sufficient manner because exhaust volume is limited to the induced airflow rate. On the other hand, the latter prior art has created a problem in that the high velocity jet is too noisy to reduce noise in addition to the problem involved in the former prior art.

SUMMARY OF THE INVENTION

It is an object of the present invention to eliminate these problems, and which to provide an air ventilation or air supply system having large air ventilation and air supply volume and an air ventilation or air supply system capable of reducing noise.

According to a first aspect of the present invention, there is provided an air ventilation or air supply system comprising a blower, a primary flow guide, and induction portion arranged from an inlet side to an outlet side of the primary flow for inducing a secondary flow at the outlet side of the primary flow.

According to a second aspect of the present invention, there is provided an air ventilation or air supply system comprising a blower, a primary flow guide for covering the blower, and an induction nozzle arranged from an inlet side to an outlet side of the primary flow for covering the primary flow guide, and extending to a position behind a downstream end of the primary flow guide.

According to a third aspect of the present invention, there is provided an air ventilation or air supply system wherein the blower comprises an axial fan and the primary flow guide is formed in a cylindrical shape.

According to a fourth aspect of the present invention, there is provided an air ventilation or air supply system wherein the following relationship is established:

$$0.5 \leqq D_1/(D_0+2L \tan \alpha_1) \leqq 1.5$$

wherein the primary flow guide has an outlet provided with a diameter of $D_0$, the induction nozzle is formed in a cylindrical shape to have an outlet provided with a diameter of $D_1$, the outlet of the induction nozzle is apart from the outlet of the primary flow guide by an axial distance of L, and the primary flow has an expansion angle of $\alpha_1$, at the outlet of the primary flow guide arranged for the blower.

According to a fifth aspect of the present invention, there is provided an air ventilation or air supply system wherein a rectifying member is provided in the vicinity of the outlet of the induction nozzle.

According to a sixth aspect of the present invention, there is provided an air ventilation or air supply system wherein ducts are arranged to flow a part of the primary flow to a peripheral portion of the outlet of the induction nozzle.

According to a seventh aspect of the present invention, there is provided an air ventilation or air supply system wherein a hood is connected to a downstream end of the induction nozzle to change directions of the primary flow and the secondary flow.

According to an eighth aspect of the present invention, there is provided an air ventilation or air supply system wherein the blower comprises a centrifugal fan, and the primary flow guide is constituted by an inlet side guide and an cylindrical outlet side guide arranged on an outer diameter side of the centrifugal fan.

According to a ninth aspect and a fifteenth aspect of the present invention, there is provided an air ventilation or air supply system including secondary flow passage opening and closing means for selectively opening and closing the secondary flow passage.

According to a tenth aspect of the present invention, there is provided an air ventilation or air supply system wherein a plate-shaped member which has air-permeability is arranged inside the induction nozzle and apart from the induction nozzle.

According to an eleventh aspect of the present invention, there is provided an air ventilation or air supply system comprising a centrifugal fan, an inlet side guide for guiding a primary flow, a guide plate arranged on a side opposite to an inlet side of the centrifugal fan for guiding the primary flow in a radial direction, and an induction disk for covering the inlet side guide and providing an outlet between the guide plate and the induction disk.

According to a twelfth aspect of the present invention, there is provided an air ventilation or air supply system wherein a space between the guide plate and the induction disk is gradually narrowed toward outer peripheral edges of the guide plate and the induction disk.

According to a thirteenth aspect of the present invention, there is provided an air ventilation or air supply system wherein the following relationship is established:

$$0.5 \leqq 2H_1/\{2H_0+(D_3-D_2)\tan\alpha_2\} \leqq 1.5$$

wherein the centrifugal fan has a diameter of $D_2$, the guide plate is formed in a circular shape to have a diameter of $D_3$, the centrifugal fan has an outlet width of $H_0$, an outlet defined by the outer peripheral edges of the induction disk and the guide plate has a width of $H_1$, and the primary flow from the centrifugal fan has an expansion angle of $\alpha_2$ when the centrifugal fan is provided with the guide plate.

According to a fourteenth aspect of the present invention, there is provided an air ventilation or air supply system wherein there is provided a side plate for partially closing a portion between the guide plate and the induction disk.

According to a sixteenth aspect of the present invention, there is provided an air ventilation or air supply system wherein a static pressure in the secondary flow passage is detected to control the secondary flow passage opening and closing means.

According to a seventeenth aspect of the present invention, there is provided an air ventilation or air supply system wherein the secondary flow passage opening and closing means is automatically opened and closed by a pressure action exerted from a static pressure in the passage.

According to an eighteenth aspect of the present invention, there is provided an air ventilation or air supply system which has the guide plate whose installation angle is changeable.

According to a nineteenth aspect of the present invention, there is provided an air ventilation or air supply system wherein there are provided a support for a cylindrical inlet which couples and supports the induction disk and the inlet side guide in the vicinity of an inlet side of the secondary flow, and an induction disk support which couples and supports the induction disk and the guide plate in the vicinity of the outlet.

According to a twentieth aspect of the present invention, there is provided an air ventilation or air supply system wherein a system according to the second aspect has the inlet side directed to the outlet of a system according to the eleventh aspect.

As explained, in the system according to the first aspect, the induction portion is arranged from the inlet side to the outlet side of the primary flow to induce the secondary flow on the outlet side for the primary flow. The air ventilation and air supply volume can be provided as the sum of the primary flow and the secondary flow, increasing the flow rate. In addition, it is possible to restrain the outlet air velocity to reduce noise.

In the system according to the second aspect, the induction nozzle is arranged from the inlet side to the outlet side of the primary flow so as to cover the primary flow guide and extend to a position downstream a downstream end of the primary flow guide, offering a similar effect.

In the system according to the third aspect, an induction air ventilation or air supply system can be realized by a relatively simple structure because the axial fan and the cylindrical primary flow guide are used.

In the system according to the fourth aspect, the following relationship is established:

$$0.5 \leqq D_1/(D_0+2L\tan\alpha_1) \leqq 1.5$$

wherein the primary flow guide has an outlet provided with a diameter of $D_0$, the induction nozzle is formed in a cylindrical shape to have an outlet provided with a diameter $D_1$, the outlet of the induction nozzle is apart from the outlet of the primary flow guide by an axial distance of L, the primary flow has an expansion angle of $\alpha_1$, at the outlet of the primary flow guide arranged for the blower.

As a result, pressure loss due to collision of a jet against the induction nozzle, and a decrease in the flow rate due to back flow into the induction nozzle can be minimized to carry out air ventilation and air supply in an effective way.

In the system according to the fifth aspect, the rectifying member is provided in the vicinity of the induction nozzle outlet to eliminate the swirling component in the jet blown out of the induction nozzle outlet, restraining the entrainment after flow-out from the induction nozzle and extending the reach of the jet.

In the system according to the sixth aspect, the duct is arranged to flow a part of the primary flow to a peripheral portion of the induction nozzle outlet. By flowing a low velocity auxiliary flow around a main flow, the entrainment just after blow-out from the induction nozzle outlet is reduced to extend the reach of the jet.

In the system according to the seventh aspect, the hood is connected to the downstream end of the induction nozzle to avoid an adverse effect from outdoor wind.

In the system according to the eighth aspect, the blower comprises a centrifugal fan, and the outlet side guide of the primary flow guide which is around on the outer diameter side of the centrifugal fan is formed in a cylindrical shape. It is possible to provide an induction air ventilation or air supply system for supplying air in the axial direction by using the centrifugal fan.

In the system according to the ninth aspect and the fifteenth aspect, there is the secondary flow passage opening and closing means for selectively opening and closing the secondary flow passage. It is possible to cope with both of a demand for a large airflow rate and a demand for a high static pressure by changing the opening degree.

In the system according to the tenth aspect, the provision of the plate-shaped member having air-permeability inside the induction nozzle can reduce noise.

In the system according to the eleventh aspect, there are provided the centrifugal fan, the inlet side guide for guiding the primary flow, the guide plate arranged on the side opposite to the inlet side of the centrifugal fan for guiding the primary flow in a radial direction, and the induction disk for covering the inlet side guide and providing the outlet between the guide plate and the induction disk. It is possible to provide an induction air ventilation or air supply system for supplying air in a radial direction using the centrifugal fan. As a result, the air ventilation and air supply volume can be increased, and the air velocity can be restrained to reduce noise.

In the system according to the twelfth aspect, the space between the guide plate and the induction disk is gradually narrow toward the outer peripheral edges of the guide plate and the induction disk to induce the secondary flow in an effective way.

In the system according to the thirteenth aspect, the following relationship is established:

$$0.5 \leqq 2H_1/\{2H_0+(D_3-D_2)\tan\alpha_2\} \leqq 1.5$$

wherein the centrifugal fan has a diameter of $D_2$, the guide plate has a diameter of $D_3$, the centrifugal fan has an outlet width of $H_0$, the outlet defined by the outer peripheral edges of the induction disk and the guide plate has a width of $H_1$, and the primary flow has an expansion angle of $\alpha_2$ when the centrifugal fan is provided with the guide plate.

As a result, the pressure loss due to collision of the jet against the induction disk, and a decrease in the flow rate due to the back flow from the outlet can be minimized to carry out air ventilation and air supply in an effective way.

In the system according to the fourteenth aspect, the side plate which can partially close the portion between the guide plate and the induction disk is arranged to avoid an adverse effect from outdoor wind.

In the system according to the sixteenth aspect, the secondary flow passage opening and closing means is controlled depending on a detected static pressure, and in the system according to the seventeenth aspect, the secondary flow passage opening and closing means is automatically opened and closed by a pressure action exerted from the static pressure. Both arrangements can automatically provide a large airflow rate and a high static pressure depending on a change in conditions.

In the system according to the eighteenth aspect, the angle of the guide plate is variable. The direction of the outlet air from the outlet can be regulated.

In the system according to the nineteenth aspect, the support for the cylindrical inlet and the support for the induction disk are provided in the vicinity of the inlet side of the secondary flow and in the vicinity of the outlet, respectively. These locations have a relatively low flow velocity, and make the amount of noise reduced.

In the system according to the twentieth aspect, the system according to the second aspect has the inlet side directed to the outlet of the system according to the eleventh aspect. It is possible to convey the outlet air from the outlet to a farther location, and to convey a large volume of air in a wider range.

BRIEF DESCRIPTION OF THE DRAWINGS

FIG. 28(*a*) and (*b*) are perspective views of another example of the system according to the tenth embodiment;

FIG. 53 is a cross-sectional view of the system according to a twentieth embodiment of the present invention;

FIG. 54 is a cross-sectional view of another example of the system according to the twentieth embodiment;

DESCRIPTION OF PREFERRED EMBODIMENTS

EMBODIMENT 1

Figure 1:
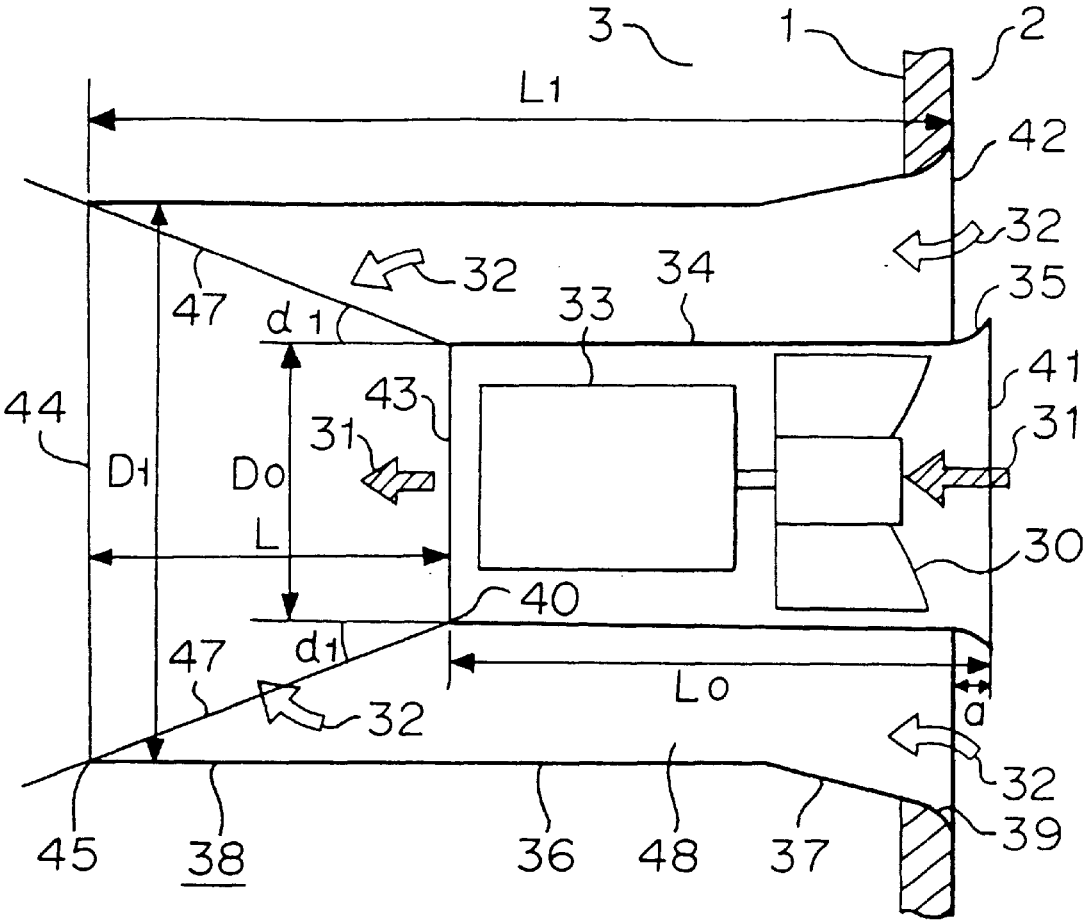
FIG. 1 is a cross-sectional view of the air ventilation or air supply system according to a first embodiment of the present invention.
Figure 2:
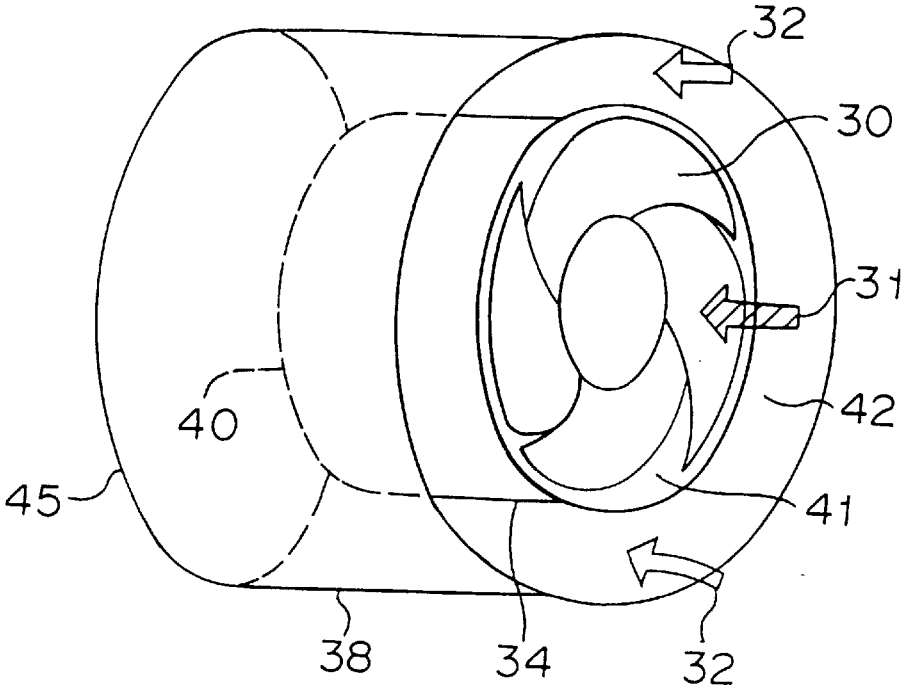
FIG. 2 is a perspective view of the system according to the first embodiment.

In FIG. 1, there is shown a sectional view of the air ventilation or air supply system according to a first embodiment of the present invention. In FIG. 2, there is shown a perspective view of the system. In these figures, reference numeral 1 designates a wall for partitioning an indoor side 2 and an outdoor side 3. Explanation will be made for a case wherein the air in the indoor side 2 is led out into the outdoor side 3 by the air ventilation or air supply system. Reference numeral 30 designates an axial fan which works as a blower for generating a primary flow 31. Reference numeral 33 designates an electric motor of 60 Hz and 100 V for driving the axial fan. Reference numeral 34 designates a casing which works as a primary flow guide for guiding the primary flow 31, which is formed in a cylindrical shape to cover the axial fan 30, and which has an end at an inlet side formed with a bell mouth 35 to reduce suction pressure loss in the primary flow 31.

Reference numeral 38 designates an induction nozzle which works as an induction portion to induce a secondary flow explained later, which is formed in a cylindrical shape so as to have a larger diameter than the diameter of the casing 34, and which is arranged coaxially with the casing 34 from the inlet side to an outlet side of the primary flow 31. The induction nozzle 38 is constituted by a cylindrical shape portion 36, a bell mouth 39 provided on an end at the inlet side to reduce suction pressure loss in the secondary flow, and a throttle connecting pipe 37 for coupling the cylindrical portion 36 and the bell mouth 39. The induction nozzle has a downstream end 45 extended to a location downstream a downstream end 40 of the casing 34. The induction nozzle 38 has an annular inlet for the secondary flow 42 provided in an inlet end of the bell mouth 39. The annular inlet is aligned with or shifted from, in a downstream direction (the lefthand side in FIG. 1), a circular inlet for the primary flow 41 which is provided in an inlet end of the bell mouth 35 of the casing 34.

In operation, when the electric motor 33 is energized to rotate the axial fan 30, the air in the indoor side 2 is sucked from the primary flow inlet 41 to produce the primary flow 31, i.e. a flow directed to an outlet 43 of the casing 34 through the casing. The primary flow 31 is blown out into the induction nozzle 38 from the outlet 43 of the casing 34. Since there is a difference in velocity at an interface, i.e. a shear surface 47, between the blown primary flow 31 and the air in the induction nozzle 38, a shear force is created between the blown primary flow and the air in the induction nozzle, causing the air in an annular space formed between the casing 34 and the induction nozzle 38 to be involved in the primary flow 31 by jet entrainment due to the shear force. This induction effect produces a flow directed to the shear surface 47 of the primary flow 31 from the secondary flow inlet 42 in the annular space, i.e. the secondary flow 32. The secondary flow 32 flows into the induction nozzle 38 from the secondary flow inlet 42 which is arranged on the indoor side 2, neighboring the primary flow inlet 41. The secondary flow is blown out into the outdoor side 3 from an outlet 44 of the induction nozzle 38 after having joined the first flow 31.

Because the primary flow inlet 41 and the secondary flow inlet 42 are provided on the same indoor side 2, the overall air ventilation or air supply volume which is led from the indoor side 2 to the outdoor side 3 by the air ventilation or air supply system is equal to the sum of the flows exhausted into the outdoor side 3 from both of the primary flow inlet 41 and the secondary flow inlet 42, allowing the air ventilation or air supply volume to be remarkably increased.

The fan is not required to be formed as a high velocity flow blowing device using compressed air produced by e.g. a compressor. Relatively low outlet velocity of fans such as the axial fan stated earlier, a centrifugal fan and a mixed flow fan can be used, minimizing the noise caused by a jet, or the noise caused by collision of a jet with an element around the jet such as the casing.

In this embodiment, a strong swirling component is created because the primary flow 31 is generated by the axial fan 30. The primary flow 31 with the swirling component which has gushed out into the induction nozzle 38 from the casing 34 has a higher degree of involution of air around the primary flow than a nonswirling jet without a swirling component, increasing the amount of entrainment of the air around the primary flow. That is to say, this embodiment can offer an advantage in that the air in the induction nozzle 38 can be effectively induced.

Now, the sizes and the performance of an example of the air ventilation or air supply system according to the embodiment will be described. The example has been made so that the diameter of the outlet 43 of the casing 34, or the diameter $D_0$ of the outlet formed inside the downstream end 40 of the casing 34 is 100 mm, that the diameter of the outlet 44 of the induction nozzle 38, or the diameter $D_1$ of the outlet formed inside the downstream end 45 of the induction nozzle 38 is 140 mm, that an axial length $L_0$ of the casing 34 is 130 mm, that an axial length $L_1$ of the induction nozzle 38 is 190 mm, that an axial distance L from the outlet 43 of the casing 34 to the outlet 44 of the induction nozzle 38 is 70 mm, and that a shifting amount "a" of the secondary flow inlet 42 to the primary flow inlet 41 in the downstream direction is 10 mm. The induction effect is not adversely affected if the shifting amount "a" is 0 or a positive value.

Since the primary flow 31 has to have a certain expansion angle so as to expand in a cone shape from the outlet 43 of the casing 34 in order to determine the sizes of the induction nozzle 38 in the system presented as the example, the following examination has been conducted in advance to find the expansion angle. First, an air supply system constituted by the axial fan 30, the electric motor 33 and the casing 34 has been operated in an open space within a dark room. Vapor generated by a humidifier has been sprayed from the primary flow inlet 41 to be mixed with a swirling jet (primary flow) so as to work as a tracer, and the swirling jet with the vapor mixed has been blown out of the outlet 43. Light which is produced by e.g. a tungsten halogen lamp located in the downstream direction of the jet has been passed through a slit to provide sheet-like light, and the sheet-like light has been irradiated to make a jet blowing state visible. The jet with which minute droplets produced from the vapor has been mixed has been irradiated by the sheet-like light to cause irregular reflection, appearing in white in an image. The jet has been photographed by a CCD camera to obtain a static image. Regarding the white irregular reflection image in the static image as the jet, the expansion angle of the jet $\alpha_1$ has been read, finding about 16 degree.

Next, the dimensions of the induction nozzle 38 have been determined based on the expansion angle $\alpha_1$. If the primary flow 31 which has been blown out of the outlet 43 of the casing 34 into the induction nozzle 38 reaches the outlet 44 at the downstream end 45 of the induction nozzle 38 without colliding with an inner wall surface of the induction nozzle 38, and if the diameter of the jet section at the outlet 44 is substantially equal to the diameter of the outlet 44, the induction amount is maximized. If the diameter of the induction nozzle 38 is small than the diameter of the jet section, the jet collides with the inner wall surface of the induction nozzle 38 concluding to increase loss, reducing the flow rate of air supply. If the diameter of the induction nozzle is much larger, a region without a main jet formed therein is created at the outlet 44 to form a reverse flow directed into the induction nozzle 38 from the downstream side through the outlet 44. This item will be further explained later on.

In this example, the axial distance L from the outlet of the casing 34 to the outlet 44 of the induction nozzle 38 has been set as shown in the equation identified below since the diameter $D_0$ of the casing 34 is 100 mm, the diameter $D_1$ of the induction nozzle 38 is 140 mm and the expansion angle of the jet is 16°:

$$L=(D_1-D_0)/(2\tan\alpha_1)\approx 70\ mm$$

When the sizes of the system are set as stated above, the section of the jet which is blown out of the outlet 43 of the casing 34 corresponds to the section of the outlet 44 of the induction nozzle 38.

The system has been driven at a rated voltage of 100 V and at 60 Hz, and the total flow rate at the primary flow inlet 41 and the secondary flow inlet 42 has been measured to find 180 $m^3$/h. On the other hand, when the flow rate of an air supply system which is constituted by the axial fan 30, the electric motor 33 and the casing 34 without provision of the induction nozzle 38 has been measured under the same input conditions, 116 $m^3$/h has been found. It has been proved that the provision of the induction nozzle 38 can generate the secondary flow to increase the flow rate by about 55%.

The expansion angle of the jet varies from systems to systems. The expansion angle of the jet was 16° in the example while e.g. a general nonswirling jet having an axisymmetrical circular shape is 6°. In the example, the jet which is blown out of the casing 34 includes a swirling component, and a centrifugal force caused by the swirling component can provide rapid diffusion just after outlet to make the expansion angle larger in comparison with the expansion angle of a nonswirling jet having an axisymmetrical circular shape blown out of an outlet having a circular shape in section. Since the expansion angle varies on the revolution of the axial fan or the shape of the fan, actual measurement is required in advance to determine the sizes of the induction nozzle.

Considering the induction mechanism, it is desirable that the cross-sectional area of the jet of the primary flow 31 which is obtained when the primary flow gushed out of the casing 34, expanded in the induction nozzle 38 at an expansion angle $\alpha_1$ and reached the outlet 44 at the downstream end 45 of the induction nozzle 38 is substantially the same as the cross-sectional area of the outlet 44.

If the diameter of the outlet 44 of the induction nozzle 38 is smaller than the diameter of the jet in section, and if the jet collides with the inner wall surface of the induction nozzle 38, the dynamic pressure which the jet has at the collision portion is partly transformed into a static pressure to produce a reverse pressure gradient in the induction nozzle 38, causing the operational point of the axial fan 30 to be shifted to a high pressure side so as to decrease the flow rate of the air supply.

Figure 3:
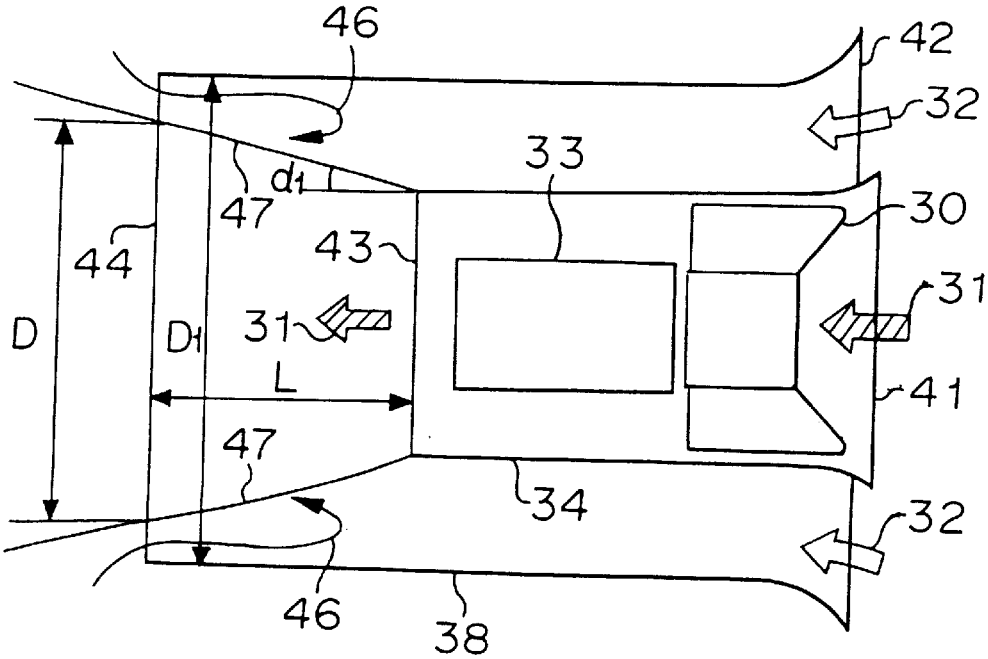
FIG. 3 is a cross-sectional view of the system according to the first embodiment, showing a relationship between an expansion angle of a jet and a diameter of an induction nozzle.

Conversely, if the diameter $D_1$ of the outlet 44 is larger than the diameter D of the jet in section at the outlet 44, an annular region without the main jet formed therein is created at the outlet 44, and a reverse flow 46 is generated at the outlet 44 to be directed into the induction nozzle 38 from the downstream side through the outlet 44 as shown in FIG. 3. The reverse flow 46 is generated by the phenomenon wherein air is sucked through a portion of the outlet 44 to compensate the air in the induction nozzle 38 which is involved in the primary flow 31 by entrainment and is discharged out of the outlet 44. In this case, the total air supply volume of the air ventilation or air supply system is reduced because the suction flow rate from the secondary inlet 42 is decreased.

When the diameter of the outlet 44 of the induction nozzle 38 is set to be the same as the diameter D of the jet in section at the outlet 44, the following equation is established.

$$D_1=D_0+2L\tan\alpha_1 \therefore D_1/(D_0+2L\tan\alpha_1)=1 \quad (1)$$

Although there is no problem in practice if the left side of the equation (1) is exactly, a smaller value than 0.5 causes a great decrease in flow rate because of pressure loss due to collision of the jet with the inner wall surface of the induction nozzle, and a larger value than 1.5 causes a great decrease in flow rate because of the reverse flow 46 from the outlet 44 into the induction nozzle 38. It is preferable that the value of the left side of the equation (1) is not less than 0.5 and not higher than 1.5.

EMBODIMENT 2

When the system according to the present invention is used as an air conveying system, it is required that a jet having an increased volume by the induction effect is conveyed for some distance without being diffused. Since the air conveying system has air conveyed to and fro between air ventilation or air supply systems without a duct, it is desirable that the jet which is blown out of an air ventilation or air supply system can reach to the other paired system for some distance without being damped.

Figure 4:
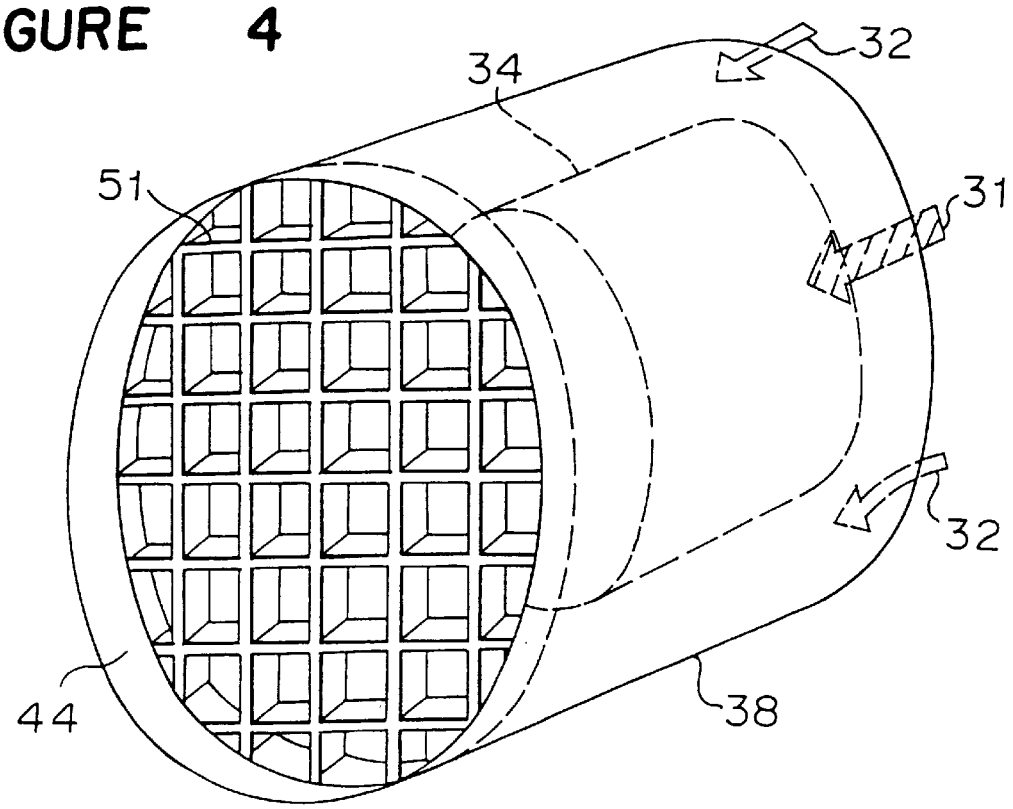
FIG. 4 is a perspective view of the system according to a second embodiment of the present invention.
Figure 5:
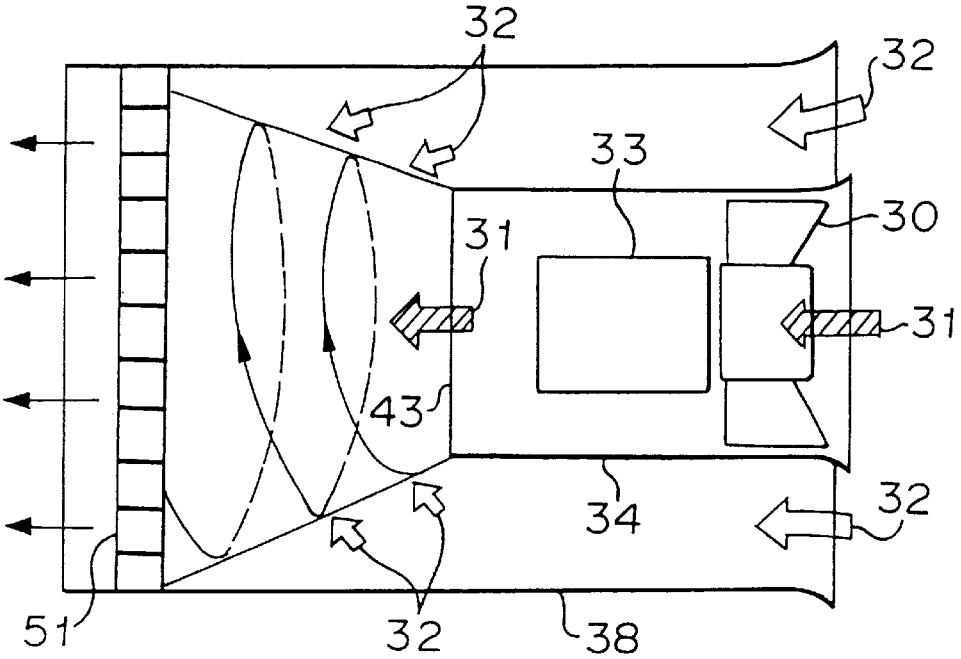
FIG. 5 is a cross-sectional view of the system according to the second embodiment.

In FIG. 4, there is shown a perspective view of the air ventilation or air supply system according to a second embodiment which is suited to such application. In FIG. 5, there is shown a sectional view of the system of FIG. 4. In these figures, reference numeral 51 designates a rectifying member which is provided in the vicinity of the outlet of the induction nozzle 38 to rectify the airflow, and which is constituted by arranging a plurality of plates in a lattice pattern so as to extend in parallel with an axial direction of the axial fan 30. Since the other features are the same as those of the first embodiment, explanation of the other features will be omitted.

In operation, when the primary flow 31 which is generated by energizing the electric motor 33 to drive the axial fan 30 is blown out of the outlet 43 through the casing 34, the primary flow includes a strong swirling component caused by revolution of the axial fan 30. The swirling jet has a first property to rapidly expand from its rotational axis in a radial direction because of its centrifugal force. In addition, the swirling jet has a second property to have more entrainment amount than a general nonswirling jet because a large extent of diffusion phenomenon is caused by momentum transfer. The latter property allows the entrainment to be effectively carried out in the induction nozzle 38, leading to an increase in the secondary flow. However, the former property contributes a decrease in the distance for which the jet can reach when the jet having an increased volume due to the induction effect in the induction nozzle 38 is blown out of the outlet 44 toward an open space. In order to eliminate the former property while holding the latter property, the rectifying member 51 are arranged in the vicinity of the outlet 44 of the induction nozzle 38.

In FIG. 5, the swirling jet of the primary flow which is gushed out of the outlet 43 of the casing 34 into the induction nozzle 38 is directed to the rectifying member 51 maintaining the swirling component while involving ambient air by the entrainment process. The rectifying member may be formed in any shape as long as the swirling component in the flow can be eliminated. Examples of the rectifying member are a rectifying grid, a honeycomb grid, a rectifying mesh, and a fan having a rotation direction reversed to the axial fan 30. The jet which has passed through the rectifying member 51 to remarkably decrease the swirling component can extend its reach in comparison with a jet which contains a swirling component at the time of blowing out of the outlet 44.

EMBODIMENT 3

Figure 6:
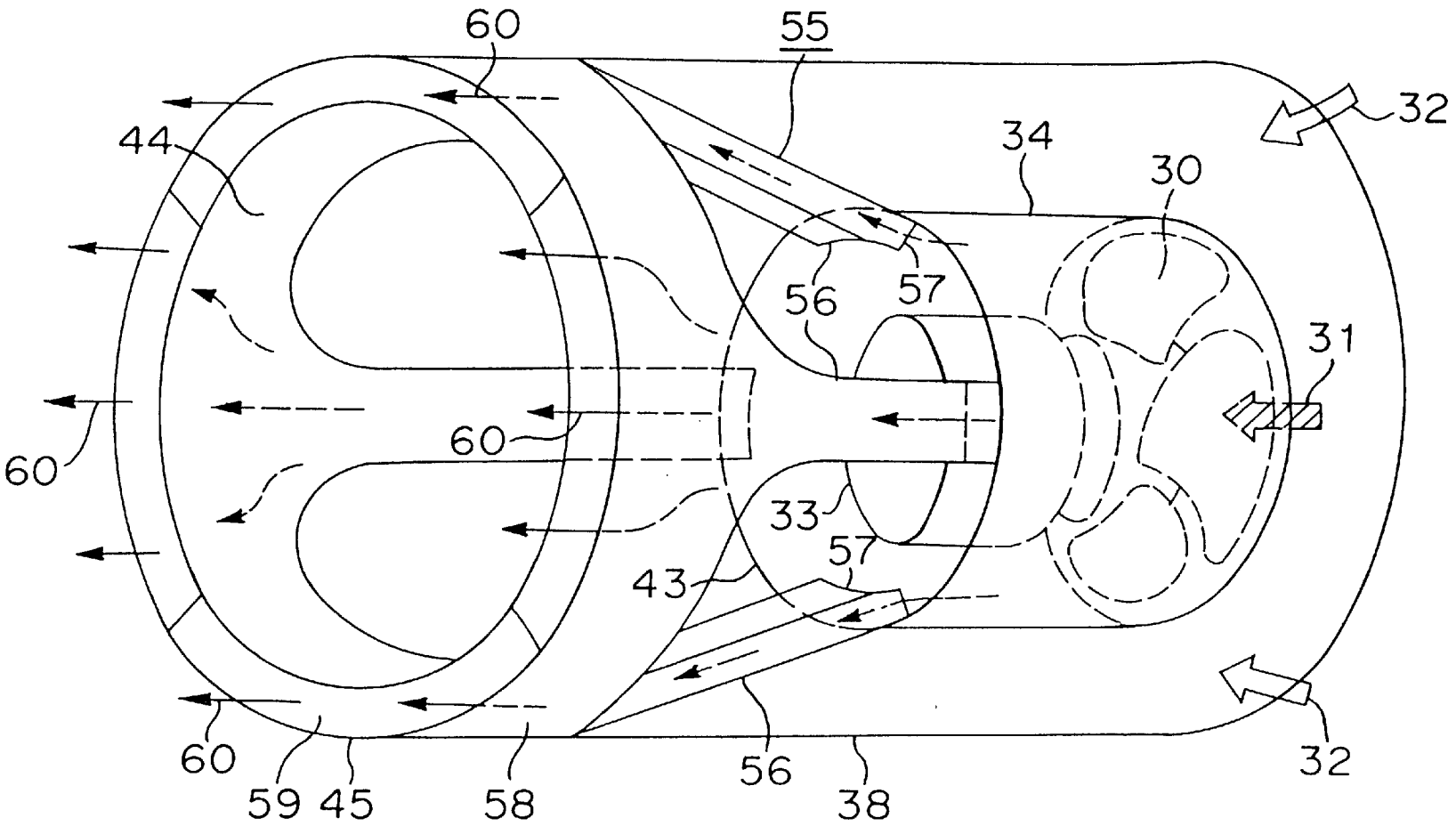
FIG. 6 is a perspective view of the system according to a third embodiment of the present invention.
Figure 7:
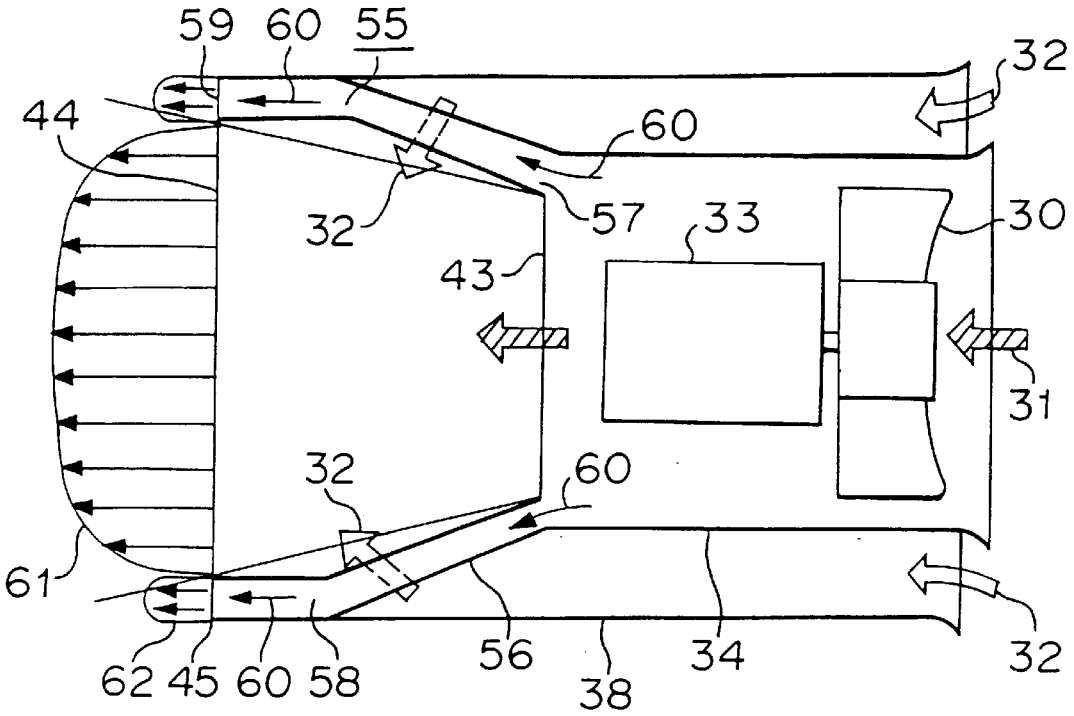
FIG. 7 is a cross-sectional view of the system according to the third embodiment.

As a measure to increase the reach of the jet blown out of the outlet, it is proposed that the entrainment amount of the blown jet is reduced to increase the reach. In FIG. 6, there is shown a perspective view of the air ventilation or air supply system according to a third embodiment, wherein the induction nozzle 38 is shown in a transparent fashion. In FIG. 7, there is shown a sectional view of the system of FIG. 6. In these figures, reference numeral 55 designates auxiliary flow ducts which allow a part of the primary flow 31 to flow from the inside of the casing 34 to a peripheral portion of the outlet 44 of the induction nozzle 38. Reference numeral 56 designates air directing ducts, each of which has one end formed with an auxiliary inlet 57 opened at the outlet 43 of the casing 34, and each of which is formed in a narrow width so as not to prevent the secondary flow 32 from flowing. Reference numeral 58 designates a dual cylindrical connecting duct which is provided around a location in touch with an inner surface of the downstream end 45 of the induction nozzle 38, or the peripheral portion of the outlet 44, and has one end smoothly communicated with the respective air directing ducts 56 and the other end formed with an auxiliary flow outlet 59 opened at the peripheral portion of the outlet 44. The respective auxiliary flow ducts 55 are constituted by the respective air directing ducts 56 and the connecting duct 58. Since the other features are the same as those of the first embodiment, explanation of the other features will be omitted.

In operation, the primary flow 31 which is generated by the axial fan 30 is blown out of the outlet 43 of the casing 34. At the same time, a part of the primary flow 31 is blown into the auxiliary flow inlets 57, and that part of the primary flow 31 enters into the air directing ducts 56 and are separated from the remaining part of the primary flow. The part of the primary flow in the air directing ducts is conveyed into the connecting duct 58, and is blown as an auxiliary flow 60 out of the auxiliary flow outlet 59. Since the width in the passage from the air directing ducts 56 to the connecting duct 58 is gradually and smoothly increased toward the downstream direction, the flow equally decelerates, and becomes an equally low velocity flow in the circumferential direction of the connecting duct 58.

The auxiliary flow 60 thus formed is gushed along the shear surface of joined gas of the primary flow 31 and the secondary flow 32 blown out of the outlet 44.

The auxiliary flow 60 is decelerated by pressure loss due to the expansion of the passage and the pipeline friction, and the auxiliary flow has a lower flow velocity at the auxiliary flow outlet 59 than the main flow with the primary flow 31 and the secondary flow 32 joined therein.

Reference numeral 61 designates a main flow velocity distribution at the outlet 44, and reference numeral 62 designates an auxiliary flow velocity distribution at the auxiliary flow outlet 59. The auxiliary flow 60 having such a lower flow velocity can be gushed along the shear surface of the main flow to relieve the shear force between the primary flow and its ambient gas, decreasing the entrainment just after blow-out. The decrease in the entrainment can extend a jet core, eventually leading to an increase in the reach of the jet. Since the air directing ducts 56 are constituted by the narrow width of ducts, the degree to which the primary flow 31 is prevented from freely blowing out into the induction nozzle 38 to reduce the induction effect is minimized.

Because the entrainment in the blow-out from the outlet 44 is reduced while the amount of the secondary flow sucked from the secondary flow inlet 32 due to the entrainment of the primary flow 31 is being kept as explained, the jet which has been increased by the induction effect can be reach at a distant location.

Figure 8:
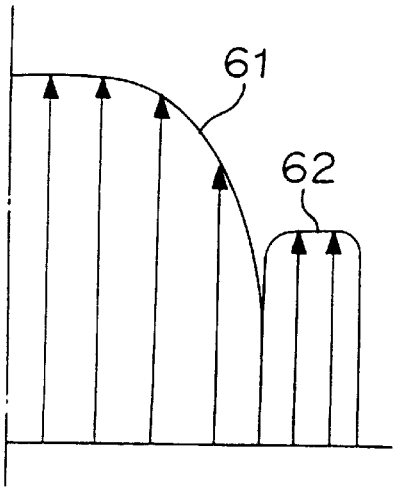
FIGS. 8(*a*) and (*b*) are velocity distributions of a main flow and an auxiliary flow in the third embodiment.
Figure 8:
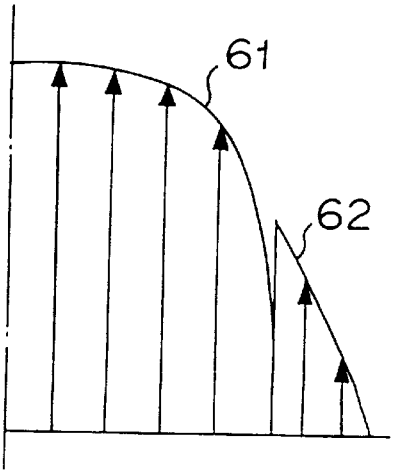

In FIG. 8, there are shown auxiliary flow velocity distributions. Even if an auxiliary flow having a rectangular shape of velocity distribution as shown in FIG. 8(*a*), a sufficient entrainment reducing effect can be obtained. If an auxiliary flow having a triangle shape of velocity distribution is gushed out so that the primary flow velocity distribution 61 has an outer edge smoothly connected to the velocity distribution of the ambient gas as shown in FIG. 8(*b*), the entrainment reducing amount can be further enlarged to extend the reach of the jet.

EMBODIMENT 4

Figure 9:
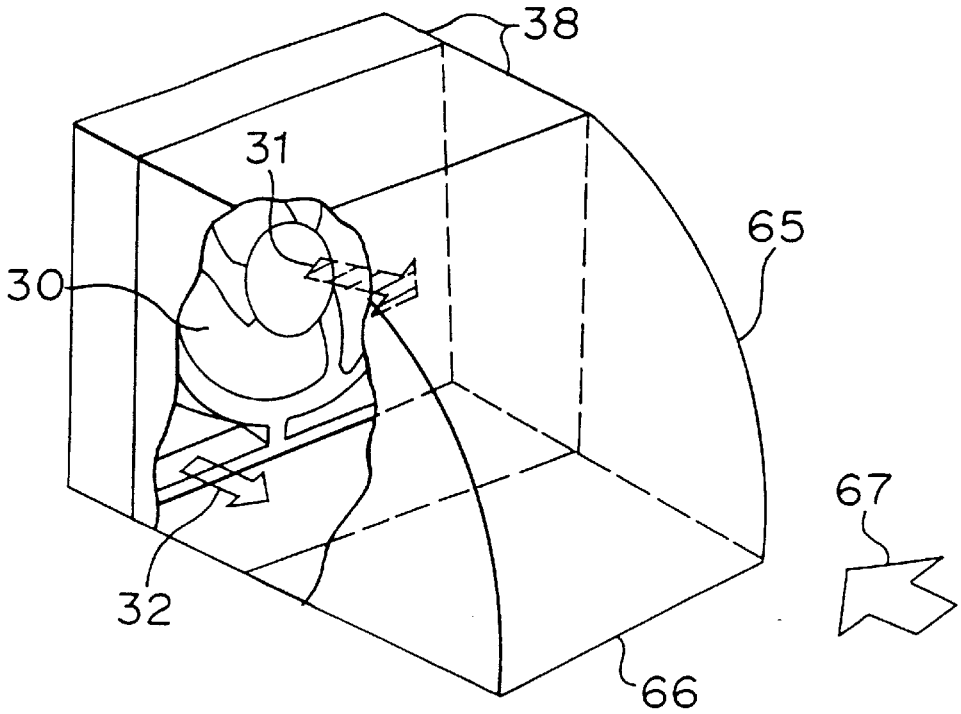
FIG. 9 is a perspective view of the system according to a fourth embodiment of the present invention.

In FIG. 9, there is shown a perspective view of the air ventilation or air supply system according to a fourth embodiment of the present invention, wherein a part of the system is fragmentarily shown, and wherein the system is used as an air ventilation system. Although the induction nozzle 38 is formed in a rectangular hollow shape, the induction nozzle works like the one according to the first embodiment. The same reference numerals as those of the first embodiment indicate similar or corresponding parts, and explanation of these parts will be omitted.

Since a conventional air ventilation system, which is constituted by a axial fan 30 and a casing 34, sucks indoor air from an inlet and exhausts the air outdoors from an outlet, the ventilation airflow is equal to the airflow of the axial fan 30. The conventional system is insufficient to ensure required ventilation flow rate for ventilation required spaces such as kitchens and sanitaries. In such spaces, an increase in the revolution of the axial fan and an increase in the diameter of the axial fan are required to establish a large amount of air ventilation. In accordance with the fourth embodiment, the induction nozzle 38 can be provided to increase the flow rate as explained with reference to the first embodiment even if the diameter of the fan is not enlarged under the same input conditions.

By the way, outdoor wind causes a problem which can not be neglected in the air ventilation system. Since outdoor wind which frequently generates in the outdoor side 3 collides with the outlet of the system and is transformed into a static pressure to increase the static pressure in the outlet of the axial fan, the difference between an indoor pressure and an outdoor pressure is increased to prevent the axial fan from working in a sufficient way. In order to cope with this problem, it is enough to provide a hood to get away from outdoor wind.

Figure 10:
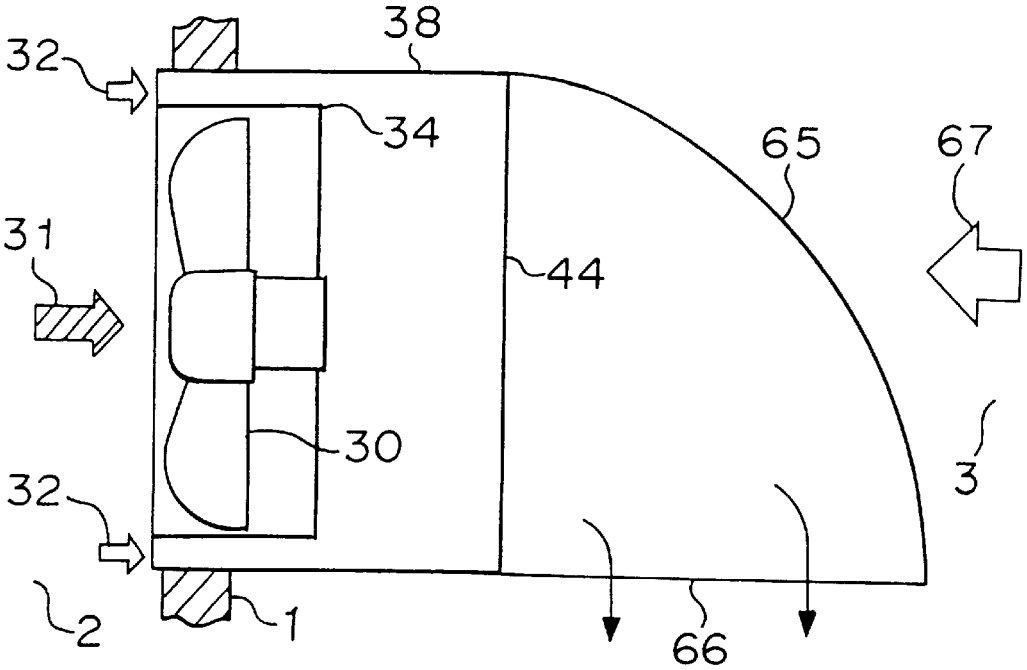
FIG. 10 is a cross-sectional view of the system according to the fourth embodiment.

In FIG. 9, reference numeral 65 designates a hood which is provided for this purpose, and which is constituted by a duct bent in an elbow shape. Reference numeral 66 designates an exhaust port which is formed on the hood 65 in a downward direction. FIG. 10 is a sectional view of the system.

Exhaust as mixed gas of the primary flow 31 and the secondary flow 32 is gushed out of the outlet 44 of the induction nozzle 38 into the hood 65. The exhaust passes through the hood 65 and is downwardly in the outdoor side 3 from the exhaust gas port 66. From whichever direction outdoor wind 67 comes, the outdoor wind is difficult to enter the hood 65, preventing the static pressure from being increased by the outdoor wind 67. In addition, rain can be prevented from entering because the exhaust port 66 is downwardly directed.

EMBODIMENT 5

Figure 11:
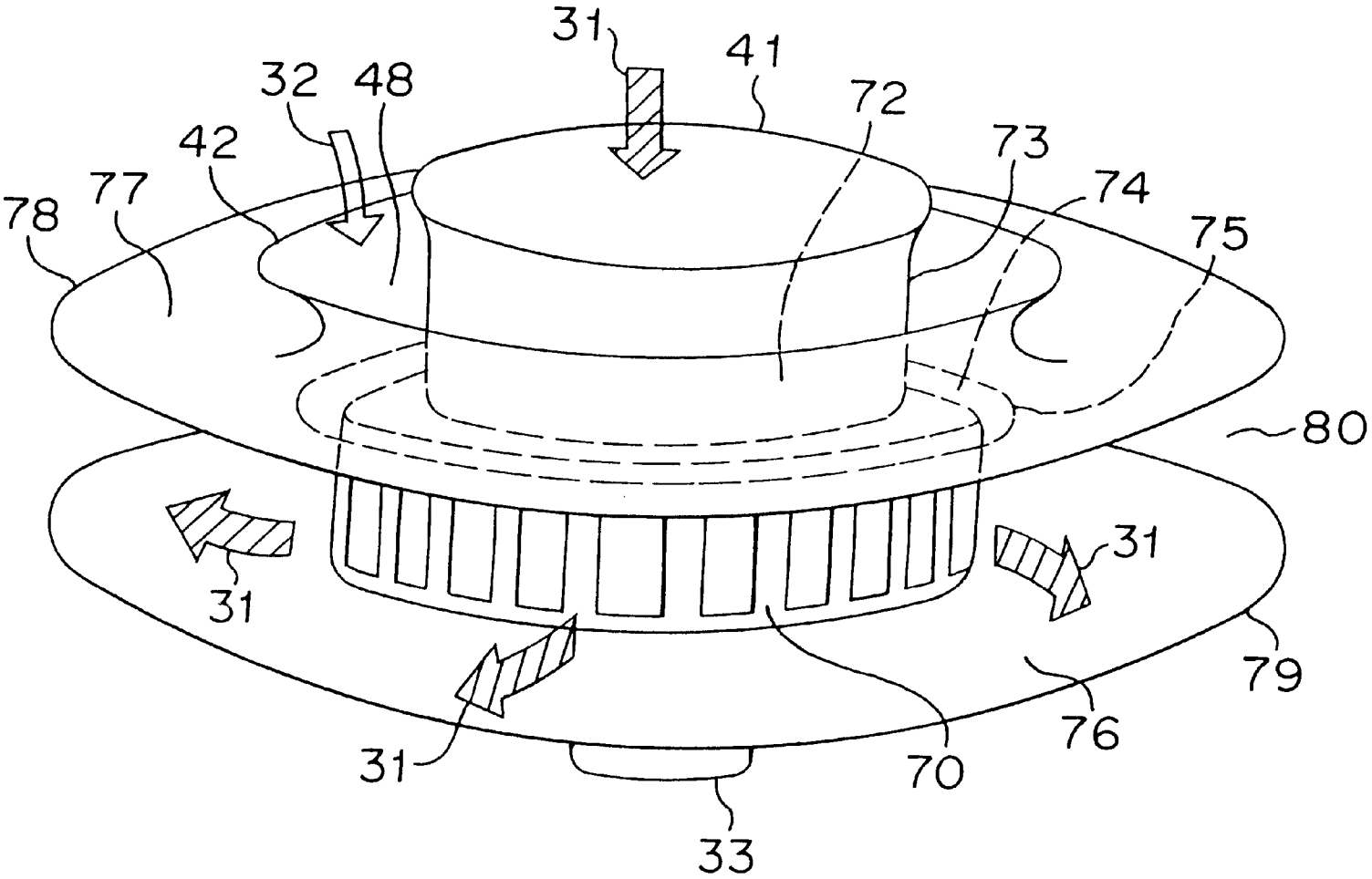
FIG. 11 is a perspective view of the system according to a fifth embodiment of the present invention.
Figure 12:
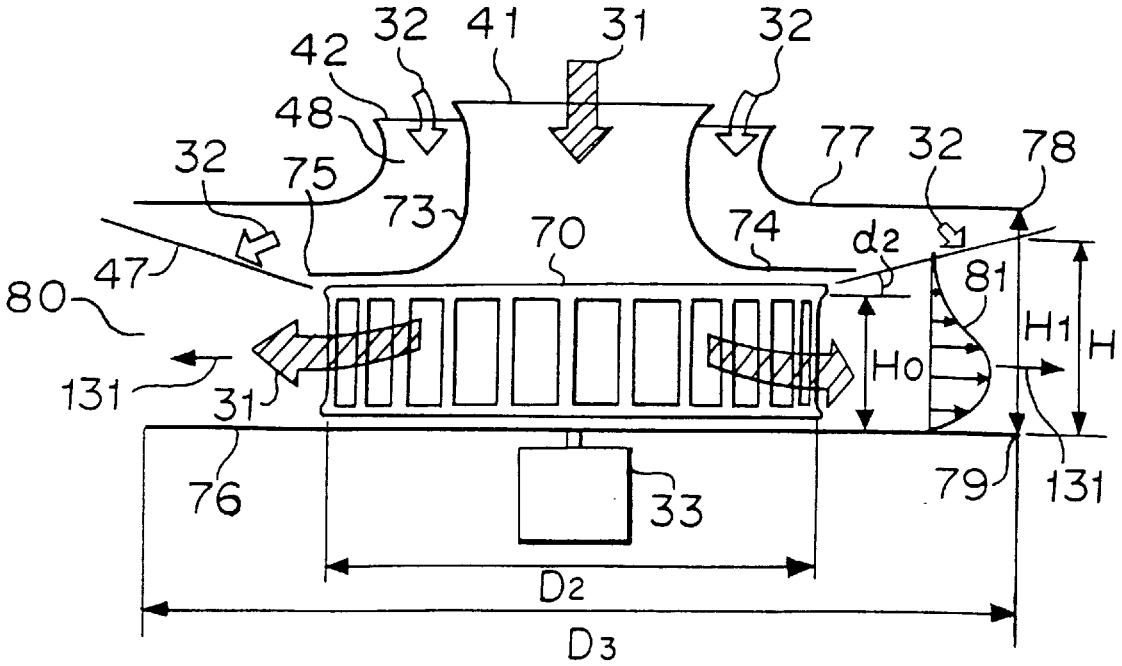
FIG. 12 is a cross-sectional view of the system according to the fifth embodiment.

Although the axial fan is used as the blower in the embodiments stated earlier, a centrifugal fan is used as the blower in this embodiment. In FIG. 11, there is shown a perspective view of the air ventilation or air supply system according to a fifth embodiment of the present invention. In FIG. 12, there is shown a sectional view of the system of FIG. 11. In these figures, reference numeral 70 designates the centrifugal fan as the blower which produces the primary flow 31 as a main component in airflow rate in air ventilation or air supply. Reference numeral 33 designates an electric motor for driving the centrifugal fan 70. Reference numeral 73 designates a cylindrical inlet which is arranged on an inlet side of the centrifugal fan 70 to work as an inlet side guide, and which has one end formed with a primary flow inlet 41 in a bell mouth shape and the other end connected to an intake port 72 of the centrifugal fan 70. Reference numeral 74 designates an annular shaped intake assistant plate which has a larger outer diameter than the outer diameter of the centrifugal fan 70 and which has an inner diameter side connected to the other end of the cylindrical inlet 73 through a smoothly connected portion. Reference numeral 76 designates a guide plate which is arranged on the side opposite to the side of the intake port 72 of the centrifugal fan 70 to guide the primary flow 31 in a radial direction, and which is formed in a circular shape to have a larger diameter than the diameter of the centrifugal fan 70. The cylindrical inlet 73 and the guide plate 76 forms a primary flow guide for guiding the primary flow 31.

Reference numeral 77 designates an induction disk as the induction portion for inducing the secondary flow, which covers the cylindrical inlet 73 at a position away from the cylindrical inlet, and which has an upstream side formed in a bell mouth shape and a downstream side formed in an annular plate shape and parallel with the guide plate 76 so that the upstream side and the downstream side are connected through a smoothly connected portion. The induction disk has a downstream end or an outer peripheral edge 78 extended beyond a downstream end of the intake assistant plate 74 or an outer peripheral edge 75 of the intake assistant plate in a downstream direction. A passage 48 for the secondary flow 32 is formed between the cylindrical inlet 73 and an induction disk 77. The induction disk 77 has an outer diameter substantially identical to the outer diameter of the guide plate 76, and an outlet 80 is formed between the outer peripheral edge 78 of the induction disk 77 and the outer peripheral edge 79 of the guide plate 76. The secondary flow inlet 42 is formed between the upstream end of the cylindrical inlet 73 of the primary flow guide and the upstream end of the induction disk 77. The secondary flow inlet 42 is arranged on the same plane as the first flow inlet 41 or shifted in a downstream direction with respect to the first flow inlet.

In operation, when the electric motor 33 is energized to rotate the centrifugal fan 70, ambient air is sucked from the primary flow inlet 41, and the sucked air arrives in the centrifugal fan 70 from the intake port 72 through the cylindrical inlet 73. This flow or the primary flow 31 is blown out of the centrifugal fan 70 in a radial form through vanes of the fan by a centrifugal force caused by the revolution of the centrifugal fan 70. The primary flow 31 which has been gushed in the radial pattern is rectified in a first space between the guide plate 76 and the intake assistant plate 74 to be directed in the horizontal direction, and is gushed into a second space between the guide plate 76 and the induction disk 77 following the first space. Reference numeral 81 represents the distribution of a radial direction velocity component in a width direction of the outlet which is included in the primary flow 31 blown out of the centrifugal fan 70. Since the primary flow 31 contacts with the air below the induction disk 77 in the second space between the guide plate 76 and the induction disk 77, a shear force due to a velocity difference between the contacted fluids is generated, causing the air below the induction disk 77 to be involved into the primary flow 31 to occur entrainment. In order to compensate for a shortage of air corresponding to the amount of the involved air, air is induced from the secondary flow inlet 42 to form the secondary flow 32.

Since the primary flow inlet 41 and the secondary flow inlet 42 are arranged on the same side (e.g. an indoor side), the inlet flow rate of the system is the sum of the primary flow 31 and the secondary flow 32, and the total flow rate of the system is increased by the flow rate of the secondary flow 32 generated by entrainment.

Because the primary flow inlet 41 and the secondary flow inlet 42 are formed in a bell mouth shape, the inlet pressure loss of both inlets can be decreased. The smooth connection between the cylindrical inlet 73 and the intake assistant plate 74 can reduce pressure loss when the secondary flow 32 passes. Consequently, the flow rate of the air ventilation or air supply system is increased by these features.

EMBODIMENT 6

Figure 13:
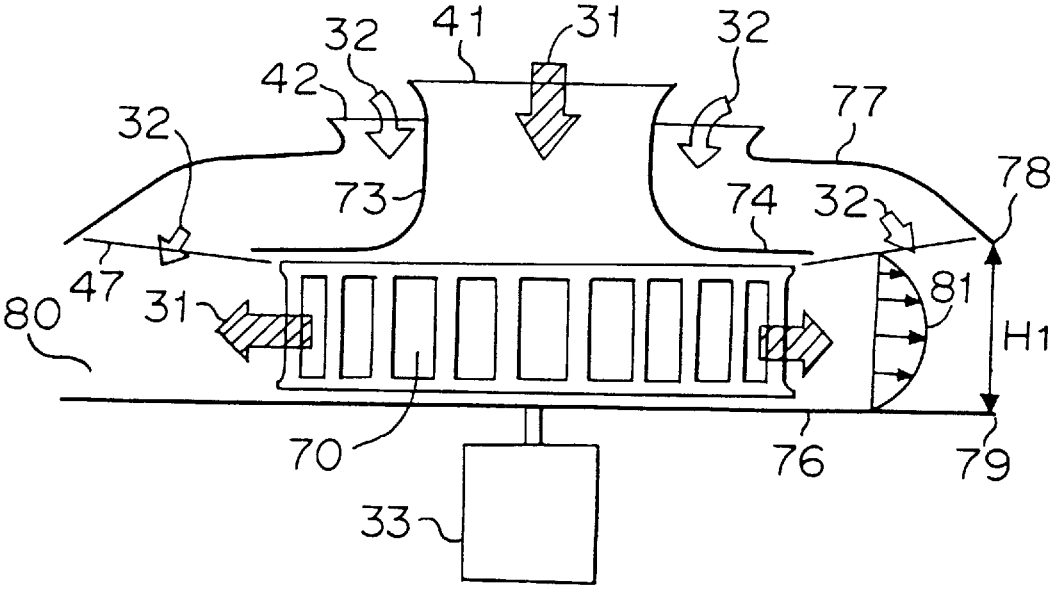
FIG. 13 is a cross-sectional view of the system according to a sixth embodiment of the present invention.

The flow which is blown out of the centrifugal fan generally exhibits a velocity distribution which is offset in a downward direction so as to have the maximum velocity in the vicinity of the guide plate 76 as shown in the velocity distribution 81 of FIG. 12. In this case, the velocity gradient of the primary flow in the vicinity of a shear surface 47 with the primary flow 31 and the secondary flow 32 contacting thereon is small to lessen a shear force applied to the shear surface. As a result, the flow rate of the induced secondary flow 32 becomes small. A sixth embodiment can improve this problem, and FIG. 13 shows a sectional view of the sixth embodiment.

Reference numeral 77 designates an induction disk which is smoothly drawn toward the guide plate 76. As a result, the space between the guide plate 76 and the induction disk 77 is gradually narrowed toward the outer peripheral edges 79 and 78. Since the other features are the same as those of the fifth embodiment, explanation on the other features will be omitted.

The diameter of the centrifugal fan 70 is defined as $D_2$, the diameter of the guide plate 76 is defined as $D_3$, the outlet width of the centrifugal fan 70 is defined as $H_0$, the outlet width of the outlet 80 is defined as $H_1$, the expansion angle of the jet (the primary flow) which is obtained by the centrifugal fan 70 when the inlet side guide 73 and the guide plate 76 are arranged without provision of the induction disk 77 to the centrifugal fan 70 is defined as $\alpha_2$ and the jet width at the outer peripheral edge 79 of the guide plate 76 under the same conditions is defined as H (see the symbols in FIG. 12).

It is desirable that the outlet width $H_1$ is slightly smaller than the jet width H. By such arrangement, the primary flow 31 blown out of the centrifugal fan 70 is contracted to relieve or eliminate the offset pattern in the velocity distribution. As a result, the velocity gradient of the primary flow in the vicinity of the shear surface 47 with the primary flow 31 and the secondary flow 32 contacting thereon can be increased to raise the induction amount by entrainment.

However, if the outlet width $H_1$ is significantly smaller than the jet width H, the cross-sectional area of the outlet of the blow-out flow with the primary flow 31 and the secondary flow 32 joined, or the area of the outlet 80 becomes small to increase pressure loss due to the presence of a contracted vein, adversely lowering the total flow rate of the system.

Figure 14:
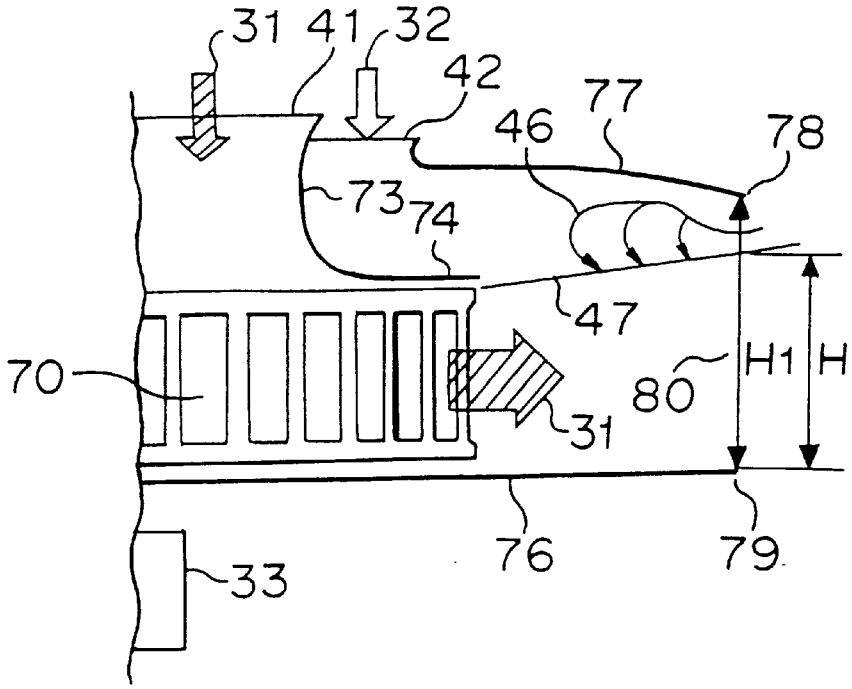
FIG. 14 is a cross-sectional view of the system according to the sixth embodiment, showing a relationship between an expansion angle of a jet and an outlet width.

Conversely, explanation of a case wherein the outlet width $H_1$ is greater than the jet width H will be made referring to FIG. 14. When the system is constructed as shown, a region without the primary flow 31 is created between the shear surface 47 and the outer peripheral edge 78 of the induction disk 77. The secondary flow 32 which is generated by entrainment of the primary flow 31 is normally supplied from the secondary flow inlet 42. When the pressure loss which is obtained when the secondary flow is passing through a space defined by the cylindrical inlet 73, the intake assistant plate 74 and the induction disk 77 is compared with the intake pressure loss which is obtained by sucking through an opened space formed between the shear surface 47 and the outer peripheral edge 78 of the induction disk 77, the latter can be smaller than the former in some cases. In such cases, a reverse flow 46 is created so as to be sucked from between the shear surface 47 and the outer peripheral edge 78 of the induction disk 77. If the reverse flow 46 is created, the intake flow rate from the secondary flow inlet 42 is decreased because the secondary flow 32 involved from the shear surface 47 is replaced by the reverse flow 46. That is to say, if the outlet width $H_1$ is too large, the reverse flow 46 from the outlet 80 which works as a short circuit to have no contribution to the entire intake airflow rate of the system is created to decrease the total airflow volume.

As can be seen from FIG. 12, the following equation is found:

$$H_1/H=2H_1/\{2H_0+(D_3-D_2)\tan\alpha_2\}$$

If $H_1/H$ is smaller than 0.5, the pressure loss at the outlet 80 is remarkably increased. If $H_1/H$ is greater than 1.5, the reverse flow from the outlet 80 is increased. It is preferable that $H_1/H$ is a value not less than 0.5 and not greater than 1.5.

Figure 15:
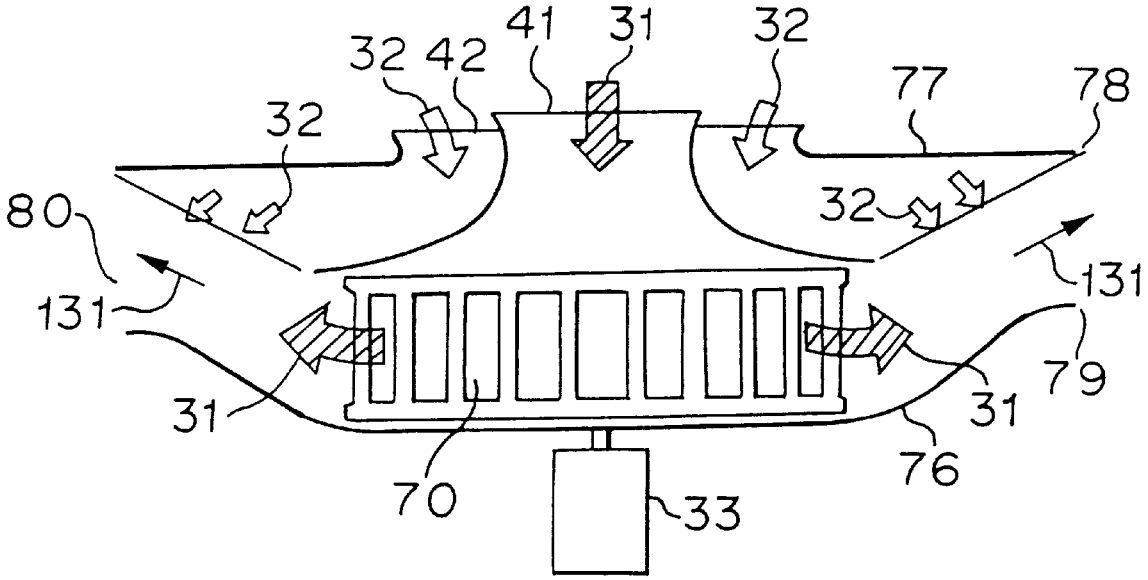
FIG. 15 is a cross-sectional view of another example of the system according to the sixth embodiment.

In order to narrow the space between the guide plate 76 and the induction disk 77, the measure shown in FIG. 15 may be adopted to draw the guide plate 76 toward the induction disk 77 to obtain smooth approach besides the arrangement wherein the induction disk 77 is approached toward the guide plate 76. Both of the guide plate and the induction disk may be drawn to be approached each other, offering a similar effect.

EMBODIMENT 7

Figure 16:
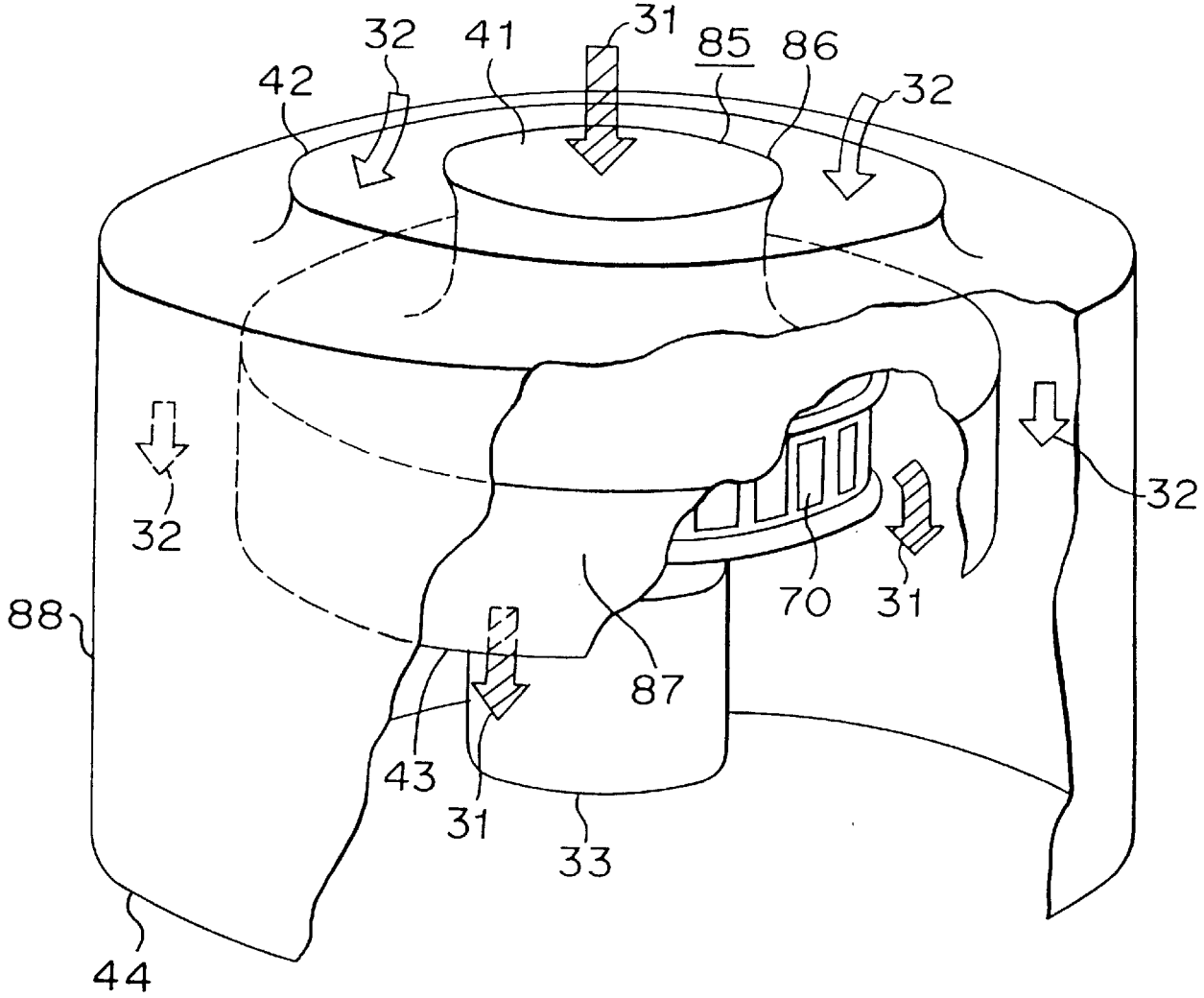
FIG. 16 is a perspective view of the system according to a seventh embodiment of the present invention.
Figure 17:
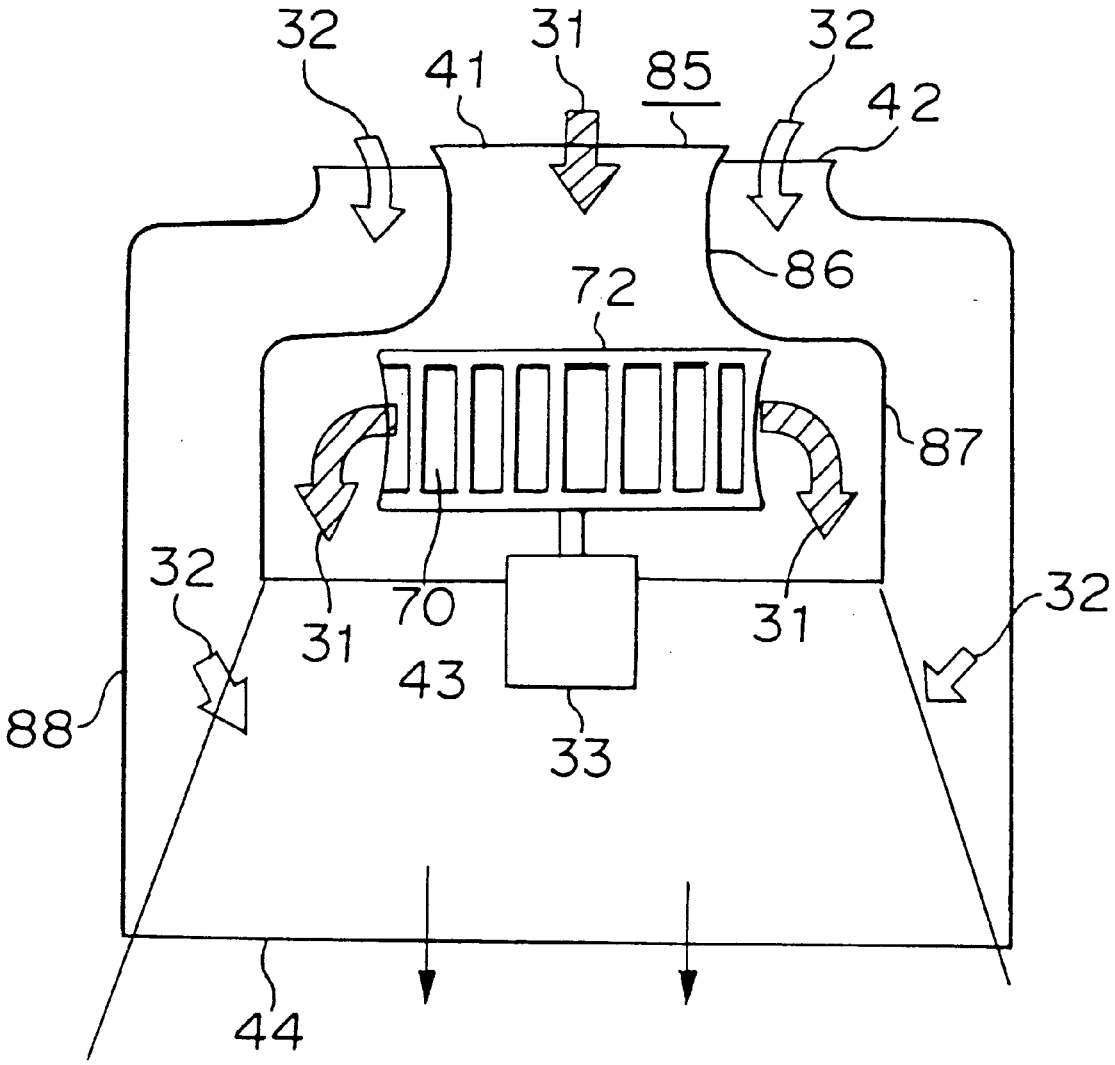
FIG. 17 is a cross-sectional view of the system according to the seventh embodiment.

Although the air blown out by the centrifugal fan is radially diffused along with the guide plate in the fifth embodiment, the outlet air may be directed to an axial direction of the fan. In FIG. 16, there is shown a perspective view of the air ventilation or air supply system according to a seventh embodiment wherein a part of the system is fragmentarily shown. In FIG. 17, there is shown a cross-sectional view of the system of FIG. 16. In these figures, reference numeral 85 designates a primary flow guide for guiding the primary flow 31. Reference numeral 86 designates a cylindrical inlet which is arranged on the intake side of the centrifugal fan 70 so as to work as an inlet side guide. Reference numeral 87 designates a primary flow guiding cylinder which is arranged on an outer diameter side of the centrifugal fan 70 so as to cover the centrifugal fan at a position away from the centrifugal fan and which works as an outlet side guide. The cylindrical inlet 86 and the primary flow guiding cylinder 87 form the primary flow guide 85. The cylindrical inlet 86 is formed in a cylindrical shape, and has one end formed with a primary flow inlet 41 in a bell mouth shape and the other end communicated with the intake port 72 of the centrifugal fan 70. The primary flow guiding cylinder 87 is formed in a cylindrical shape, and has an upstream end formed with an annular closed space between the centrifugal fan 70 and the primary flow guiding cylinder and a downstream end downwardly extended beyond a lower end of the centrifugal fan 70 so as to provide an outlet 43 for the primary flow 31.

Reference numeral 88 designates a cylindrical induction nozzle which covers the cylindrical inlet 86 and the primary flow guiding cylinder 87 at a position at away therefrom, and which has an upstream end formed in a bell mouth shape so as to provide a secondary flow inlet 42 between the cylindrical inlet 86 and itself and has a downstream end downstreamly extended beyond the downstream end of the primary flow guiding cylinder 87 so as to provide an outlet 44 for a joined flow of the primary flow 31 and the secondary flow 32. The secondary flow inlet 42 is arranged on the same plane as the primary flow inlet 41, or is arranged so as to be shifted on a downstream side with respect to the primary flow inlet.

In operation, when the centrifugal fan 70 is rotated, ambient air is sucked from the primary flow inlet 41, and the sucked air is radially discharged out of the centrifugal fan 70 after the sucked air has passed through the cylindrical inlet 86 and the inside of the centrifugal fan 70. The primary flow 31 which is radially discharged collides with an inner wall surface of the primary flow guiding cylinder 87, and the flowing direction of the primary flow is changed in an axial direction of the centrifugal fan 70 or in a downward direction in FIG. 17. The primary flow 31 which has been downwardly directed is blown out of the outlet 43 of the primary flow guiding cylinder 87 into the induction nozzle 88, having a swirling component.

Since the primary flow 31 collides with ambient air near to an inner wall of the induction nozzle 88, a shear force due to a velocity difference between both fluids is created to involve the ambient air so as to provide entrainment. In order to compensate for a shortage of air corresponding to the amount of the involved air, air is induced from the secondary flow inlet 42 to create a secondary flow 32. Since the primary flow inlet 41 and the secondary flow inlet 42 are arranged on the same side (e.g. an indoor side), the intake flow rate of the system is the sum of the primary flow 31 and the secondary flow 32, increasing the airflow rate of the system by the flow rate of the secondary flow 32 caused by the entrainment.

EMBODIMENT 8

Figure 18:
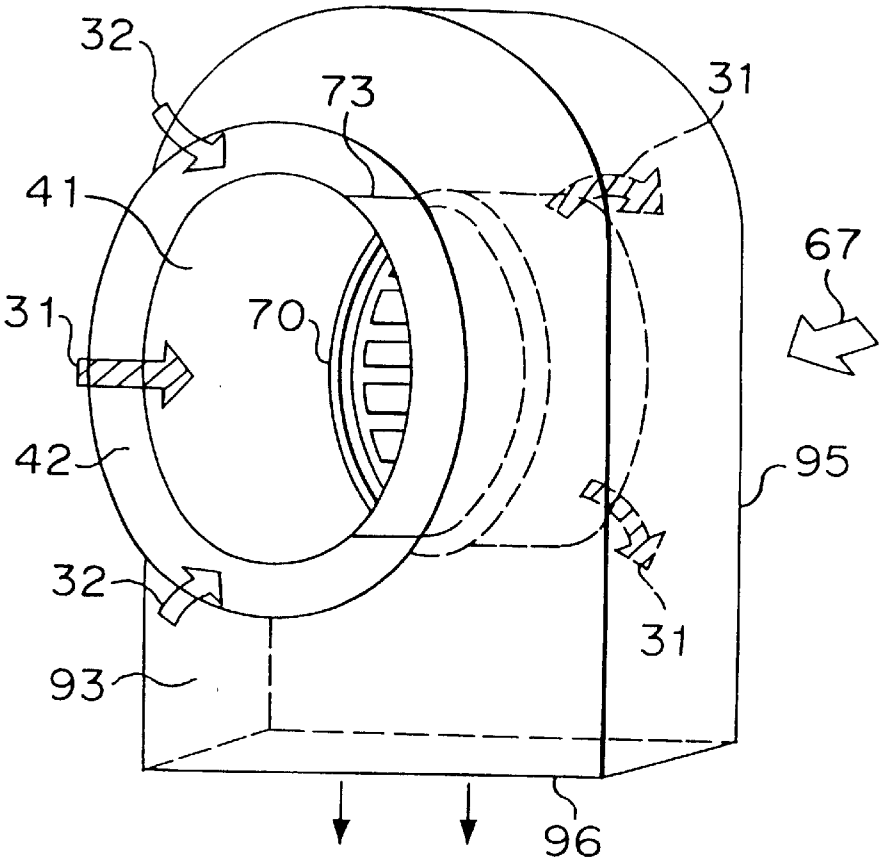
FIG. 18 is a perspective view of the system according to an eighth embodiment of the present invention.
Figure 19:
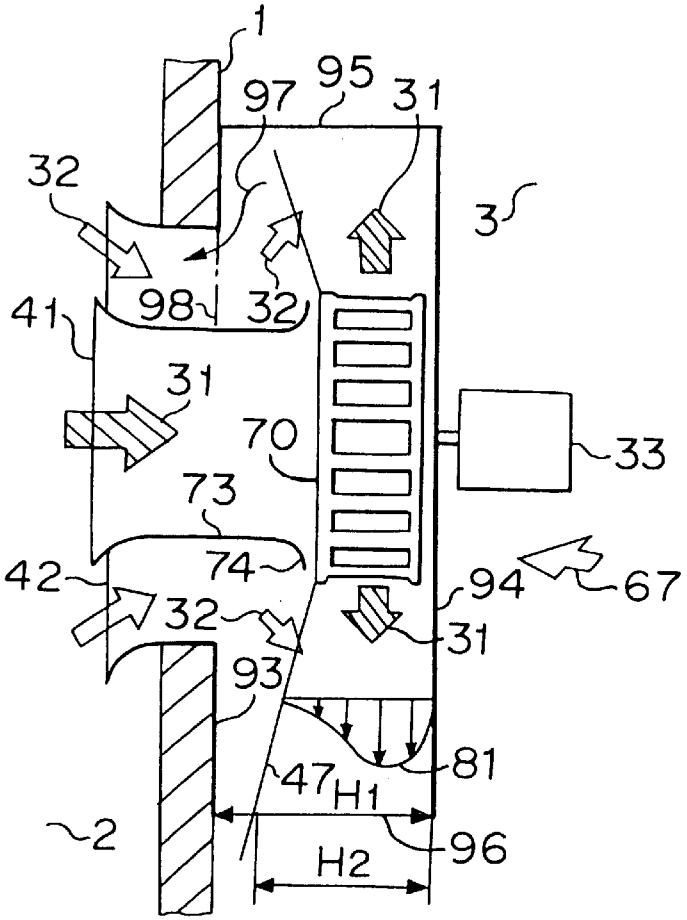
FIG. 19 is a cross-sectional view of the system according to the eighth embodiment.

In FIG. 18, there is shown a perspective view of the air ventilation or air supply system according to an eighth embodiment of the present invention. In FIG. 19, there is shown a cross-sectional view of the system of FIG. 18. This embodiment uses a centrifugal fan, and aims at avoiding an adverse effect due to outdoor wind. The centrifugal fan 70 is arrange to have an axis extended in the horizontal direction. In these figures, reference numeral 93 designates an induction disk which works like the induction disk 77 of FIG. 11, and which has a lower portion in FIG. 18 formed in a rectangular shape so as to have a U-character shaped form as a whole. Reference numeral 94 designates a guide plate which works like the guide plate 76 of FIG. 11, and which a lower portion in FIG. 18 formed in a rectangular shape so as to have a U-character shaped form as a whole like the induction disk 93. Reference numeral 95 designates a side plate which is prepared in a U-character shaped form by bending a flat plate, and which is connected to outer peripheral edges of the induction disk 93 and the guide plates 94 so as to close a space between the induction disk and the guide plate from an upper portion to opposite lateral portions and open the space only at a lower portion. The opened lower portion forms an outlet 96. Since the other features are the same as those of the fifth embodiment, explanation of the other features will be omitted.

In operation, when the centrifugal fan 70 is rotated, ambient air is sucked from the primary flow inlet 41, the sucked air is gushed from the centrifugal fan 70 into the space surrounded by the induction disk 93, the guide plate 94 and the side plate 95. Portions of the gushed primary flow 31 which have blown out to an upward direction and lateral directions are changed to be directed to the outlet 96 along the side plate 95, and are blown out from the outlet. On the other hand, a portion of the primary flow which has been downwardly blown out is blown out of directly the outlet 96. Reference numeral 81 designates a primary flow velocity distribution. At that time, a shear force is created between the primary flow 31 and a low velocity fluid existing in a space the induction disk 93 and the primary flow 31 blown out of the centrifugal fan 70, a secondary flow 32 to be involved in the primary flow 31 is generated, and the secondary flow 32 is directed to a shear surface 47 from a secondary flow inlet 42.

Since the primary flow inlet 41 and the secondary flow inlet 42 are arranged on the same side, the total airflow rate of the system is increased by the amount of the secondary flow 32. Since the outlet 96 is downwardly directed, an increase in external pressure of the centrifugal fan 70 can be prevented and invasion of rain can be avoided even if outdoor wind 67 comes from any directions in the horizontal direction. The duct which is constituted by the induction disk 93, the guide plate 94 and the side plate 95 works not only as a nozzle for producing the secondary flow 32 by use of the entrainment of the primary flow 31 but also as a hood for avoiding an increase in the external pressure due to the outdoor wind 67.

When the elements have a certain position or certain sizes, the primary flow 31 which has been upwardly blown out of the centrifugal fan 70 hits against the side plate 95, and the flowing direction of that portion of the primary flow is changed, causing a reverse flow 97 toward the secondary flow inlet 42 in some cases as shown in FIG. 19. In these cases, it is preferable to provide a partition 98 for closing an upper portion of the secondary flow inlet 42.

EMBODIMENT 9

Figure 20:
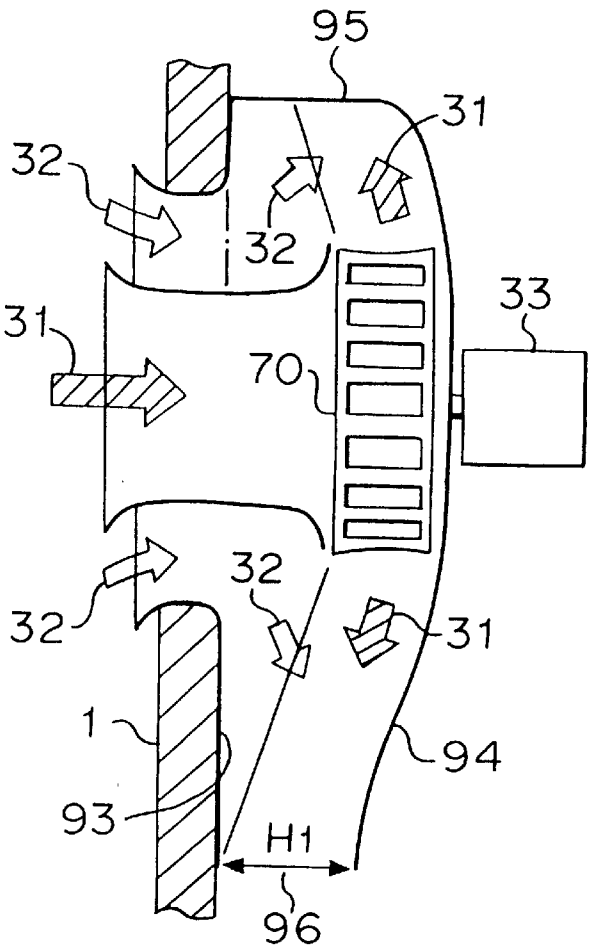
FIG. 20 is a cross-sectional view of the system according to a ninth embodiment of the present invention.

In FIG. 20, there is shown a cross-sectional view of the air ventilation or air supply system according to a ninth embodiment of the present invention. This embodiment can solve the same problem as the sixth embodiment, that is to say, can improve the offset pattern in the velocity distribution indicated by the reference numeral 81 in FIG. 19 to increase the induced primary flow 32 by narrowing the width of an outlet 96 or an outlet width $H_1$. A guide plate 94 is smoothly and gradually drawn toward an induction disk 93 to smoothly and gradually narrow a space between the guide plate 94 and the induction disk 93 toward outer peripheral edges of the guide plate and the induction disk. Since the other elements are the same as those of the eighth embodiment, explanation of these elements will be omitted.

When jet width at the outlet 96 is defined as $H_2$ under such conditions that outlet width $H_1$ is sufficiently wide and there is a region without the primary flow 31 at the outlet 96 near the induction disk 93 as shown in FIG. 19, it is desirable that the outlet width $H_1$ is adjusted to be equal to or slightly smaller than the jet width $H_2$. By such arrangement, it is possible to enlarge the secondary flow without an increase in the pressure loss at the outlet 96.

Figure 21:
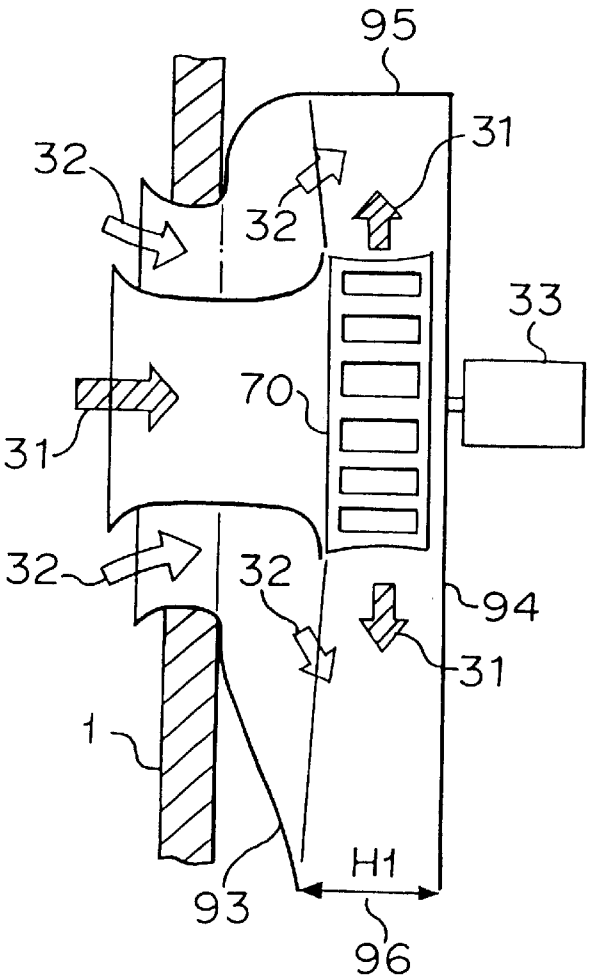
FIG. 21 is a cross-sectional view of another example of the system according to the ninth embodiment.

In FIG. 21, there is shown an example wherein the induction disk 93 is smoothly and gradually drawn toward the guide plate 94 to narrow the space between the disk and the plate so as to reduce the outlet width $H_1$. It is also acceptable to draw the disk and the guide plate so as to make both approached. Such arrangement can offer a similar effect.

EMBODIMENT 10

Figure 22:
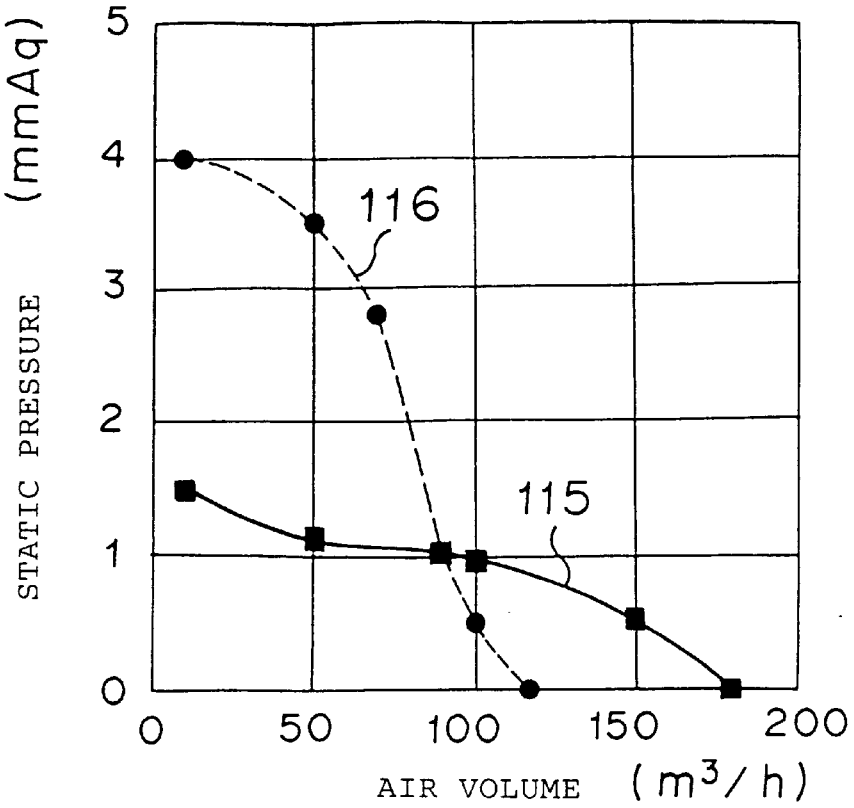
FIG. 22 is a graph showing the flow rate-static pressure characteristics of the system according to the first embodiment.

Explanation of the first through the fourth embodiments has been made with respect to the air ventilation or air supply system wherein an axial fan is used as the blower for producing the primary flow 31. These embodiments aim at remarkably increasing the airflow rate in such a state wherein no pressure loss is added (open side). In FIG. 22, there is shown an flow rate-static pressure characteristics, wherein reference numeral 115 represents an flow rate-static pressure characteristic curve indicative of the air supply performance of the system according to the first embodiment or shown in FIG. 1. Reference numeral 116 represents a curve indicative of a usual, or noninduction type system, which shows the air supply performance curve of a conventional blower which is the same as the system shown in FIG. 1 except for the absence of the induction nozzle 38. As can be seen from this figure, the system shown in FIG. 1 can provide 1.55 times the airflow rate of the conventional blower on the open side (the static pressure is 0 mmAq) while the system shown in FIG. 1 has a lower static pressure than the conventional blower on a shutoff side wherein the airflow rate is near to 0 $m^3/h$, which is caused e.g. when outdoor air hits against an outlet surface to raise the static pressure or a duct having great pressure loss is connected. This is because all portions of the primary flow 31 are not gushed from the outlet 44 of the induction nozzle due to addition of pressure loss to the outlet 44 of the induction nozzle on the shutoff side, and a portion of the primary flow 31 flows back in a route to the primary flow inlet 42 from the inside of the induction nozzle 38 having smaller pressure loss. This phenomenon causes a decrease in the static pressure on the shutoff side of the system according to the first embodiment with the secondary flow inlet 42 provided therein. Now, a measure to increase the static pressure on the shutoff side will be explained.

Figure 23:
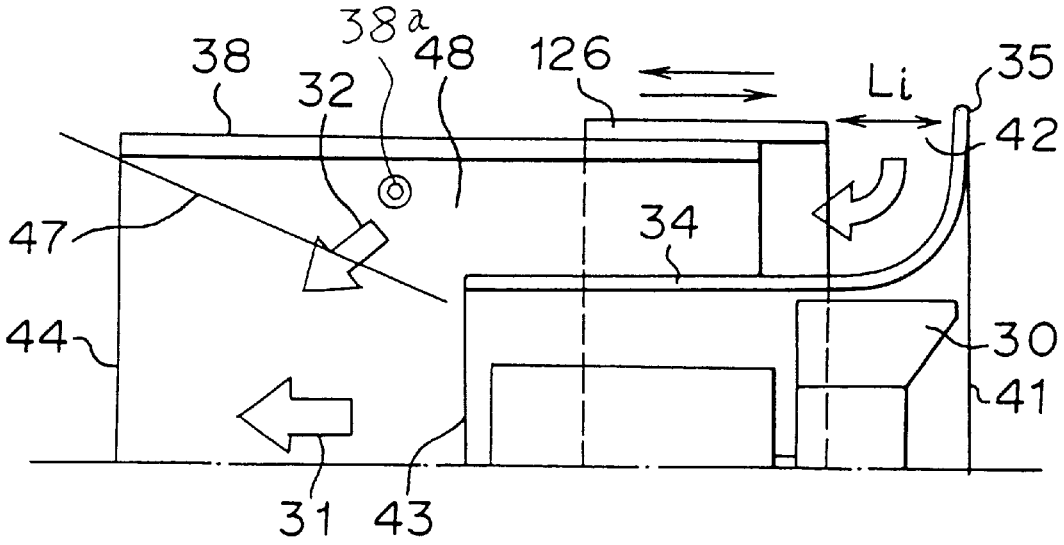
FIG. 23 is a cross-sectional view of the system according to a tenth embodiment of the present invention.

In FIG. 23, there is shown a cross-sectional view of the air ventilation system according to a tenth embodiment of the present invention, which is in a plane along the central axis of the system, and wherein an upper half of the system is shown. Explanation of parts similar to those of the first embodiment will be omitted. In this figure, reference numeral 126 designates a slide shutter as secondary flow passage opening and closing means in a cylindrical shape, which is fitted on a circumferential portion of the inlet side of the induction nozzle 38 in a cylindrical shape, and which can be slided along the induction nozzle 38 in the axial direction thereof to arbitrarily change the secondary flow inlet 42 defined by the upstream end of the induction nozzle 38 and the bell mouth provided on the primary flow inlet 41 so as to carry out opening and closing control. In comparison with the system according to the first embodiment shown in FIG. 1, the system according to the tenth embodiment is characterized in that the outer peripheral edge of the bell mouth of the primary flow inlet 41 has the same diameter as or a greater diameter than the outer peripheral edge of the induction nozzle, and that the upstream end of the induction nozzle 38 and the outer peripheral edge of the bell mouth have such a shape that they are parallel or are relatively slided to provide complete shutoff.

Figure 24:
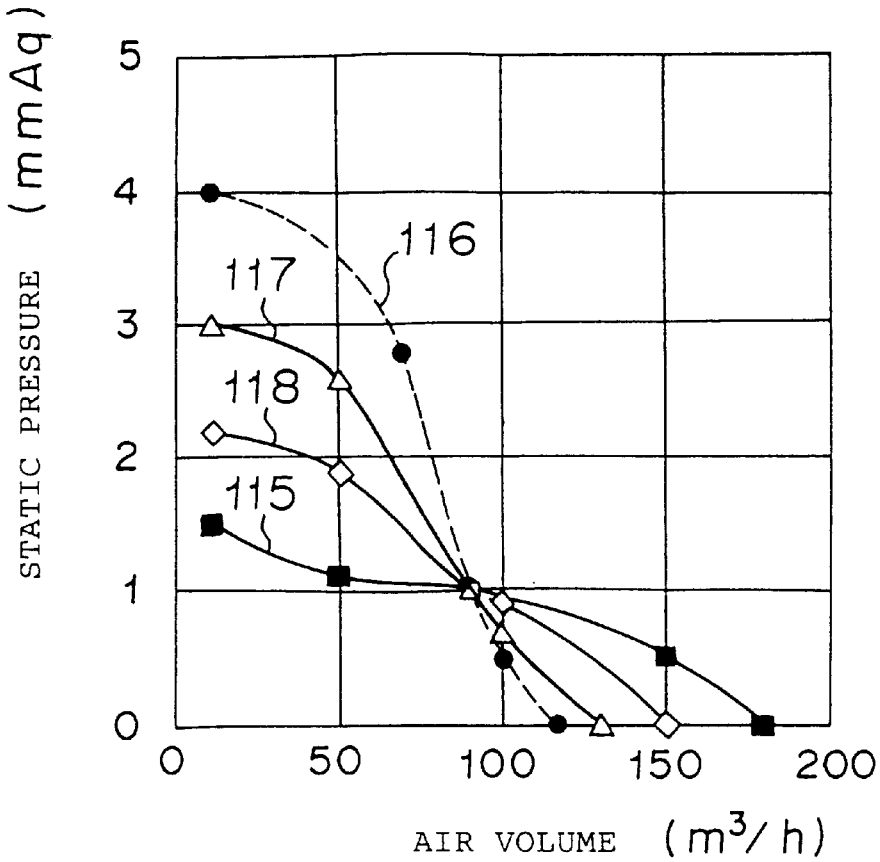
FIG. 24 is a graph showing the flow rate-static pressure characteristics of the system of FIG. 23.

The operation of this embodiment will be explained. In FIG. 23, the opening width of the primary flow inlet 42 which is formed in a space between the slide shutter 126 and the bell mouth 35 is defined as Li. In FIG. 24, there are shown flow rate-static pressure characteristic curves which are obtained when the slide shutter 126 is slided in the axial direction of the induction nozzle 38 to change Li to 0 mm (a usual blower), 10 mm, 20 mm and 30 mm (fully open), and which are indicated by reference numerals 116, 117, 118 and 115, respectively. The curves 115 and 116 are the same as the ones shown in FIG. 22. From this figure, it is seen that the greater the opening width Li is, the more the airflow rate on the open side (static pressure near 0 mmAq) is while the less the static pressure on the shutoff side (0 $m^3/h$ of airflow rate) is.

Such arrangement can obtain required static pressure by guiding the slide shutter 126 toward the bell mouth 35 of the primary flow inlet 41 to set the secondary flow inlet 42 at an open state, a closed state or an intermediate state depending on conditions even if the system is used for environment requiring a great static pressure.

In order to obtain a higher static pressure, it is sufficient to prevent the air from flowing back through the secondary flow inlet 42. Since no entrainment is created on a shear surface 47 of a primary flow 31 into the induction nozzle 38 in case of back flow, the inside of the nozzle changes to a positive pressure without having a negative pressure. This phenomenon can be utilized to automatically control the shutoff static pressure of the system. An automatic feed device such as a combination of a ball thread and an electric motor may be used to move the slide shutter 126 so as to have a desired value of the opening width Li. The static pressure in the secondary flow passage 48, e.g. on the inner wall surface of the induction nozzle 38 is detected by a sensor. When the detected value is greater than the atmospheric pressure in a space with the gas to be sucked present, the slide shutter 126 is moved toward the bell mouth 35 of the primary flow inlet 41 to gradually decrease the opening width Li so as to be inversely proportional to a static pressure difference, or when the pressure in the induction nozzle 38 is lower than the atmospheric pressure, the secondary flow inlet is fully opened. When the detected value becomes even a little greater than the atmospheric pressure in the space, the feed device is used to control the slide shutter 126 so as to have a fully closed state. In this manner, a desired shutoff static pressure can be attained to obtain a high static pressure.

Figure 25:
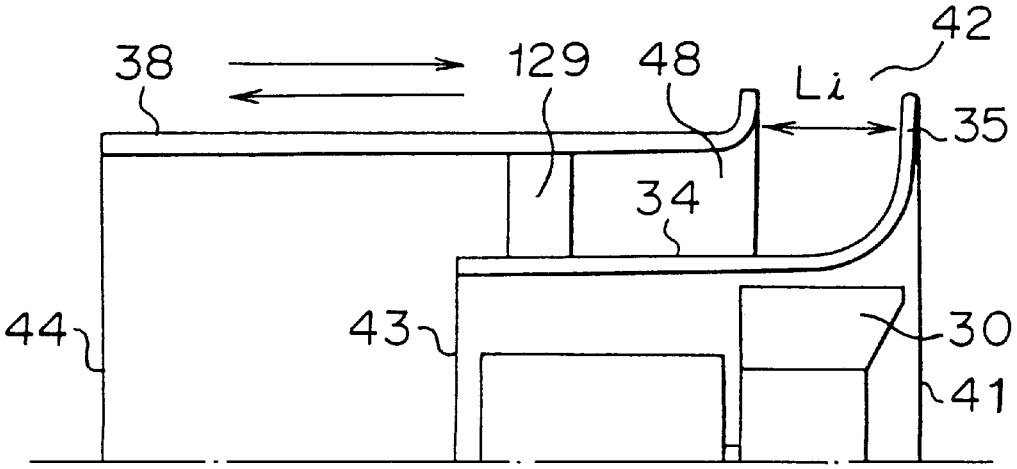
FIG. 25 is a cross-sectional view of another example of the system according to the tenth embodiment.

Although the embodiment shown in FIG. 23 is constructed so that the cylindrical slide shutter 126 is arranged between the induction nozzle 38 and the bell mouth 35 of the secondary flow inlet 41, the induction nozzle 38 may be constituted so that the induction nozzle is slidable in the axial direction of the nozzle through an induction nozzle support 129 for attaching the nozzle to a casing 34 of the fan 30 as shown in FIG. 25. The induction nozzle support 129 may be fixed to the induction nozzle 38 to perform a sliding movement with respect to the casing 34, or is fixed to the casing 34 to perform the sliding movement with respect to the induction nozzle 38. The induction nozzle 38 can be slided through the induction nozzle support 129 with a sliding mechanism to make the opening width Li of the secondary flow inlet 42 variable, offering a similar effect.

Detecting a static pressure on the inner wall surface of the induction nozzle 38 may be carried out, moving the induction nozzle 38 by a feed device so as to obtain a desired value of the opening width Li. Checking a difference between the detected static pressure and atmospheric pressure, the induction nozzle 38 can be moved fro and back in the axial direction to change the opening width Li of the secondary flow inlet 42, controlling the static pressure on the shutoff side.

Figure 26:
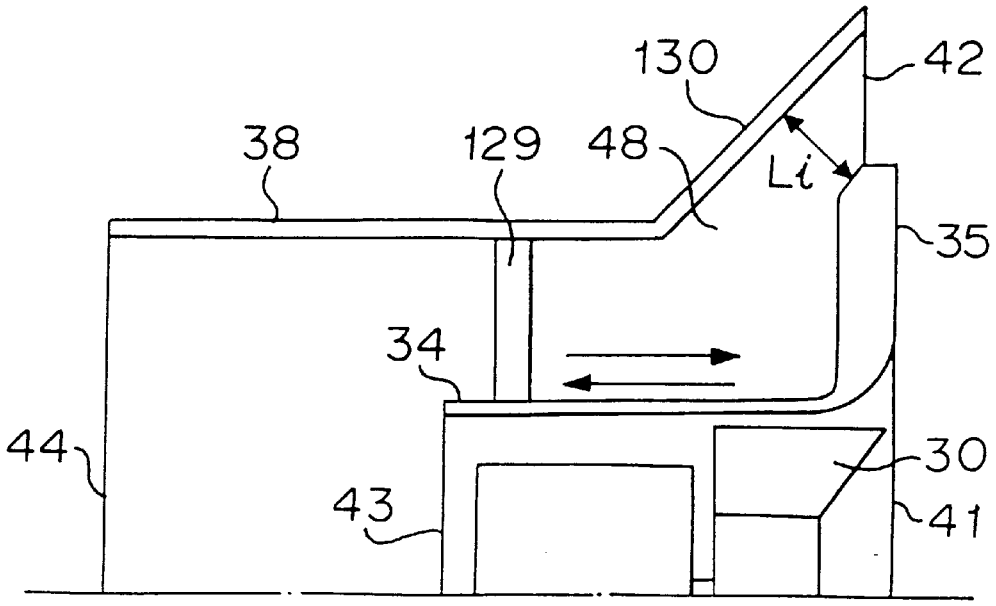
FIG. 26 is a cross-sectional view of another example of the system according to the tenth embodiment.

Referring now to FIG. 26, an enlarged portion 130 for the secondary flow is arranged to be connected to the secondary flow inlet 42, the enlarged portion for the secondary flow inlet has a greater diameter than the primary flow inlet 41, and the outer peripheral edge of the bell mouth 35 of the primary flow inlet 41 is formed so that the outer peripheral edge can form a contacting surface with an inner wall of the enlarged portion 130 to provide air tightness. The induction nozzle 38 and the casing 34 are coupled together through the slidable induction nozzle support 129 like the embodiment of FIG. 25, and the casing 34 can be slided in the axial direction of the casing. In the case of FIG. 26, the induction nozzle 38, to which the enlarged portion 130 is connected, is fixed. The casing 34 with the axial fan 30 therein can be slided in the axial direction through the induction nozzle support 129 to arbitrarily regulate the opening width Li between a space defined by an inner wall of the enlarged portion 130 and the bell mouth of the primary flow inlet 41. The embodiment of FIG. 26 can offer an effect to provide a higher static pressure like the embodiments of FIG. 23 and 25. The static pressure on the inner wall in the induction nozzle 38 is detected, and the opening width Li is automatically changed depending on a difference between the detected static pressure and atmospheric pressure to attain an arbitrary shutoff pressure, obtaining a higher static pressure.

Figure 27:
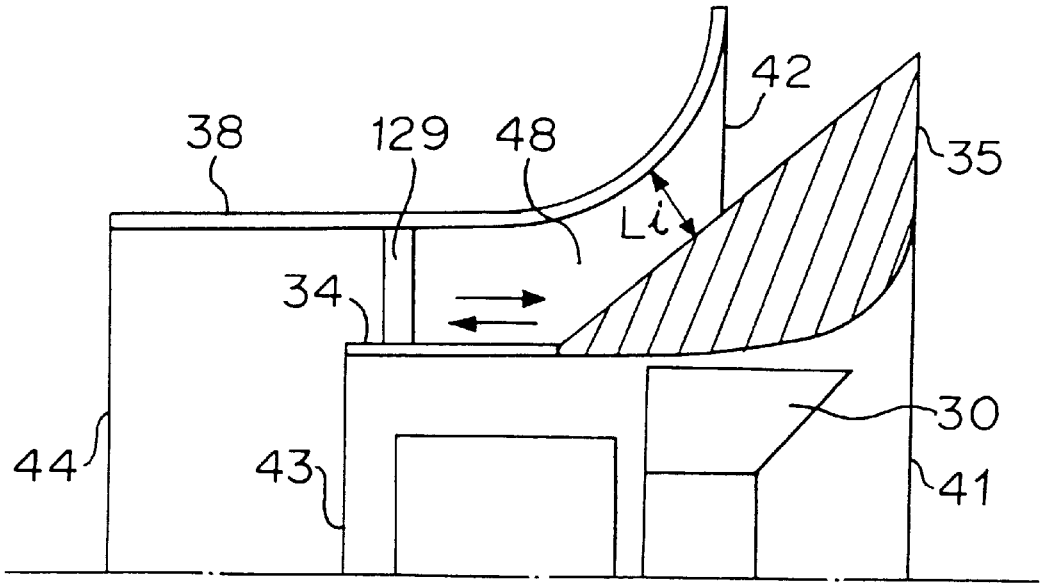
FIG. 27 is a perspective view of another example of the system according to the tenth embodiment.

Although the induction nozzle 38 is formed in a conical shape to provide the enlarged portion 130 for the secondary flow inlet in FIG. 26, the casing 34 may be formed in a conical shape as shown in FIG. 27 to offer a similar effect. In such a case, the air supply performance can be further improved if the inside of the casing 34 is formed in a bell mouth shape to reduce pressure loss at the primary flow inlet.

In FIG. 28, there are shown a perspective view of means for changing the opening rate of the secondary flow inlet 42, wherein an enlarged portion indicated by S in (*a*) is shown in (*b*). In FIG. 28, a ring-shaped plate 150 with a plurality of openings 152 formed therein is fitted into the secondary flow inlet 42 of a system similar to the one shown in FIG. 1. The ring-shaped plate is formed with a slide valve 127 for closing each of the openings at an arbitrary rate and a slide valve support 128 for mounting the slide valve 127 so as to slidable along the ring-shaped plate 150.

The slide valve can be moved in directions indicated by arrows shown in FIG. 28(*b*) to change the opening rate of the second flow inlet 42. For example, in order to increase the shutter static pressure, the slide valve 127 is slided to decrease the opening rate of the secondary flow inlet 42. By such arrangement, a higher static pressure can be established like the opening rate changing mechanism shown in FIGS. 23, 25, 26 and 27. A feed device for controlling the opening and closing of the slide valve 127, and the static pressure sensor 38*a* in the nozzle 38 can be provided to automatically control the slide valve 127.

EMBODIMENT 11

It is shown in the tenth embodiment that the opening rate of the secondary flow inlet 42 can be arbitrarily regulated to change the shutoff static pressure, establishing a higher static pressure. However, the tenth embodiment has a problem in that if the opening rate of the secondary flow inlet 42 is decreased to increase the static pressure on the shutoff side, the increased amount of the airflow rate on the open side is conversely decreased at that opening rate. Now, a measure wherein the secondary flow inlet 42 can be formed with a shutter automatically opened and closed depending on the static pressure in the secondary flow passage to deal with not only a state requiring a high static pressure on the shutoff side but also a state requiring a large airflow rate on the open side will be explained.

Figure 29:
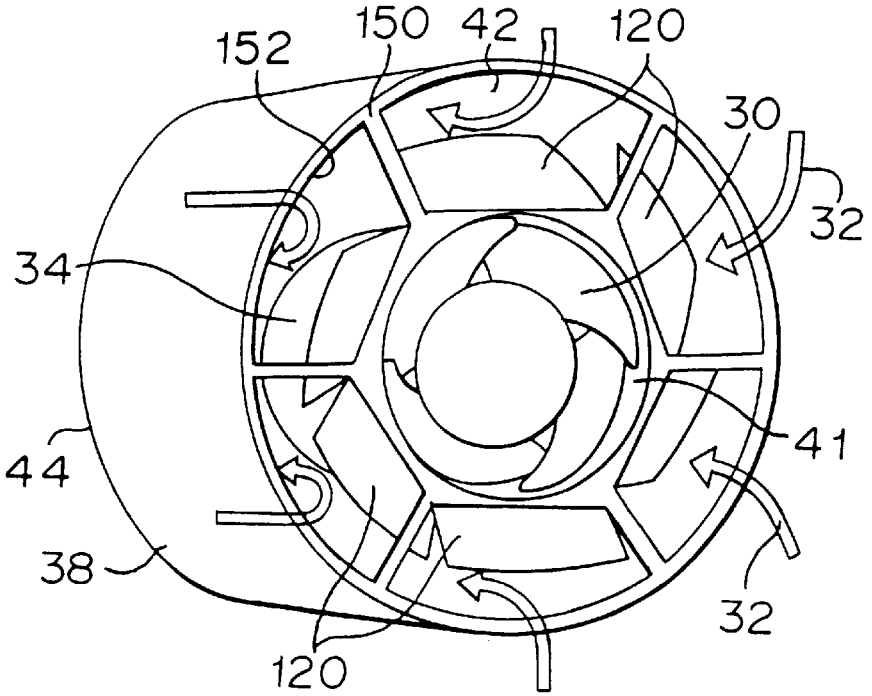
FIG. 29 is a perspective view of the system according to an eleventh embodiment of the present invention.
Figure 30:
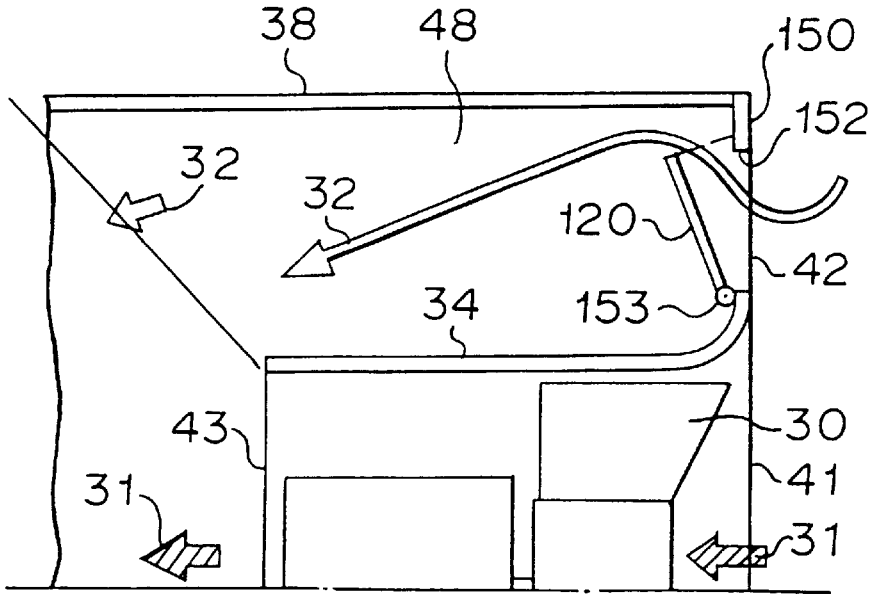
FIG. 30 is a cross-sectional view of the system of FIG. 29.

In FIG. 29, there is shown a perspective view of the air ventilation or air supply system according to an eleventh embodiment of the present invention, wherein induction shutters 120 are provided in addition to the arrangement of the system according to the first embodiment shown in FIG. 1. Explanation of similar parts will be omitted like explanation of the tenth embodiment. In FIG. 30, there is shown a cross-sectional view of the system, which is in a plane including the central axis of the system, and wherein an upper half of the system is shown. In these figures, reference numeral 120 designates the openable and closable induction shutters which are arranged in the induction nozzle 38 at the secondary flow inlet 42. The secondary flow inlet 42 is formed with a ring-shaped plate 150 having a plurality (6 in this figure) of openings 152. The induction shutters 120, which are made of a material having a small weight and some extent of solidity such as a thin sheet of celluloid, plastics and styrene foam, are attached to the casing by supports 153 so as to be smoothly openable and closable. With respect to a method for supporting the induction shutters 120, there are e.g. a method wherein the support 153 for each of the induction shutters 120 is formed in a cylindrical shape, a linear member such as an iron core and a wire is inserted into the cylindrical portion and opposite ends of the linear member are fixed to the ring-shaped plate 150 or the inlet of the casing 34 so as to be rotatable, and a method using an openable and closable member such as a hinge. Whichever method is adopted, smooth opening and closing operation of the induction shutters 120 must be taken into account.

Figure 31:
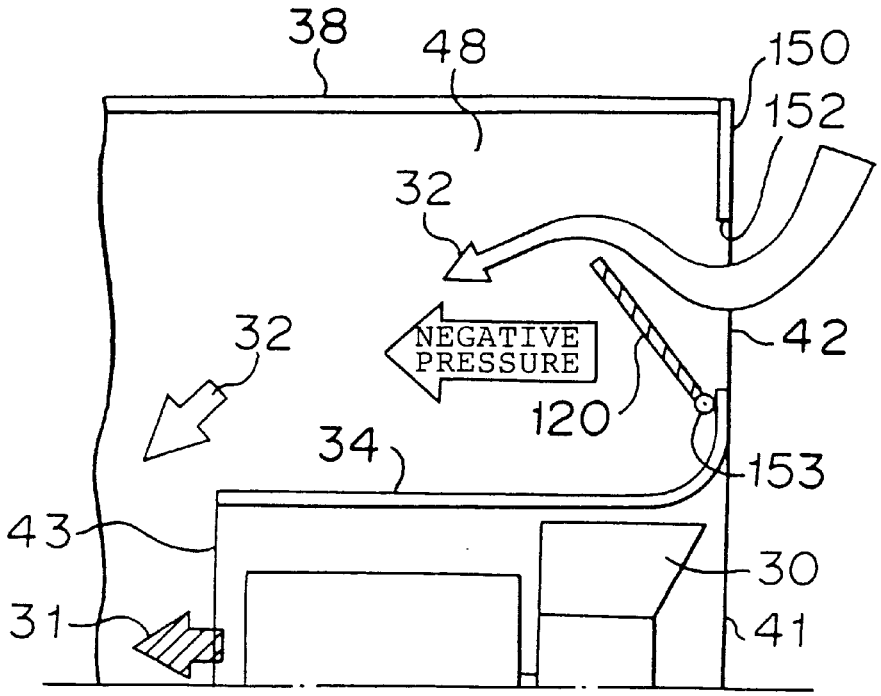
FIGS. 31(*a*) and (*b*) are cross-sectional views showing the operation of the system of FIG. 29.
Figure 31:
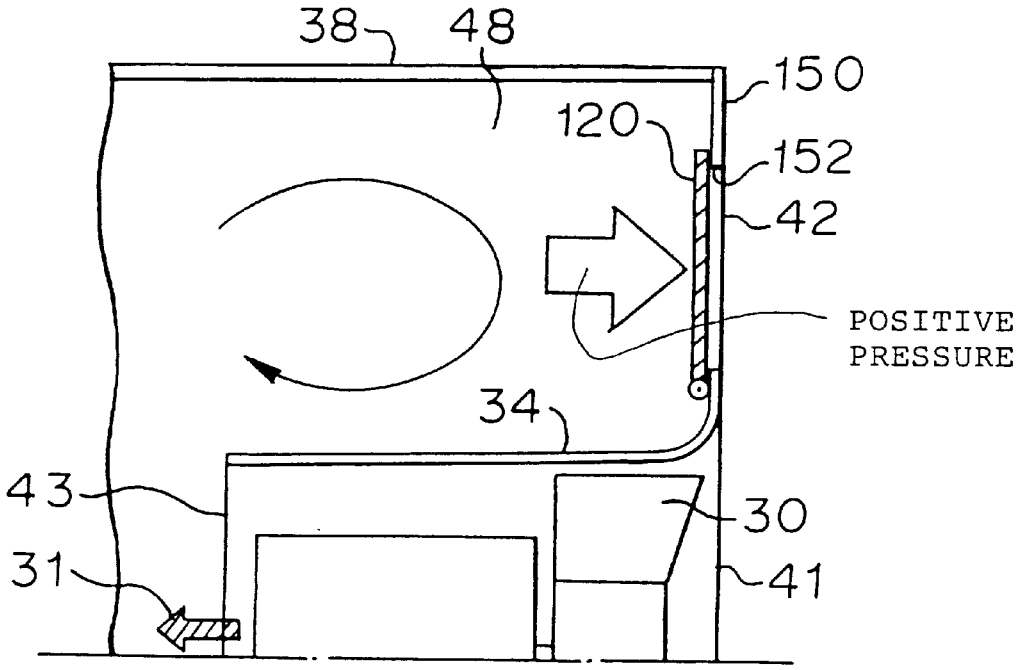

The operation of this embodiment will be explained referring to the cross-sectional views of FIG. 31. In FIG. 31(*a*), there is shown a state under opened conditions wherein the pressure loss on the side of the outlet 44 of the induction nozzle 38 is 0 mmAq. Under the opened conditions, the secondary flow 32 is created in the induction nozzle 38 by the primary flow 31 from the axial fan 30. This induction effect causes the inside of the secondary flow passage 48, or the induction nozzle 38 to have a negative pressure, creating a pressure difference between the outer and inner surfaces of each of the induction shutters 120. Each of the induction nozzles 38 is inwardly opened about the support 153 to suck the secondary flow 32 into the induction nozzle 38 through each of the openings 42.

When the pressure loss on the side of the outlet 44 of the induction nozzle 38 is increased, the flow velocity of the primary flow 31 blown out into the induction nozzle 38 is reduced, and simultaneously the induction amount is also reduced, decreasing the entire flow rate in the system. When the pressure loss is further increased, the static pressure in the induction nozzle 38 is raised and becomes finally beyond the atmospheric pressure outside the inlet. Although at that time, the reverse flow occurs in the secondary flow inlet 42 in the system according to the first embodiment, the induction shutters 120 can be moved to close the secondary flow inlet 42, offering an effect similar to a check valve according to the eleventh embodiment. This is because the provision of the induction shutters 120 which are openable and closable in the induction nozzle allows a pressure difference created between the outer and inner surfaces of the induction shutters 120 by an increase in the pressure in the induction nozzle 38 to carry out automatic closing operation by a pressure action as shown in FIG. 31(*b*). Even if the pressure loss on the outlet side is further increased, no reverse flow from the secondary flow inlet 42 occurs, exhibiting an air supply performance similar to a usual, or noninduction blower.

Figure 32:
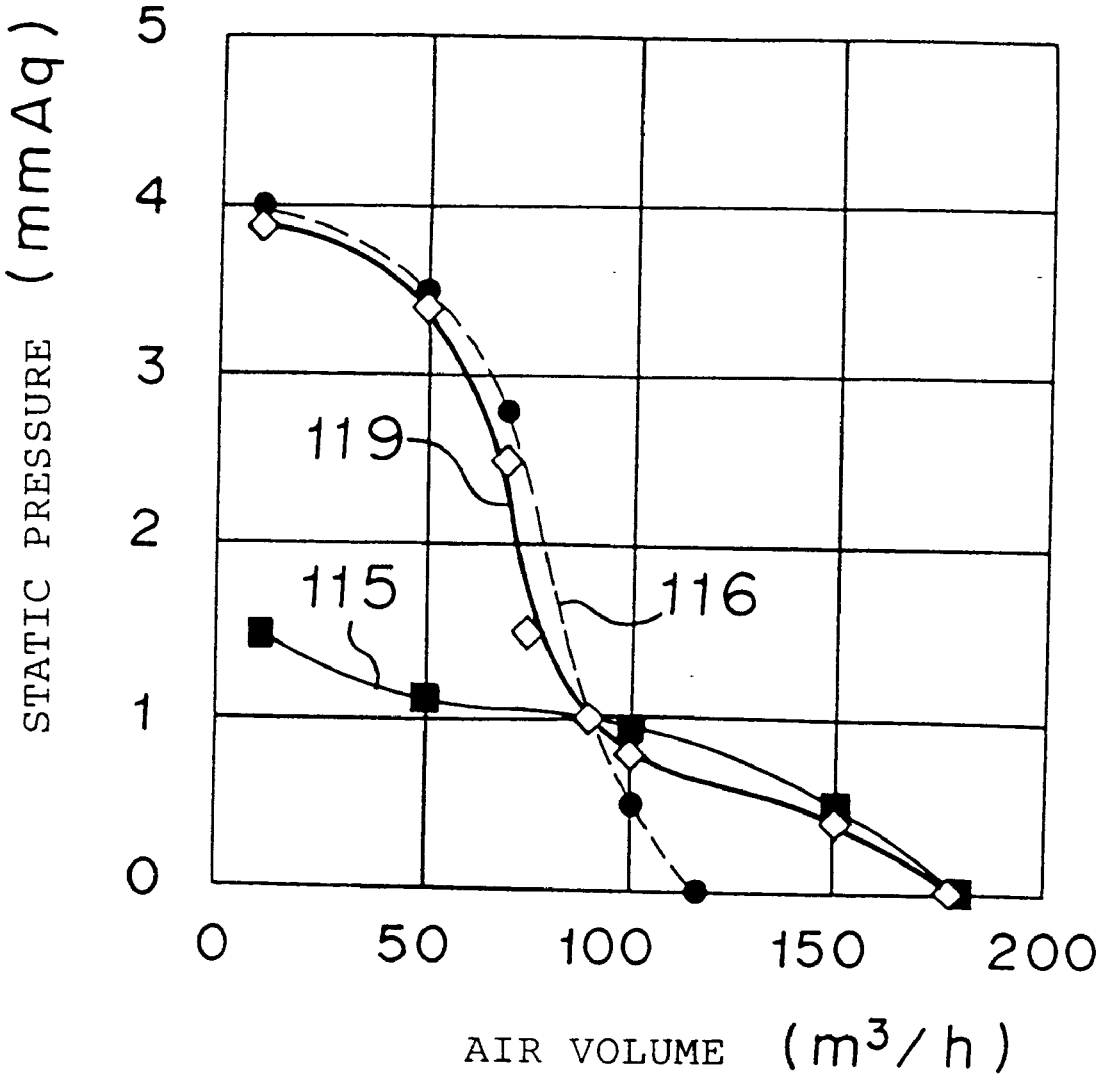
FIG. 32 is a graph showing the flow rate-static pressure characteristics of FIG. 29.

In FIG. 32, a line 119 designates an flow rate-static pressure characteristic curve according to the eleventh embodiment. Lines 115 and 116 are the same as the curves shown in FIG. 22.

As seen from this figure, the system with the induction shutters 120 according to the eleventh embodiment causes the induction shutters 120 to be opened on the open side (large flow rate side) with respect to a crossing point of 90 $m^3/h$ and 1.0 mmAq so as to provide the induction effect, increasing the airflow rate like the performance curve of the system according to the first embodiment indicated by the line 115. On the other hand, the induction shutters 120 are closed on the shutoff side with respect to the crossing point to prevent the reverse flow from the secondary flow inlet 42, obtaining a high static pressure like the performance curve of the usual noninduction blower indicated by the line 116.

As explained, the induction shutters 120 which are openable toward the inside of the induction nozzle 38 can be arranged in the secondary flow inlet 42 to be automatically opened and closed by the pressure action without provision a special control measure, providing a high static pressure on the shutoff side and a large airflow rate on the open side according to conditions.

When the system is installed in e.g. a case where a static pressure is varied on the presence and absence of outdoor wind, it is possible to carry out effective air ventilation or air supply in a manner suited to conditions.

Figure 33:
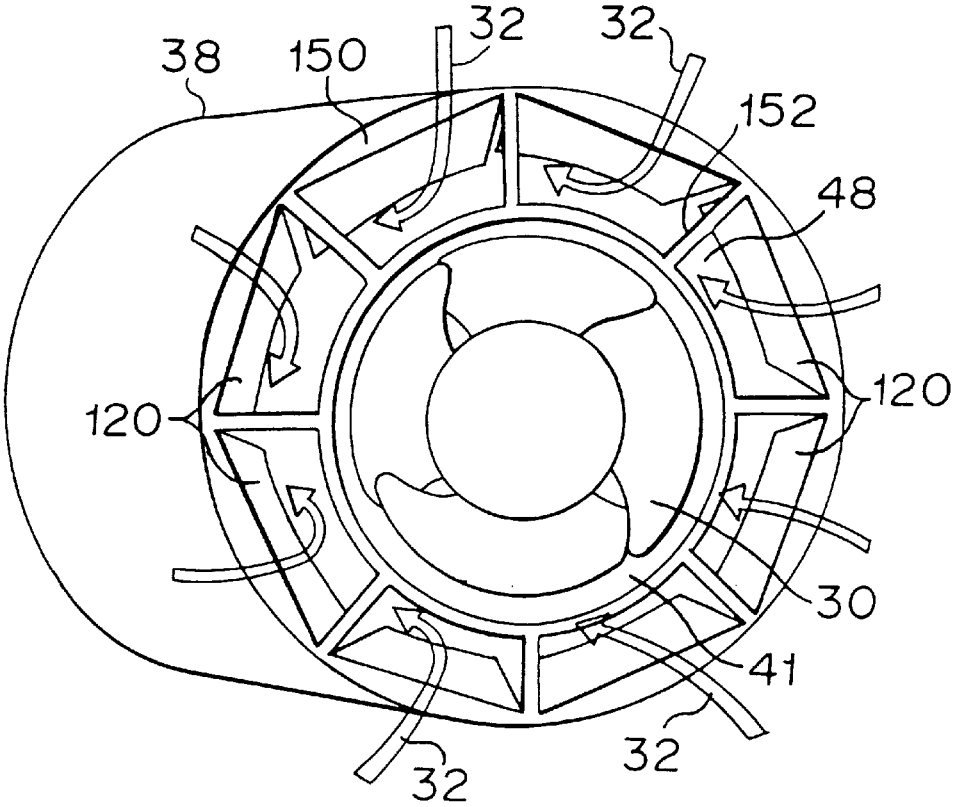
FIG. 33 is a perspective view of another example of the system according to the eleventh embodiment.
Figure 34:
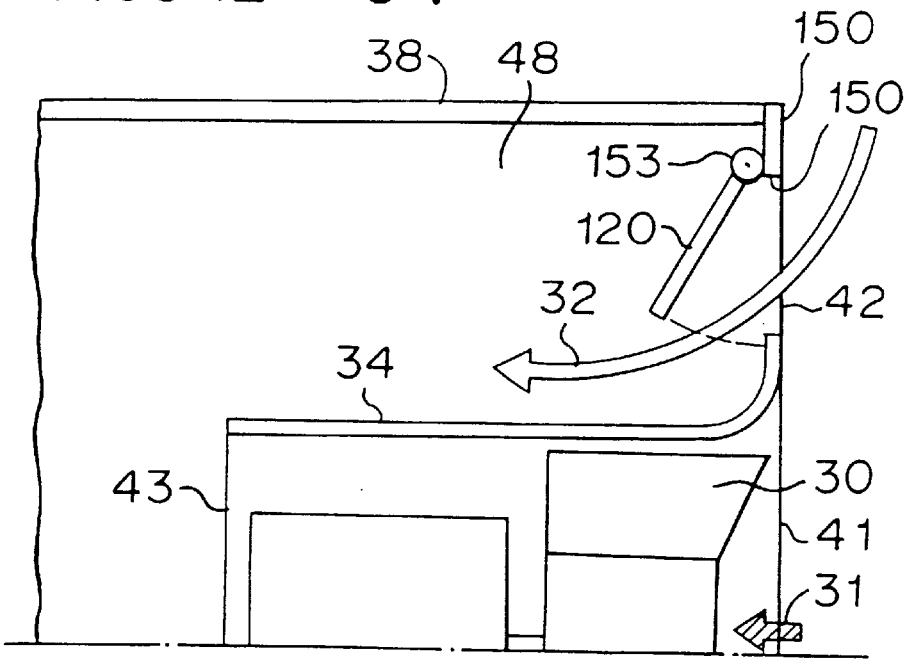
FIG. 34 is a cross-sectional view of the system shown in FIG. 33.

Although the supports 153 for the induction shutters 120 are provide on the openings 42 formed in the ring-shaped plate 150 on the side of the casing 34 in the system shown in FIG. 29, the supports 153 may be provided on the openings on the side of the induction nozzle 38 as long as there is no bar to complete opening and closing of the induction shutters 120. In FIG. 33, there is shown a perspective view of another example of the system with the induction shutters 120. In FIG. 34, there is shown a cross-sectional view of the example of FIG. 33. The example of FIGS. 33 and 34 is different from the example of FIGS. 29 and 30 in that the supports 153 for the induction shutters 120 are provided on the ring-shaped plate 120 on the side of the induction nozzle 38. The secondary flow 32 sucked from the openings 42 has a directional characteristic to be sucked from a direction slanted toward a circumferential direction with respect to the axial direction as shown in FIG. 34. According to the example of FIGS. 33 and 34, the induction shutters 120 can be opened so as not to prevent suction of the secondary flow 32, reducing the pressure loss in suction and increasing the flow rate of the secondary flow 32.

Figure 35:
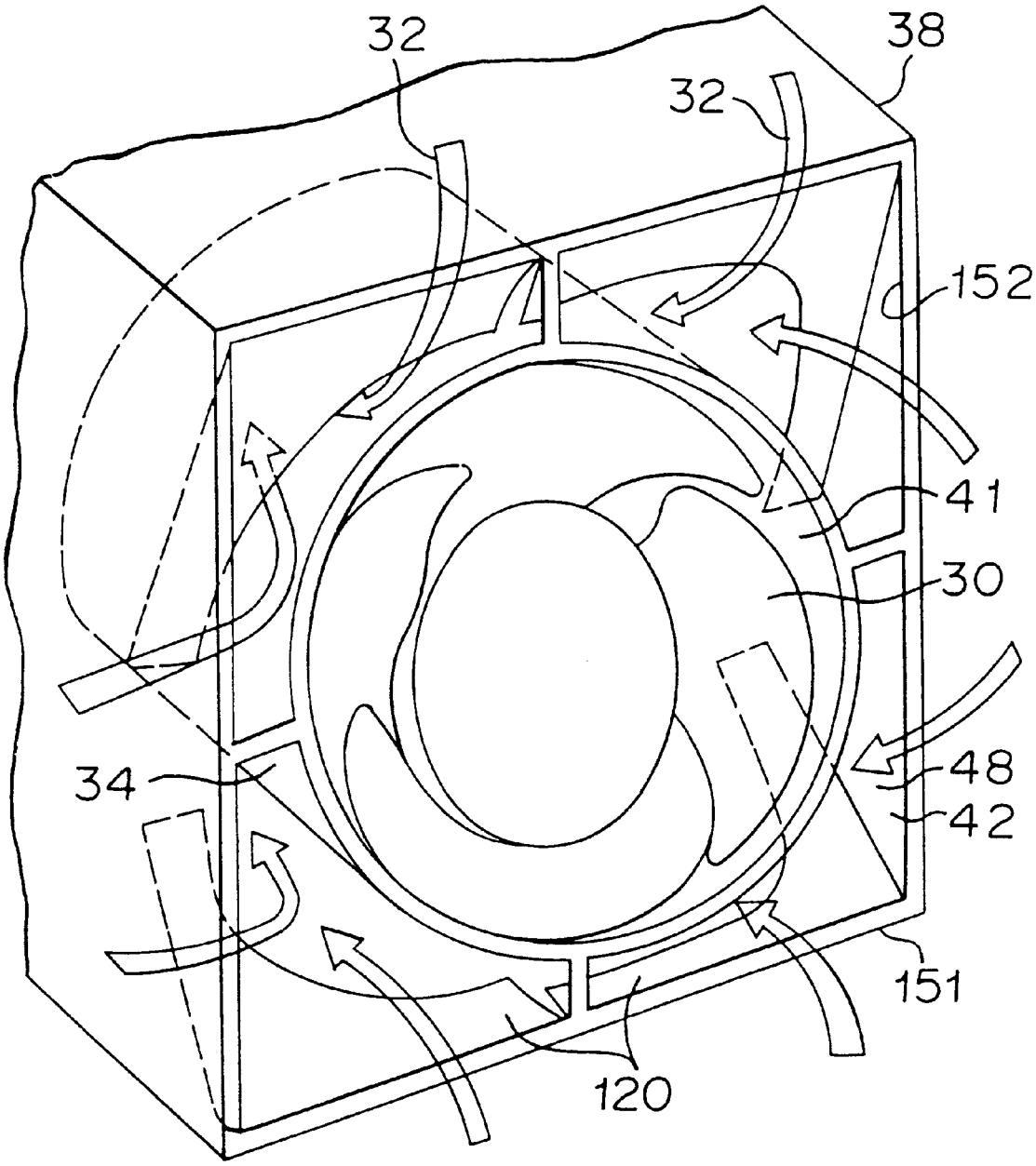
FIG. 35 is a perspective view of another example of the system according to the eleventh embodiment.

Although it is shown in FIGS. 29 and 33 that the induction shutters 120 are provided under the condition wherein the induction nozzle 38 is formed in a cylindrical shape, the shape of the induction nozzle 38 is not limited to a cylindrical shape, and may have any shapes. In FIG. 35, there is shown a perspective view of an example of the air ventilation or air supply system wherein the induction nozzle 38 which is formed in a rectangular shape in section is provided with the induction shutters 120. As seen from this figure, a lid 151 having four openings 152 covers the secondary flow inlet 42 defined between the upstream end of the induction nozzle 38 and the upstream end of the casing 34, and the secondary flow inlet is provided with the induction shutters 120 so as to open and close the openings 152 in the lid 151. The induction shutters 120 are openable toward only the inside of the induction nozzle like the examples shown in FIGS. 29 and 33.

Even if the induction nozzle 38 is shaped in a rectangular form or any other form, the provision of the induction shutters 120 in the secondary flow inlet 42 as explained can offer an effect similar to the case wherein the induction nozzle is formed in a cylindrical shape.

Figure 36:
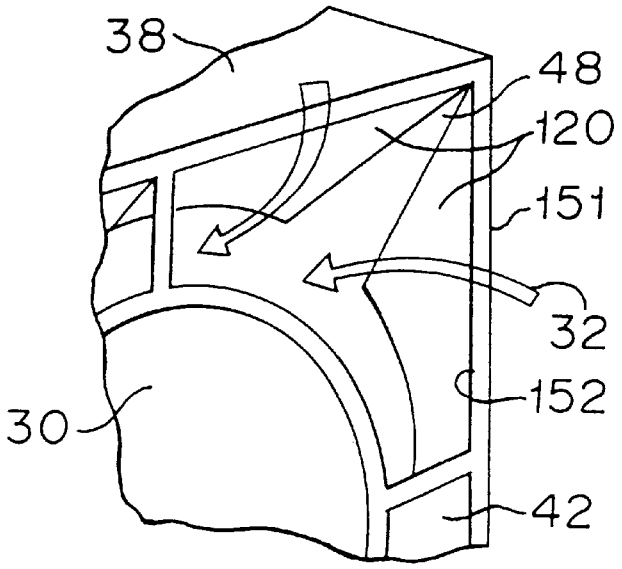
FIG. 36 is a perspective view of another example of the system according to the eleventh embodiment.
Figure 37:
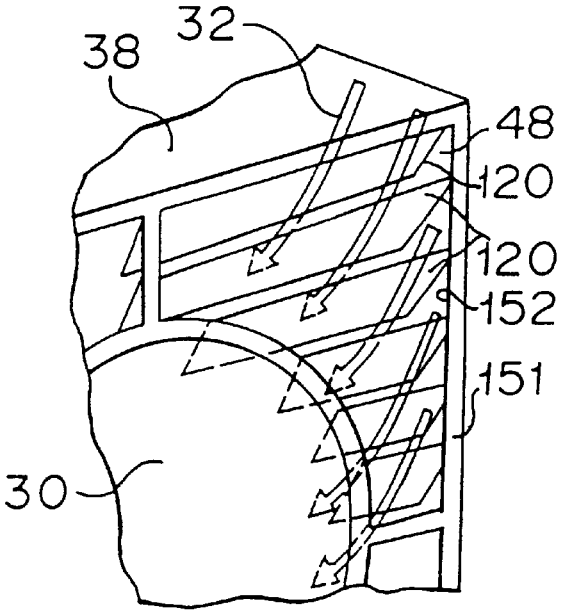
FIGS. 37(*a*) and (*b*) are a perspective view and a sectional view of other examples of the system according to the eleventh embodiment.
Figure 37:
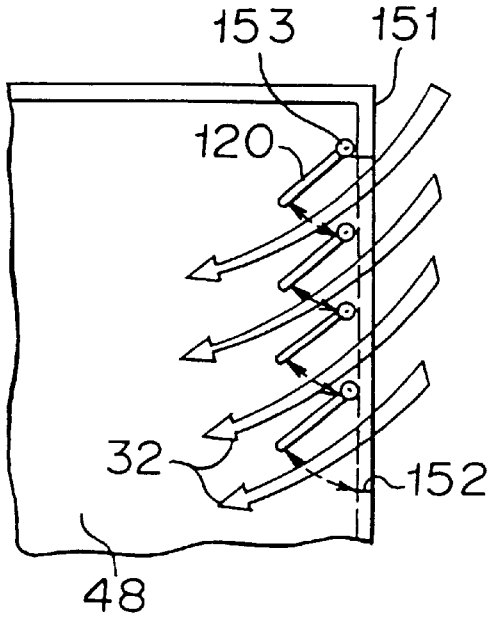

When the induction nozzle 38 is formed in a rectangular shape, the induction shutters 120 may be formed in other shapes than that shown in FIG. 35, and may be formed in an arbitrary shape as shown in FIG. 36. In FIG. 36, there is shown a perspective view wherein each of the induction shutters 120 shown in FIG. 35 is divided into two parts, and wherein when the induction shutters 120 are almost closed by an increase in the static pressure in the induction nozzle 38, these two parts of each of the shutters can be lightly overwrapped or closed without forming a gap to prevent the back flow from the secondary flow inlet 42. In addition, in FIG. 37(*a*), there is a perspective view of another example of the induction shutter. In FIG. 37(*b*), there is a cross-sectional view of the example. As shown, each of the induction shutters 120 is formed in a blind-like shape so as to be divided into a plurality of parts, and each of the openings is provided with such a plurality of parts, offering a similar effect.

EMBODIMENT 12

This embodiment provides secondary flow passage opening and closing means which is automatically opened and closed by a pressure action like the eleventh embodiment.

Figure 38:
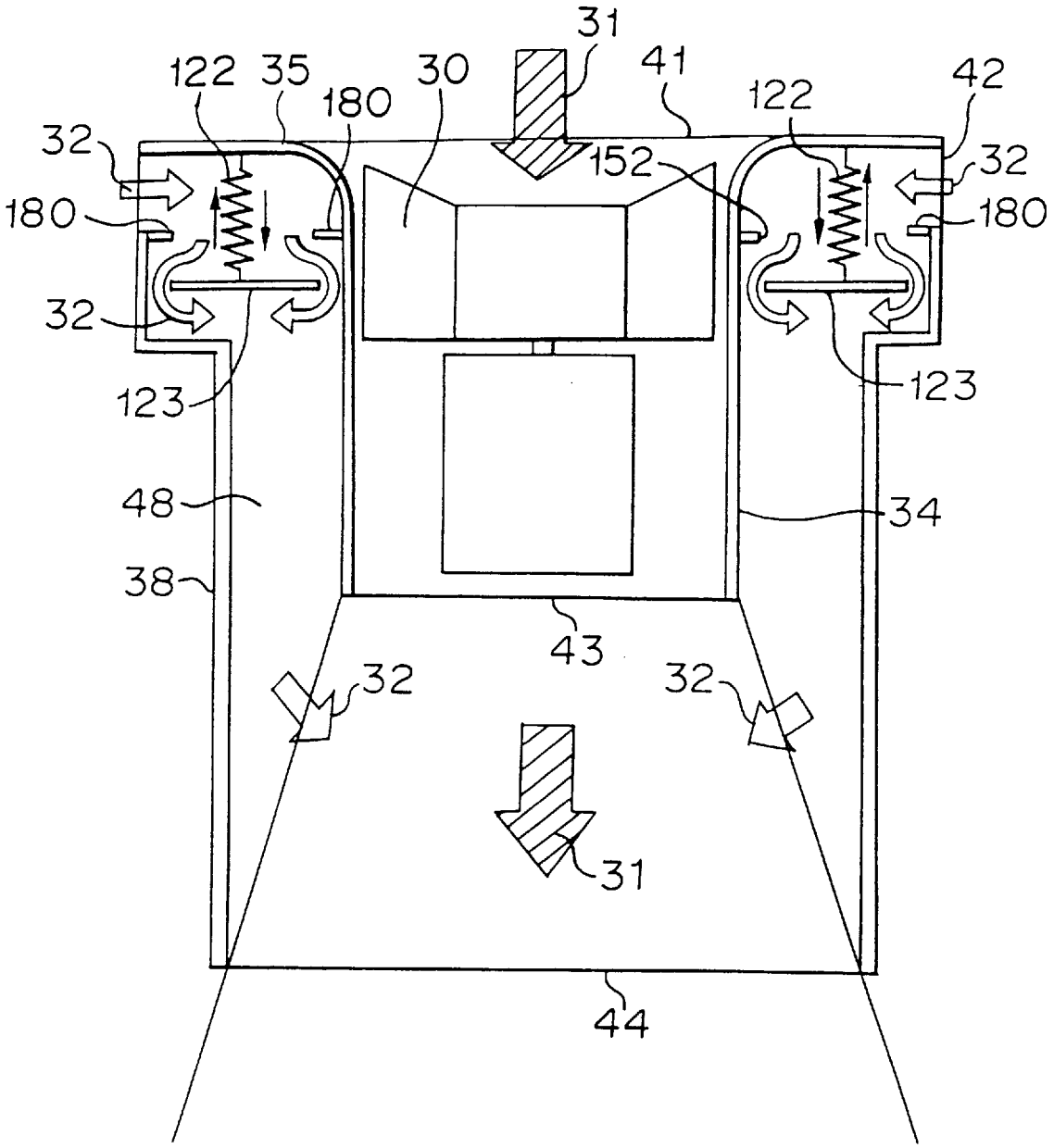
FIG. 38 is a cross-sectional view of the system according to a twelfth embodiment.

Although it is shown in the eleventh embodiment that the induction shutters 120 which are provided on the ring-shaped plate 150 or the lid 151 of the secondary flow inlet 42 are formed in a shutter structure so as to be opened and closed like a door, other structures may be adopted as long as they can automatically open and close the secondary flow inlet 42 by a pressure difference. In FIG. 38, there is shown a cross-sectional view of an example of the air ventilation or air supply system which is formed with a damper supported by springs. The system is formed in a substantially cylindrical shape as a whole like the one of FIG. 29. Explanation of parts similar to those of the tenth embodiment will be omitted. In FIG. 38, reference numeral 35 designates a bell mouth which is provided so as to be substantially flush with the plane of the primary flow inlet 41. Reference numeral 123 designates the damper for induction which opens and closes the secondary flow inlet 42. Reference numeral 122 designates springs which couple the damper 123 to an inner surface of the bell mouth 35. Reference numeral 180 designates a partition which is provided on an upstream end of the secondary flow passage 48, and which receives the damper 123. The partition 180 is formed with an opening 152. The opening may be formed so as to continuously extend along the entire circumference of the induction nozzle 38, or to be divided in sections in the circumferential directions. The induction damper 123 may be formed so as to shut the opening 152.

The operation will be explained. The springs 122 have a length adjusted so that the induction damper 123 is apart from the partition 180 downwardly to accept the secondary flow 32 when axial fan 30 is not driven. At that time, the opening 152 in the partition, which communicates with the secondary flow inlet 42, is in an open state. When the fan 30 is driven, the inside of the induction nozzle 38 becomes a negative pressure by the induction effect in such a case wherein the side of the outlet 44 of the induction nozzle 38 is under the open conditions. In that case, the induction damper 123 is attracted in the downstream direction to keep the opening 152 in the partition 180 open, causing the secondary flow 32 to be sucked from the secondary flow inlet 42. On the other hand, when the pressure loss on the side of the outlet 44 of the induction nozzle 38 is increased, the static pressure in the induction nozzle 38 is raised. When the pressure in the induction nozzle rises up beyond the atmospheric pressure outside the inlet, the presence of the high static pressure in the induction nozzle 38 pushes up the induction damper 123 toward the partition 180 to close the opening 152 in the partition 180. As a result, the passage 48 for the secondary flow 32 is closed to prevent the back flow from the secondary flow inlet 42, exhibiting the high static pressure like the usual blower. The springs 122 are formed to have a small spring constant in order to minimize the pressure loss required for operation of the damper 123.

Figure 39:
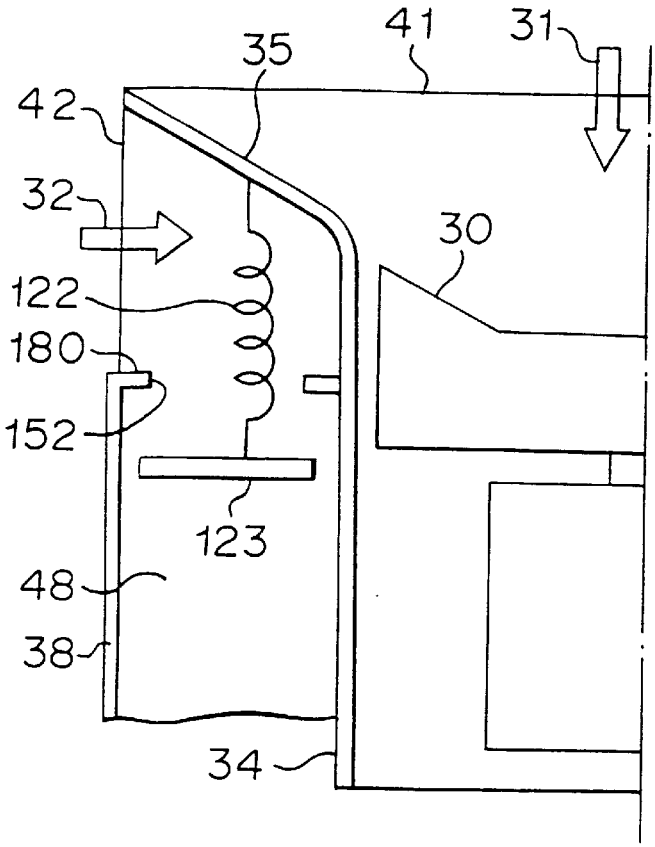
FIG. 39 is a cross-sectional view of another example of the system according to the twelfth embodiment.

Although it is shown in FIG. 38 that the bell mouth 35 formed in a flat shape, the bell mouth may be formed in a slant surface as shown in FIG. 39 or in a curved surface to smoothly or gradually decrease the cross-sectional area. In these cases, the suction resistance of the primary flow 31 can be reduced to improve the air supply performance of the system.

Figure 40:
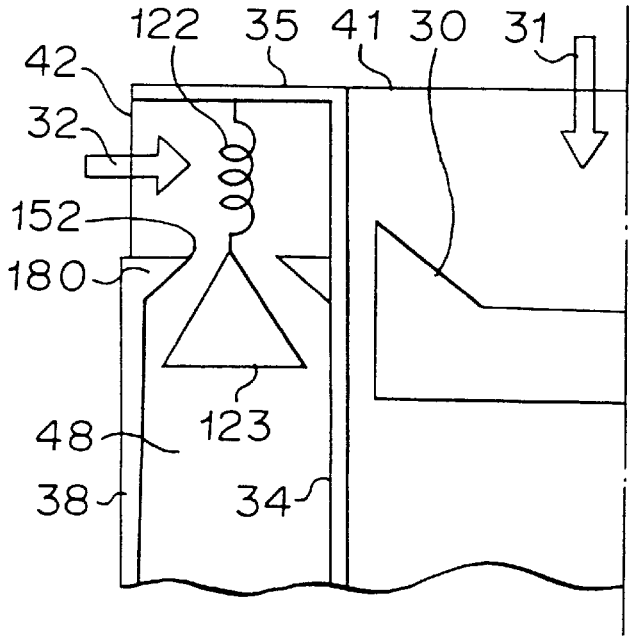
FIG. 40 is a cross-sectional view of another example of the system according to the twelfth embodiment.

The induction damper 123 may be formed in a triangular shape in section as shown in FIG. 40 to reduce the suction resistance of the secondary flow, improving the air supply performance of the system.

EMBODIMENT 13

Figure 41:
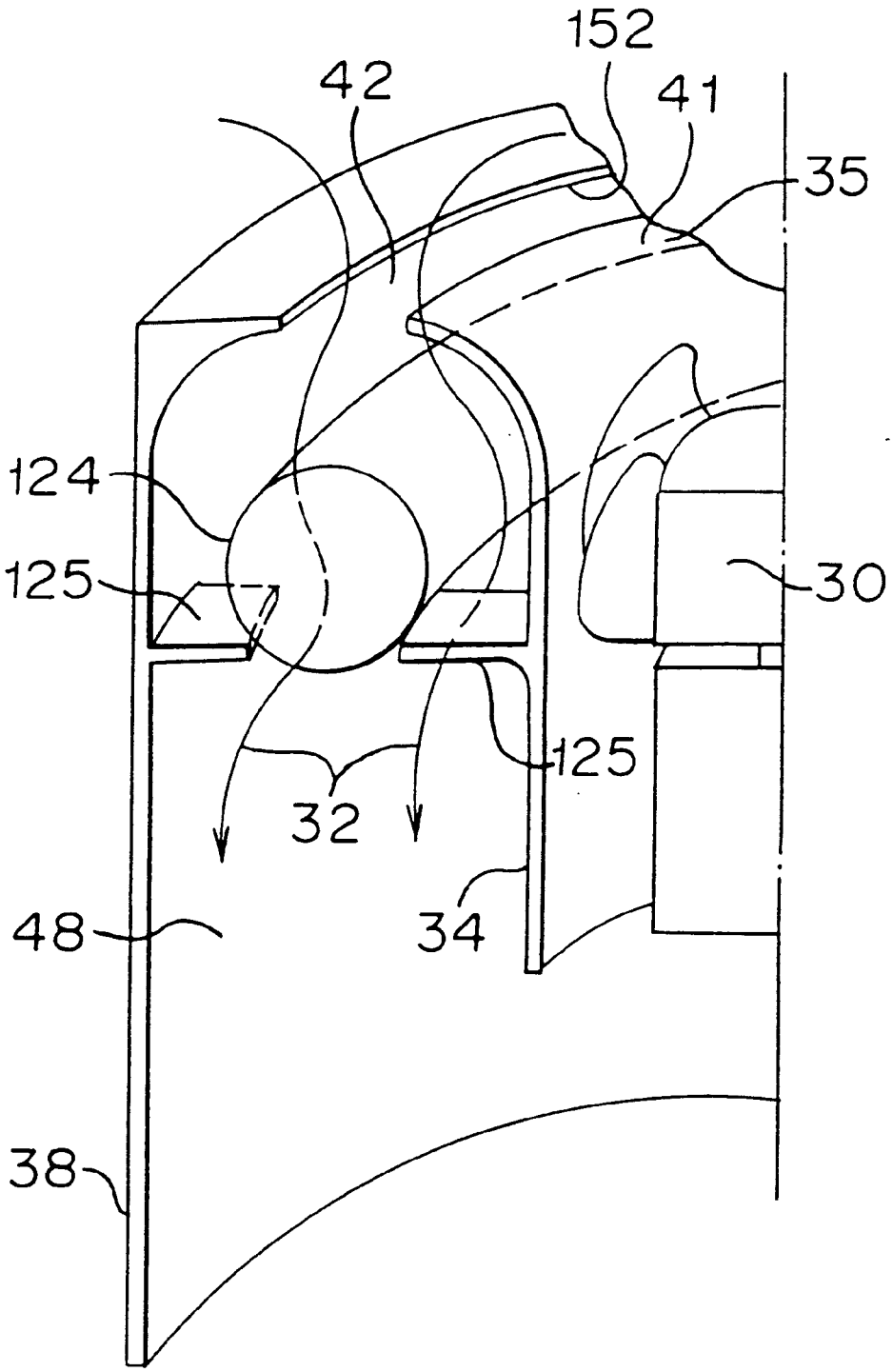
FIG. 41 is a perspective sectional view of the system according to a thirteenth embodiment.
Figure 42:
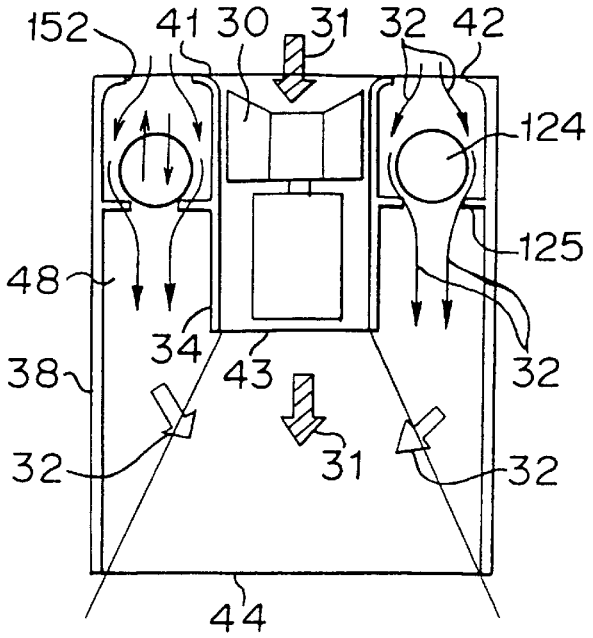
FIG. 42 is a cross-sectional view of the system shown in FIG. 41.

In FIG. 41, there is shown a perspective sectional view of an example of the system wherein there is provided a doughnut-like shutter which automatically opens and closes the secondary flow passage by a pressure action. In FIG. 42, there is a cross-sectional view of the system of FIG. 41. In this example, the opening 152 is formed in an annular slit-like shape between the upstream end of the induction nozzle 38 and an outer peripheral edge of a bell mouth 35 of the primary flow inlet 41. A doughnut-like shutter 124 is put in the secondary flow passage 48 between the induction nozzle 38 and the casing 34. The shutter has a circular section, and the circular section has a diameter larger than the width of the slit of the secondary flow inlet 42 and smaller than the difference between the radius of the casing 34 and the radius of the induction nozzle 38. An imaginary circular line of the doughnut shaped shutter 124 which extends at a central position in the annular portion of the shutter in the circumferential direction has substantially the same radius as an imaginary circular line of the secondary flow inlet 42 which extends at a central position in the annular slit in the circumferential direction. There is provided a shutter stopper 125 for holding the doughnut shaped shutter 124 in a space between the secondary flow inlet 42 and the outlet of the casing 34. The shutter is made of a light weight and waterproof material such as styrene foam and hollow plastic. The shutter stopper 125 is constituted by plurality of pieces which are separately arranged in the circumferential direction of the shutter so as not to provide a bar to the flow of the secondary flow 42.

Figure 43:
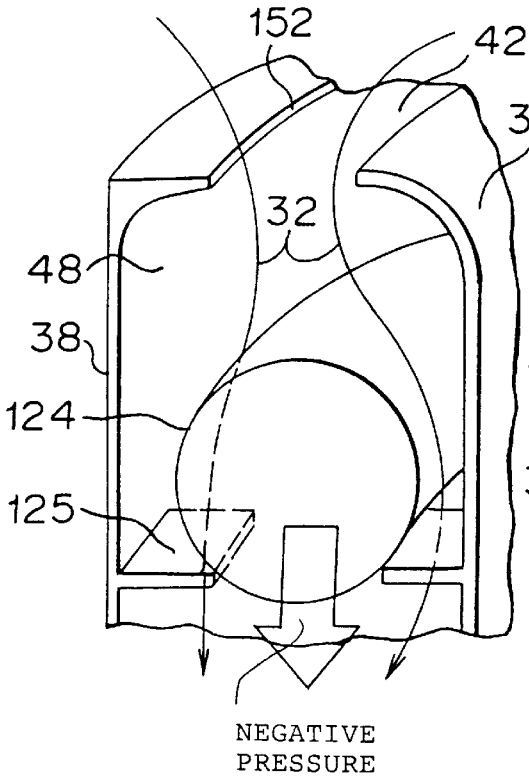
FIGS. 43(*a*) and (*b*) are perspective sectional views showing the operation of the system shown in FIG. 41.
Figure 43:
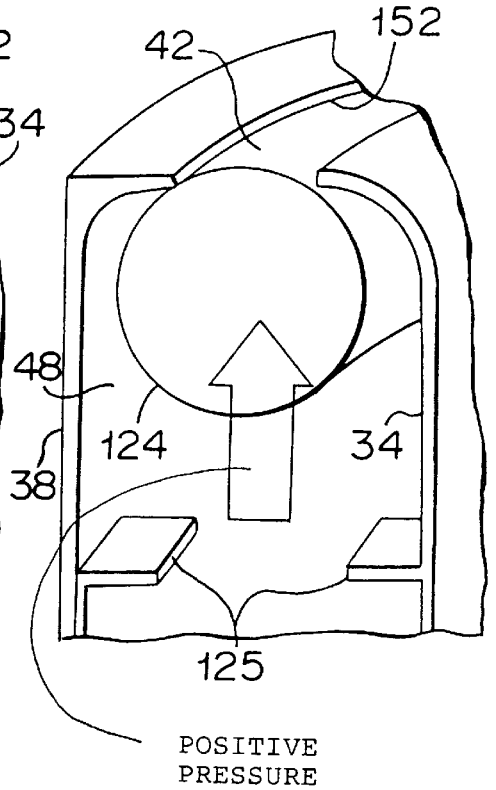

The operation will be explained referring to FIG. 43 wherein the secondary flow inlet 42 and its surroundings are shown in a magnified form. When the fan 30 is driven, the inside of the induction nozzle 38 becomes a negative pressure by the induction effect in a case wherein the side of the outlet 44 of the induction nozzle 38 is under the open conditions. In that case, the doughnut shaped damper 124 is attracted in the downstream direction in the induction nozzle 38, and the damper is moved to the position of the shutter stopper 125. In this stage, the passage 48 for the secondary flow 32 is in an open state as shown in FIG. 43(*a*), the secondary flow 32 is sucked in from the secondary flow inlet 42, and the secondary flow comes into the nozzle after passing the doughnut shaped shutter 124. Under the open conditions, the airflow rate is increased by the induction effect. On the other hand, when the pressure loss on the side of the outlet 44 of the induction nozzle 38 is increased, the static pressure in the induction nozzle 38 is raised. When the pressure in the nozzle goes up beyond the atmospheric pressure outside the inlet, the high static pressure in the induction nozzle 120 works as a positive pressure to push up the doughnut shaped shutter 124 toward the secondary flow inlet 42, closing the opening 152 of the secondary flow inlet 42 as shown in FIG. 43(*b*). As a result, the passage 48 for the secondary flow 32 is closed to prevent the back flow from occurring, providing the high static pressure like the non-induction blower.

Since the doughnut shaped shutter 124 is arranged so as to be freely movable in the secondary flow passage 48 between the induction nozzle 38 and the casing 34 depending on the static pressure as explained, a large airflow rate can be obtained on the open side, and a high static pressure can be obtained on the shutoff side.

EMBODIMENT 14

Explanation of the fifth through ninth embodiments has been made with respect to the system wherein a centrifugal fan is used as the blower for producing the primary flow 31. These embodiments aim at significantly increasing the airflow rate under a condition wherein no pressure loss is added (open side). Explanation of the thirteenth and fourteenth embodiments have been made with respect to an increase in the static pressure of the system using an axial fan. The measure to raise the static pressure to a high level is also applicable to the system using a centrifugal fan according to the fifth through ninth embodiments.

Figure 44:
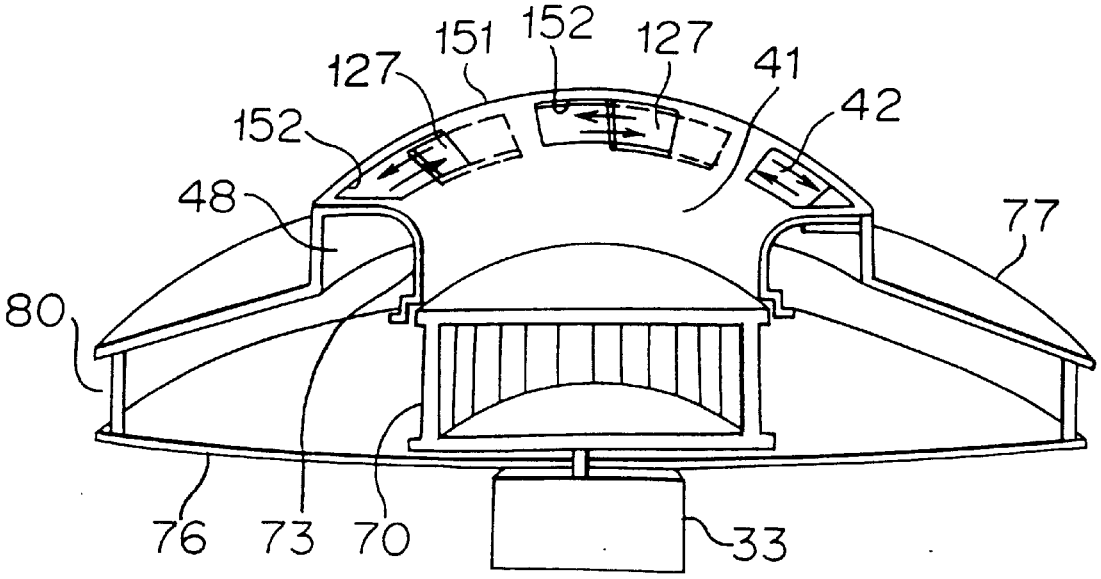
FIG. 44 is a perspective sectional view of the system according to a fourteenth embodiment of the present invention.

In FIG. 44, there is shown a perspective sectional view of the air ventilation or air supply system according to a fourteenth embodiment of the present invention. The same reference numerals as those of the fifth embodiment indicate similar or corresponding parts, and explanation of those parts will be omitted. In this figure, reference numeral 151 designates a lid which is provided between the upstream end of the induction disk 77 and the upstream end of the cylindrical inlet 73, and which has a plurality of sector-shaped openings 152 formed therein. The openings 152 have a slidable valve 127 as the secondary passage opening and closing means arranged therein so as to regulate the opening ratio thereof.

The operation will be explained. Although the blower of FIG. 11 can provide a larger airflow rate than the conventional noninduction blower by about 1.55 times on the open side, the blower of FIG. 11 provides a lower static pressure than the conventional noninduction blower on the shutoff side. The reason is that pressure loss is added to the outlet 80 formed by the induction disk 77 and the guide plate 76 on the shutoff side, that the outlet flow 31 is not gushed out of the outlet 80 at the outer peripheral edge of the induction disk 77, and that the outlet flow flows back through the secondary flow inlet 42 having smaller pressure loss. In order to raise the static pressure to a high level in the system according to the fifth embodiment shown in FIG. 11, it is sufficient to prevent the back flow from the secondary flow inlet 42. When the slidable valve 127 of FIG. 44 is slided to decrease the open ratio of the openings 152, the static pressure on the shutoff side is increased in comparison with the static pressure of the system according to the fifth embodiment shown in FIG. 11 though the airflow rate on the open side is slightly decreased. When the slidable valve 127 is further slided to close the openings 152, the back flow from the secondary flow inlets 42 becomes extinct, providing the static pressure on the shutoff side like the conventional noninduction blower.

As explained, the provision of the lid 151 with the slidable valve 127 in the secondary flow inlets 42 of the system using a centrifugal fan 70 can open and close the secondary flow passage 48 by the movement of the slidable valve 127 to arbitrarily change the static pressure on the shutoff side, raising the static pressure to a high level.

It is possible to automatically regulate the shutoff static pressure of the air ventilation or air supply system utilizing the phenomenon wherein the static pressure on the inner wall in the induction disk 77 is changed from a negative pressure to a positive pressure by the induction effect when the back flow occurs. For the purpose, an automatic feed device such as a combination of a ball thread and an electric motor is provided on the system of FIG. 44 to move the slidable valve 127 to a desired position. The static pressure on the wall in the induction disk 77 is detected, and a signal indicative of the static pressure is transmitted to the automatic feed device. When the static pressure has a value larger than the atmospheric pressure outside the secondary flow inlet 42, the slidable valve 127 is gradually moved in a direction for reducing the opening ratio, or immediately when the pressure in the induction disk 77 is larger than the atmospheric pressure, the feed device is used to regulate the slidable valve 127 so as to provide a fully closed state. In this manner, an arbitrary shutoff static pressure can be attained, and it is possible to raise the static pressure to a high level.

It is not necessary to form the openings 152 formed in the lid 151 for the secondary flow inlets 42 in sector-shaped windows which are concentrically arranged as shown in FIG. 44. As long as an arbitrary opening ratio can be obtained by regulating the slidable valve 127, the openings can be shaped in any other forms such as a triangular form, a round form and rectangular form, offering a similar effect.

EMBODIMENT 15

It is shown in the fourteenth embodiment that the opening ratio of the secondary flow inlets 42 can be set to have an arbitrary value to change the shutoff static pressure, in particular establishing a high raise in the static pressure. The fourteenth embodiment creates a problem in that when the opening ratio of the secondary flow inlets 42 is decreased to increase the static pressure on the shutoff side, an increased amount in the open airflow rate is conversely decreased at that opening ratio. Now, a measure wherein shutters automatically opened and closed depending on the static pressure in the secondary flow passage are arranged in the secondary flow inlets 42 to deal with not only a state requiring a high static pressure on the shutoff side but also a state requiring a large airflow rate on the open side will be explained.

Figure 45:
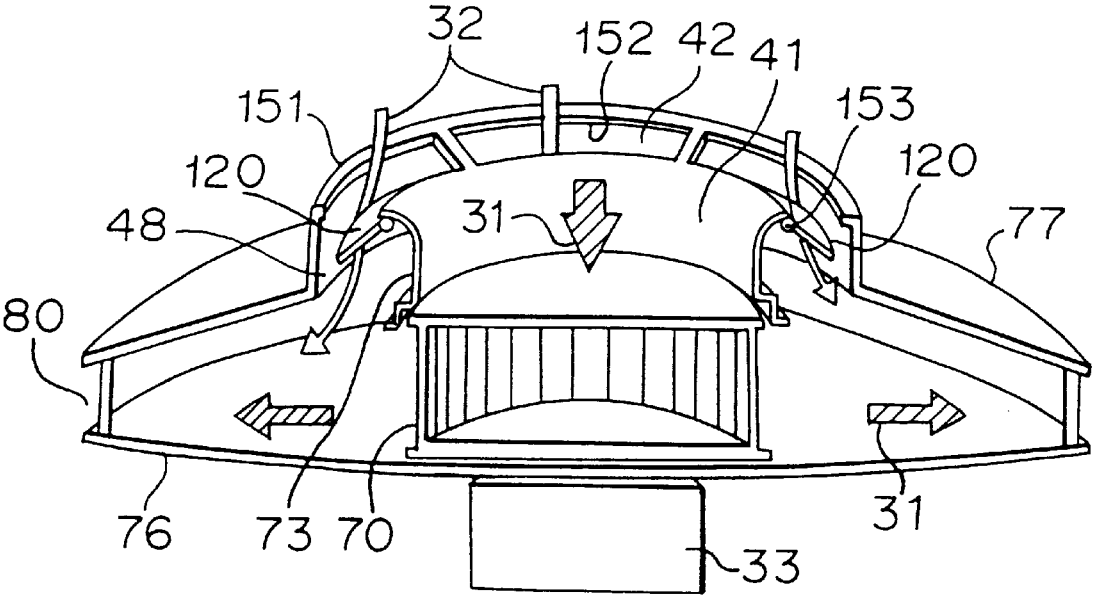
FIG. 45 is a perspective sectional view of the system according to a fifteenth embodiment of the present invention.
Figure 46:
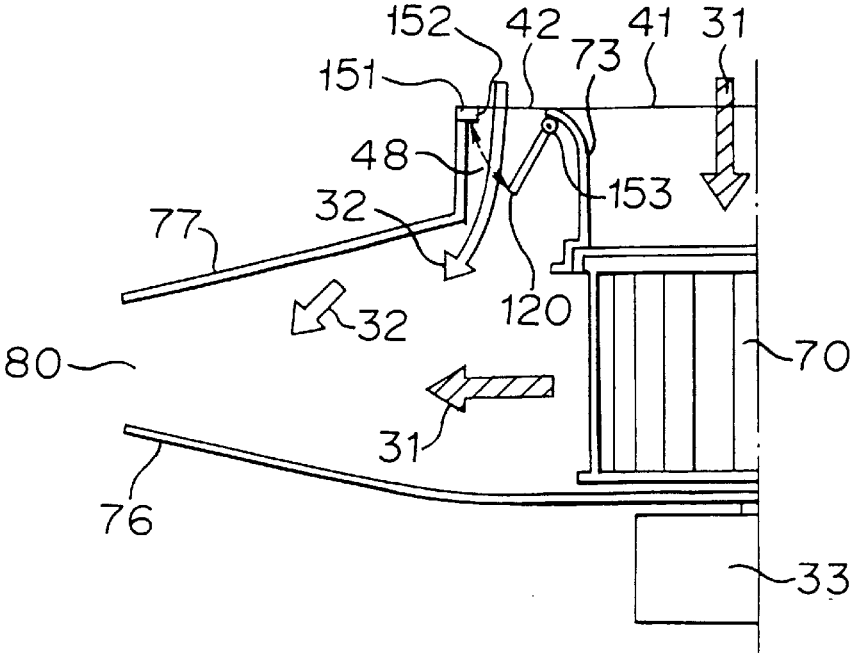
FIG. 46 is a cross-sectional view of the system shown in FIG. 45.

In FIG. 45, there is shown a perspective sectional view of the air ventilation or air supply system according to a fifteenth embodiment of the present invention. In FIG. 46, there is shown a cross-sectional view of the system of FIG. 45, taken along a plane including the central axis of the system. The same reference numerals as those of the fourteenth embodiment indicate corresponding or similar parts, and explanation of those parts will be omitted. In these figures, reference numeral 120 designates each of the openable and closable induction shutters which are arranged on a side in the induction disk 77 of the secondary flow inlets 42, and which can be opened toward only the inside of the induction disk 77. The lid 151 having a plurality of openings 152 formed therein are arranged between the upstream end of the induction disk 77 and the upstream end of the cylindrical inlet 73. The induction shutters 120, which are made of a possibly light material having some extent of rigidity such as thin sheet of celluloid, plastic or styrene foam are attached to the side of the cylindrical inlet 73 of the openings 152 through supporting portions 153 so as to be lightly opened and closed. With respect to a method for supporting the induction shutters 120, there are a method wherein the supporting portion 153 of each of the induction shutters 120 is formed in a cylindrical shape, a linear member such as iron core and wire is inserted into the cylindrical portion, and the opposite ends of the linear member are fixed to the lid 151 or an outer peripheral edge of the cylindrical inlet 73 so as to be rotatable, and a method wherein an openable and closable member such as a hinge is used. Whatever method is adopted, smoothly opening and closing of the induction shutters 120 must be considered.

The operation will be explained referring to the cross-sectional view of FIG. 46. Under the open conditions wherein pressure loss on the side of the outlet 80 defined by the induction disk 77 and the guide plate 76 is 0 mmAq, the secondary flow 32 is created in a space between the induction disk 77 and the guide plate 76 by the induction effect of the primary flow 31 from the centrifugal fan 70. The induction effect causes a negative pressure to be created in the induction nozzle to generate a pressure difference between the inner and outer surfaces of each of the induction shutters 120. As a result, each of the induction shutters is turned around the supporting portion of each of the induction shutters to open the passage 48 for the secondary flow 32, causing the secondary flow 32 to be sucked into the space between the induction disk 77 and the guide plate 76 through the openings.

When the pressure loss on the side of the outlet 88 of the induction disk 77 is increased, the flow velocity of the primary flow 31 which is blown out in the induction disk 77 is reduced, and simultaneously the induction amount is also reduced to cause a decrease in the entire flow rate. When the pressure loss is further increased, the pressure loss on the inner wall in the induction disk 77 is raised, and finally goes up beyond the atmospheric pressure outside the inlet. Although the system according to the fifth embodiment is subjected to the back flow in the secondary flow inlet 42 at that time, the provision of the pressure action depending openable and closable induction shutters 120 in the secondary flow inlet 42 according to the fifteenth embodiment can raise the static pressure in the induction disk 77 to move the induction shutters 120 so as to close the secondary flow inlet 42, offering an effect similar to check valves. Even if the pressure loss on the outlet side is still further increased, no back flow from the openings causes, providing air supply performance similar to the noninduction blower.

Although the supporting portions 153 of the induction shutters 120 are provided on the side of the cylindrical inlet 73 in this embodiment, the supporting portions may be provided on the induction disk 77 at the secondary flow inlet 42.

As explained, the induction shutters 120, which can be opened toward only the inside in the induction disk 77, are provided in the secondary flow inlet 42 to establish high static pressure on the shutoff side and a large airflow rate on the open side.

EMBODIMENT 16

Controlling the direction of the outlet air which is blown out into an outdoor space from the outlet 80 of the induction disk 77 and the guide plate 76 will be explained in reference to the system using a centrifugal fan. In the fifth embodiment, the system using a centrifugal fan has the induction disk 77 and the guide plate 76 arranged parallel with each other. In the sixth embodiment, the system using a centrifugal fan has the induction disk 77 and the guide plate 76 arranged so that one of or both of the induction disk and the guide plate smoothly or gradually approach to narrow the cross-section of the passage.

In FIG. 12, there is shown a cross-sectional view of the system wherein the induction disk 77 and the guide plate 76 are arranged parallel with each other. In this figure, the primary flow 31 which is blown out of the centrifugal fan 70 into the space surrounded by the induction disk 77 and the guide plate 76 is directed along the guide plate 76 in directions indicated by arrows and is discharged from the outlet 80 into an outdoor space, inducing the secondary flow 32 through the shear surface. This has been confirmed by sucking a gas with steam from both of the primary flow inlet 41 and the secondary flow inlet 42, and further irradiating sheet-like light from laterally of the system to make the outlet air visible.

In FIG. 15, there is shown a cross-sectional view of the system wherein the guide plate 76 is smoothly and gradually approached toward the induction disk 77 to narrow the cross-sectional area of the passage. By a visualized flow test using steam as a tracer like the test for the system of FIG. 12, it has been confirmed that the outlet air of FIG. 15 is curved in a slant direction toward the induction disk 77 as indicated by arrows 131. As explained, the angle of the guide plate 76 with respect to the induction disk 77 can be regulated to set the outlet angle into an external space at an arbitrary value.

Figure 47:
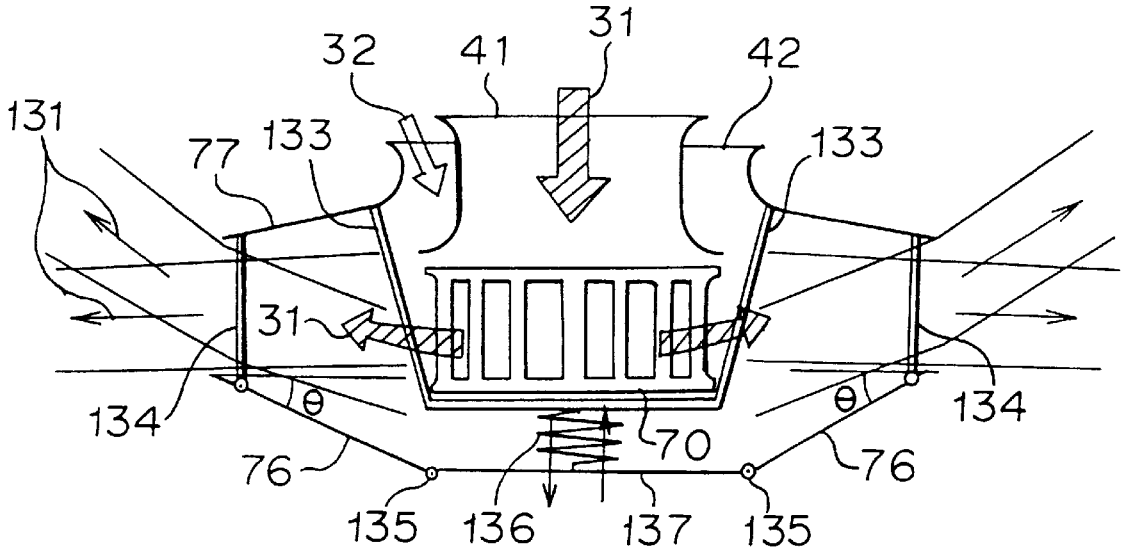
FIG. 47 is a cross-sectional view of the system according to a sixteenth embodiment of the present invention.

In FIG. 47, there is shown a cross-sectional view of the air ventilation or air supply system according to a sixteenth embodiment of the present invention. Explanation of parts similar to those of the fifth embodiment will be omitted. In this figure, reference numeral 133 designates a blower support for fixedly supporting the centrifugal fan 70. Reference numeral 134 designates fixed suspenders for fixing each of guide plates 76 to the induction disk 77. Reference numeral 135 designates variable connecting parts which are rotatably provided on one end of the respective guide plates 76. Reference numeral 137 designates a bottom plate which is connected to the guide plates 76 through the variable connecting parts 135. Reference numeral 136 designates a spring which is arranged between the centrifugal fan 70 and the bottom plate 137 for supporting the fan 70 from the lower end of the fan. Symbol θ represents an angle of the guide plates 76 with respect to the horizontal direction. The centrifugal fan 70 has the axis extended in the vertical direction.

The operation will be explained. When the bottom plate 137 is brought near the fan 70, θ is reduced. At that time of θ=0°, the bottom plate 137 is flush with the guide plates 76 to make the system operated like the fifth embodiment. Conversely, when the bottom plate 137 is moved away from the fan 70, θ is increased. When θ is 0°, the bottom plate 137 and the guide plates 76 become flush with each other as stated earlier, and the outlet air from the outlet into the external space is blown out substantially parallel with the guide plate 76. As the value of θ is gradually increased, the angle of the guide plate 76 with respect to the induction disk 77 is gradually increased, and the outlet air from the outlet is curved toward the induction disk 77 to be blown out upwardly. When the value of θ is further increased, the blowing angle of the outlet air is also increased.

As explained, the angle θ of the guide plate 76 or the angle of the guide plate 76 with respect to the fan 70 is variable, and the outlet angle of the outlet air into the external space from the outlet 80 can be changed to at a desired value, conveying the outlet flow to an arbitrary position.

A supporting member which has a height variable may be used instead of the spring 136 in this embodiment.

Instead of changing the angle of the guide plate 76, the induction disk 77 may be arranged to have a amounting angle regulated at an arbitrary value, or the angles of both of the induction disk 77 and the guide plates 76 may be adjusted, offering a similar effect.

EMBODIMENT 17

This embodiment is related to another example of the blowing direction control different from the sixteenth embodiment.

Figure 48:
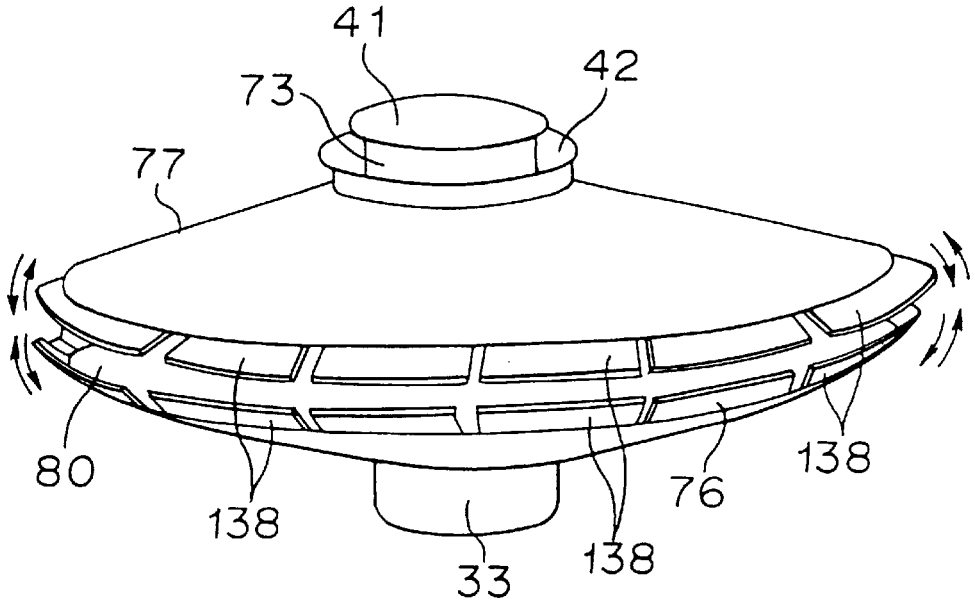
FIG. 48 is a perspective view of the system according to a seventeenth embodiment of the present invention.

In FIG. 48, there is shown a perspective view of the air ventilation or air supply system according to the seventeenth embodiment of the present invention. In this figure, reference numeral 138 designates blowing direction changing flaps which are arranged on the downstream ends of the induction disk 77 and the guide plate 76 so as to have a set angle arbitrarily regulated.

Figure 49:
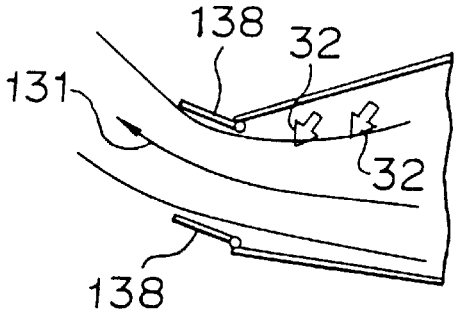
FIGS. 49(*a*) and (*b*) are cross-sectional views showing the operation of the system of FIG. 48.
Figure 49:
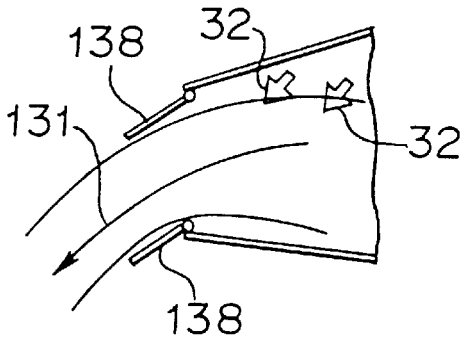

Flaps for controlling the direction of outlet air have been widely used for the outlet of an air conditioner, the outlet of a blower and so on. Such flaps are also applicable to control the direction of the outlet air of the system using the induction effect. In FIG. 49, there are shown cross-sectional views of the blowing direction changing flaps for explanation of a flowing direction, wherein when the blowing direction changing flaps 138 which are provided on the downstream ends of the induction disk 77 and the guide plate 76 are inclined toward the inlet side as shown in FIG. 49(*a*) (upwardly in this figure), outlet flow from the outlet 80 is blown out in an upwardly slanted direction in this figure. Conversely, when the blowing direction changing flaps 138 which are provided on the downstream ends of the induction disk 77 and the guide plate 76 is inclined toward the motor side as shown in FIG. 49(*b*) (downwardly in this figure), the outlet air from the outlet is blown out in a downwardly slanted direction in this figure.

In this manner, the angle of the flaps can be arbitrary changed to supply the outlet air toward a desired direction.

EMBODIMENT 18

Figure 50:
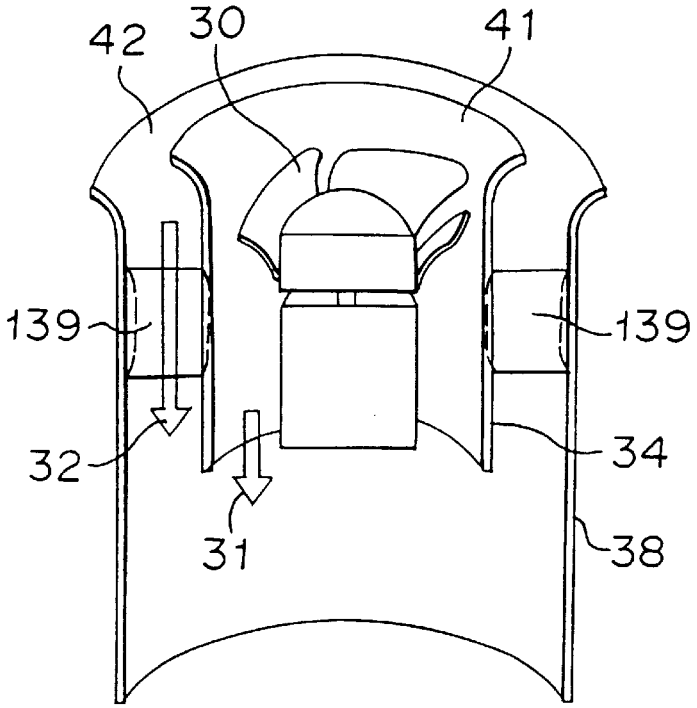
FIG. 50 is a perspective sectional view of the system according to an eighteenth embodiment.
Figures 51A, 51B, 51C:
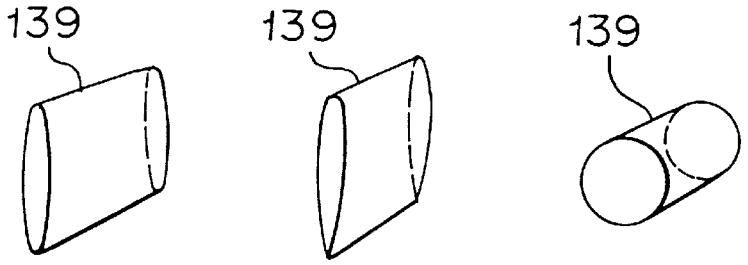
FIGS. 51(*a*)–(*c*) are perspective views of examples of the induction nozzle in the system of FIG. 50.

How to reduce the noise in the system using an axial fan according to the first embodiment will be explained. Explanation of parts similar to those of the first embodiment will be omitted. In FIG. 50, there is shown a perspective view of the air ventilation or air supply system according to a eighteenth embodiment of the present invention, wherein the system is partly fragmentarily shown. In this figure, reference numeral 139 designates induction nozzle supports for coupling the induction nozzle 38 to the casing 34 of the axial fan 30. According to the results which have been actually measured when an input of 100 V is supplied to the system according to the first embodiment, it has been confirmed that the secondary flow inlet 42 has a suction flow velocity of about 5.0 m/s. According to the frequency analyzation of the measured noise which has been carried out at the same time, it has been confirmed that there is noise having a specific frequency which is related to the diameter of the induction nozzle supports 139 and the flow velocity of the secondary flow 32. The noise is created by Karman vortexes which are generated by the secondary flow 32 when the secondary flow 32 collides with the induction nozzle supports 139 during passing through a region surrounded by the induction nozzle 38 and the casing 34. The induction nozzle supports 139 can have a cross-sectional shape formed in a streamlined shape such as a wing-shape shown in FIG. 51(*a*), and a winged shape having an elliptic section shown in FIG. 51(*b*) to reduce the noise. Testing the induction nozzle supports having a cross-section in the wing-shapes shown in FIGS. 51(*a*) and (*b*) has proved that the noise is reduced by about 1.0 dB(A) in comparison with induction nozzle supports in a pillar shape shown in FIG. 51(*c*).

As explained, the induction nozzle supports 139 for coupling the induction nozzle 38 to the casing 34 can be formed so as to have a streamlined cross-sectional shape, reducing the noise which is created by the secondary flow 32 when the secondary flow hits with the induction nozzle supports 139. In this manner, the noise can be reduced.

EMBODIMENT 19

Figure 52:
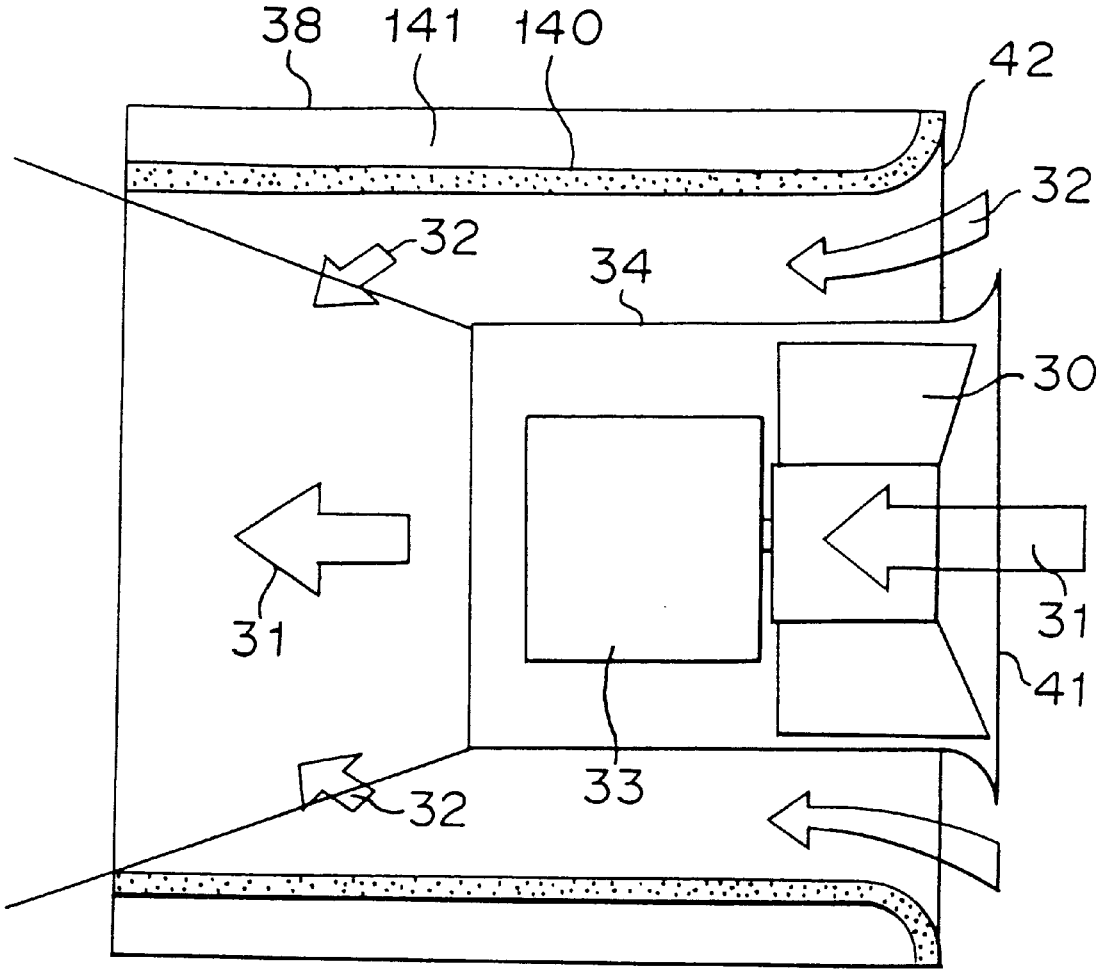
FIG. 52 is a cross-sectional view of the system according to a nineteenth embodiment.

The system according to the eighteenth embodiment can reduce the noise which is created when the secondary flow 32 hits with the induction nozzle supports 139. However, such a measure can not eliminate resonant sound or echoic sound which is created in the induction nozzle 38. In FIG. 52, there is shown a cross-sectional view of the air ventilation or air supply system according to a nineteenth embodiment. Explanation of parts similar to those of the first embodiment will be omitted. In this figure, reference numeral 140 designates a plate-shaped member which is arranged in the induction nozzle 38 and apart therefrom, and permits air to pass therethrough, and which is made of e.g. a porous plastic material. Reference numeral 141 designates a backside air layer which is provided between the air-permeable plate-shaped member 140 and the induction nozzle 38. The air permeable plate-shaped member 140 has a property to absorb sound waves in a specific frequency band by provision of the air layer 141 on the backside of the plate-shaped member. In accordance with this embodiment, such a backside air layer which fits to the frequency of the resonant sound or the echoic sound created in the induction nozzle is provide to absorb the noise.

EMBODIMENT 20

How to reduce the noise in the air ventilation or air supply system using a centrifugal fan according to the fifth embodiment will be explained. In FIG. 53, there is shown the air ventilation or air supply system according to a twentieth embodiment of the present invention. In FIG. 53(*b*), there is shown a cross-sectional view of the system. Explanation of parts similar to those of the fifth embodiment will be omitted. In this figure, reference numeral 142 designates induction disk supports which support the induction disk 77 above the guide plate 76. Reference numeral 143 designates supports for the cylindrical inlet 73, which communicates with the inside of the cylindrical inlet 73, and which couples the guide plate 76 to the annular shaped intake assistant plate 74. There are various kinds of methods for supporting the cylindrical inlet 73 and the induction disk 77. For example, when these two members are supported at locations shown in FIG. 53(*a*), the outlet air from the centrifugal fan 70 collides with the induction disk supports 142 and the supports for the cylindrical inlet 143 at a high velocity to create noise having a specific frequency due to generated vortexes. In order to cope with this problem, the respective supports 142, 143 can be formed so as to have a streamlined cross-section such as a winged shape and a winged shape having an elliptic shape as shown in FIG. 53(*b*) to reduce the noise which is created when the outlet air hits with the supports. If the respective supports 142, 143 are formed in a pillar shape, it is preferable to make the diameter large. If the diameter is small, sound having a high frequency is created, making harsh noise. The smaller the flow velocity of the hitting fluid is, the lower the noise due to collision rapidly becomes. It is preferable that the induction disk supports 142 is as apart as possible from the blower 70 to be located at positions wherein the low velocity of the outlet air has lowered.

In the method for supporting the cylindrical inlet shown in FIG. 53, the flow rate of hitting outlet air has the highest velocity to produce large noise because the supports 143 for the cylindrical inlet is located just after outlet from the fan 70. It is recommended that the supports 143 for the cylindrical inlet be arranged so as to couple the inner wall of the induction disk 77 and the outer wall of the cylindrical inlet 73 in the vicinity of the secondary flow inlet 42 as shown in FIG. 54, and that the induction disk 77 is supported by the induction disk supports 142 in the vicinity of the outlet 80 which is at the farthest distance from the blower 70 like the arrangement shown in FIG. 53. As a result, besides the adoption of the shape of the supports shown in FIG. 53(*b*), the noise is further reduced because the supports 143 for cylindrical inlet hits against the secondary flow 32 having a relatively low flow velocity.

As explained, the induction disk supports 142 which are formed so as to have a streamlined cross-sectional shape such as a winged shape, a winged shape having a elliptic section, and a round shape having a large diameter can be at the farthest location from the blower 70, and the supports 143 for the cylindrical inlet which has a shape optimized like the induction disk support 142 can be arranged to couple the induction disk 77 and the cylindrical inlet 73 in the vicinity of the secondary flow inlet 42 to reduce the noise which is created when the fluid hits against the supports.

EMBODIMENT 21

The air ventilation or air supply system according to the present invention can be used has not only an air ventilation and system but also an air supply system providing a great airflow rate.

The number of various kinds of spacious buildings such as factories, gymnasiums, atria, domes and auditoriums has been recently increased. Environment control for such spacious buildings involves peculiar problems different from those for buildings having a smaller space. For example, the height of a ceiling, the volume in a space and the maldistribution of a living space contribute to the problems. A space having a high ceiling is likely to have maldistribution of temperature in the vertical direction. For example, heated air is raised to stay in the vicinity of the ceiling on heating while cool air is lowered to stay in the vicinity of a floor on cooling. In that manner, air conditioned environment is deteriorated.

When a space has a great volume, a problem is raised in terms of not only the vertical direction but also the horizontal direction. Since the number of the inlets or the outlets of an air conditioning system is limited, it is often difficult to have an equally air conditioned space throughout the horizontal direction. A living space in a spacious building is usually present at a lower position of the building, and the volume occupied by the living space in the entire spacious building is significantly small. Most energy supplied for environment control escapes into a space other than the living space.

Figure 55:
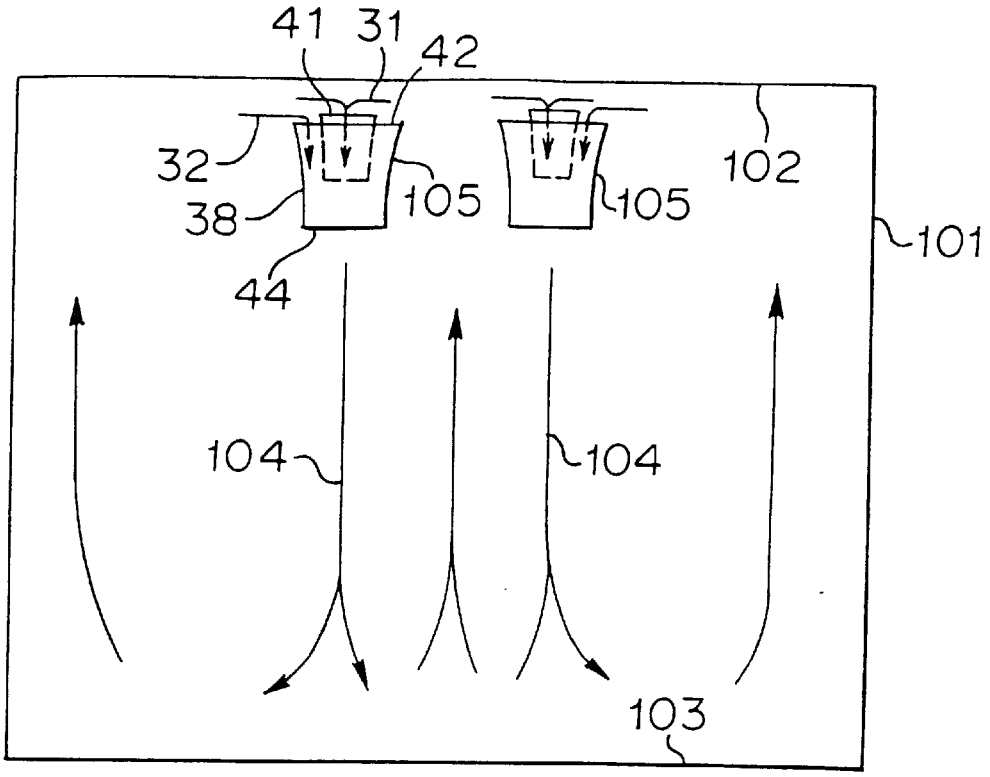
FIG. 55 is a positional arrangement of the system according to a twenty-first embodiment of the present invention.

In FIG. 55, there is shown a positional arrangement of a circulator for eliminating a temperature difference between an upper portion and a lower portion in a building, wherein e.g. the system shown in FIG. 1 is used to relieve a temperature difference in the vertical direction. In this figure, reference numeral 101 designates a space which has a high ceiling 102 and a floor 103. The system 105 is arranged in the vicinity of the ceiling 102 so that it has the primary flow inlet 41 and the secondary flow inlet 42 directed to the ceiling 102 and the outlet 44 directed to the floor 103.

In operation, when the system 105 is operated, air staying in the vicinity of the ceiling 102 is sucked through the primary flow inlet 41. The primary flow inlet 31 thus sucked is gushed into the induction nozzle 38, induces the secondary flow 32 by entrainment, and is blown out of the outlet 44. Since the induced secondary flow 32 is supplied from the secondary flow inlet 42 into the system 105, the total airflow rate of the system 105 is the sum of the primary flow 31 and the secondary flow 32. This means that the amount of the air which is greater than the airflow rate directly blown out of the fan is sucked from the vicinity of the ceiling 102 and is blown out of the outlet 44. A jet 104 thus gushed reaches the floor 103, changes into flows in parallel with the floor 103, and rises up to the ceiling 102 as great circular flows. Thus, the circular flow directed from the ceiling 102 to the floor 103 and from the floor 103 to the ceiling 102 can be formed to eliminate a temperature difference in the vertical direction within the space 101.

Such use of the air ventilation or air supply system of the present invention with the induced flow utilized as a circulator can effectively eliminate a temperature difference in the vertical direction within a spacious building because even a small input can provide a large airflow rate of conveying capability.

If a plurality of the systems are used as shown, a temperature difference in the vertical direction within a wider range of space can be relieved.

EMBODIMENT 22

Although explanation of the twenty-first embodiment has been made with respect to a case wherein an air ventilation or air supply system according to the present invention is used as a circulator to eliminate a temperature difference in the vertical direction, the system can be used as a circulator for eliminating a temperature difference in the horizontal direction. In a space which is large in the horizontal direction, only a portion of the space in the vicinity of an air conditioning outlet is air conditioned because the air which has been temperature-adjusted by a heat exchanger and has blown out of the air conditioning outlet into the space can not reach a portion of the space far from the air conditioning outlet. In order to eliminate a temperature difference in the horizontal direction within the space, the system is arranged in a range wherein the air conditioning air blown out of the air conditioning outlet can arrive.

Figure 56:
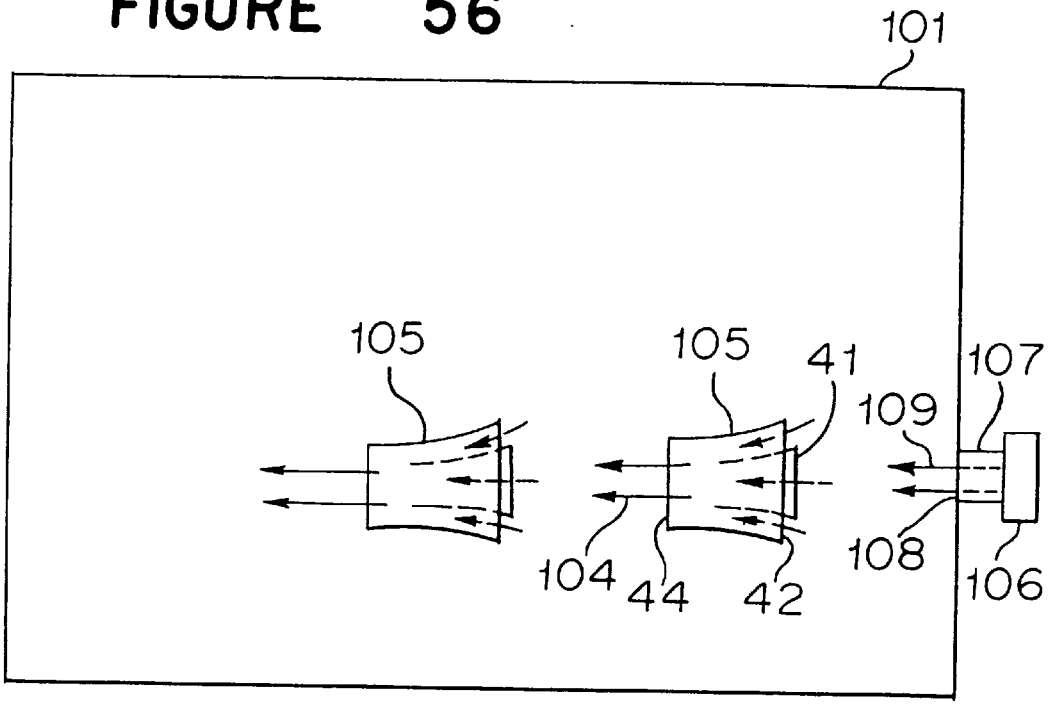
FIG. 56 is a positional arrangement of the system according to a twenty-second embodiment of the present invention.

In FIG. 56, there is shown a twenty-second embodiment, showing how to arrange the system to eliminate a temperature difference in the horizontal direction. In this figure, reference numeral 106 designates a heat exchanger for carrying out environment control in a space 101. Reference numeral 107 designates a duct which directs the air temperature-controlled by the heat exchanger 106 to the space 101. Reference numeral 108 designates an air conditioning outlet for blowing the air out of the duct 107 into the space 101. Reference numeral 109 designates the temperature-regulated air. The system 105 is arranged in a range wherein the temperature-regulated air 109 blown out of the air conditioning outlet 108 can arrive, the primary flow inlet 41 and the secondary flow inlet 42 of the system are directed to the air conditioning outlet 108, and the outlet 44 is arranged to be directed to a space to convey the air 109.

In operation, the air 109 temperature-regulated by the heat exchanger 106 is blown out of the air conditioning outlet 108 into the space 101 through the duct 107. When the system 105 is operated, the temperature-regulated air from the air conditioning outlet 108 is sucked together with ambient air from the primary flow inlet 41 and the secondary flow 42, and is blown out of the outlet 44. The airflow rate is the sum of the primary flow 31 and the secondary flow 32. An outlet jet 104 can arrive at a location far from the air conditioning outlet 108 to air condition that location.

Such use of the air ventilation or air supply system with the induction flow utilized as a circulator can effectively eliminate a temperature difference in the horizontal direction within a spacious building because even a small input can provide a large airflow rate conveying capability.

If a plurality of the system 105 are used to carry out air transfer one after another so that the temperature-regulated air 109 from the air conditioning outlet 108 is further blown out of a system 105, and another system is arranged in a range of the reach of the outlet jet 104 to further blow out the air as shown, a temperature difference in the horizontal direction within a wider range can be relieved.

EMBODIMENT 23

A large closed space such as an underground parking lot or a factory raises a problem of how to ventilate contaminated air in the space. There has been used a large-scale of air ventilation or air supply system wherein inlets for contaminated air are provided at many locations, the inlets are connected to long duct pipes, and the contaminated air is exhausted outdoors through the pipes. Such a duct pipe of air ventilation system has a drawback in that cost-performance is low because the duct pipes require a great deal of cost and because great pressure loss by the ducts requires an increase in the capability of a blower for exhaust. An example wherein an air ventilation or air supply system according to the present invention is used in a ductless air transfer system without duct pipes will be explained.

Figure 57:
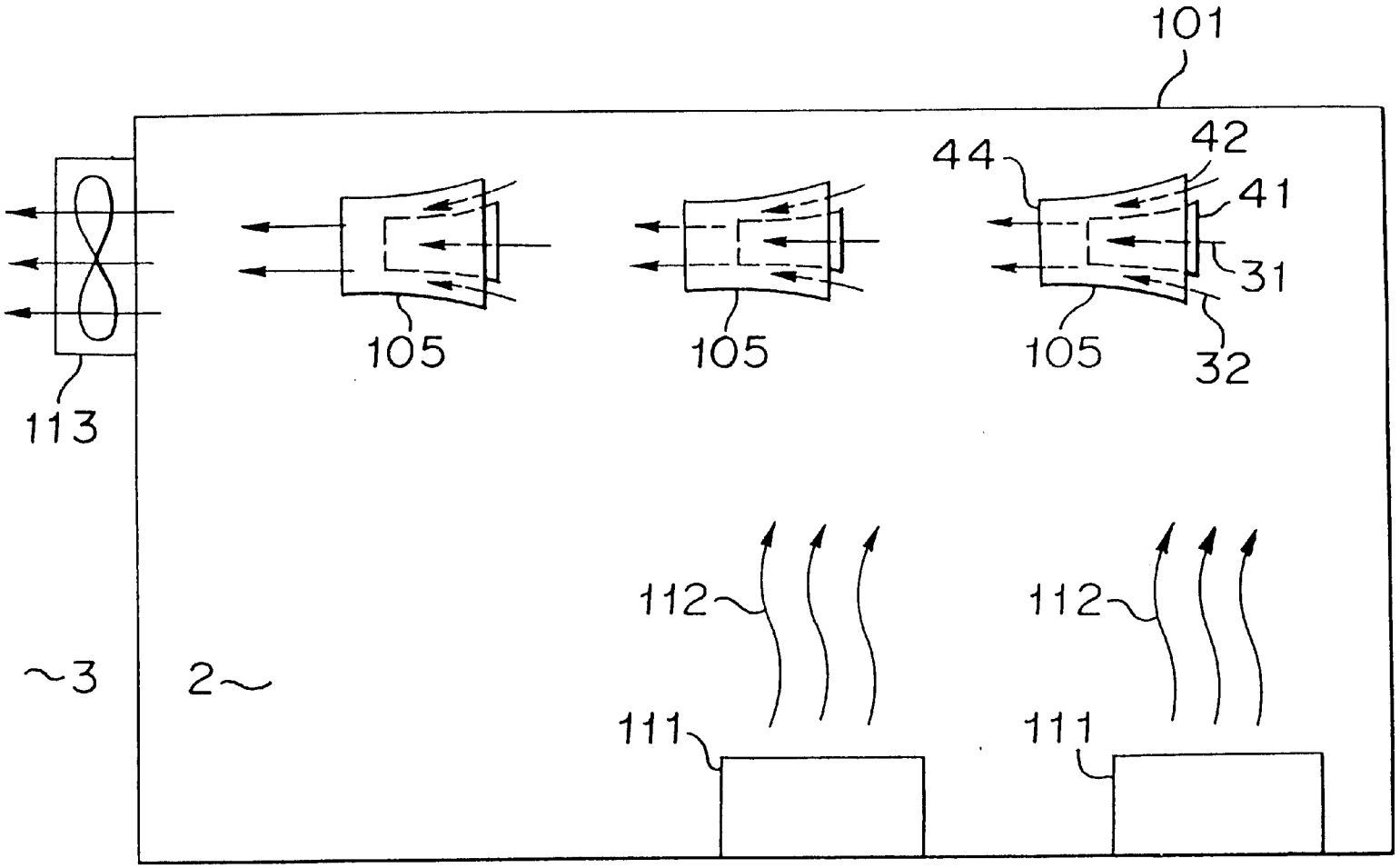
FIG. 57 is a positional arrangement of the system according to a twenty-third embodiment of the present invention.

In FIG. 57, there is shown a positional arrangement of the air ventilation or air supply system according to a twenty-third embodiment. In this figure, reference numeral 111 designates a pollution source in a space 101, such as an automobile in a parking lot, an exhaust gas producing device in a factory, a person breathing out carbon dioxide in an atrium or a large office. Reference numeral 112 designates contaminated air produced from the pollution source 111. Reference numeral 113 designates a main ventilator for eliminating the contaminated air 112 from the inside 2 of the space into outdoors 3. The system 105 has the primary flow inlet 41 and the secondary flow inlet 42 arranged in a location where the contaminated air 112 produced from the pollution source 111 exists. The system has the outlet 44 is directed toward a direction to convey the contaminated air 112.

In operation, the system is operated, the contaminated air 112 is sucked together with ambient air from the primary flow inlet 41 and the secondary flow inlet 42, and blown out of the outlet 44. The airflow rate of the system is the sum of the primary flow 31 and the secondary flow 32. If the distance to convey is short, the outlet jet is exhausted by the main ventilator 113. If the distance to convey is long, another system 105 is arranged wherein a range of the reach of the outlet jet to convey the contaminated air toward the main ventilator 113. In this manner, a plurality of the system 105 carry out transfer one after another as shown, and the contaminated air 112 is finally exhausted outdoors 3 by the main ventilator 113.

Such use of the system according to the present invention with the induction flow utilized as the ductless air transfer air ventilation or air supply system can effectively carry out ventilation in a large space because even a small input can provide a large airflow rate of conveying capability.

EMBODIMENT 24

Figure 58:
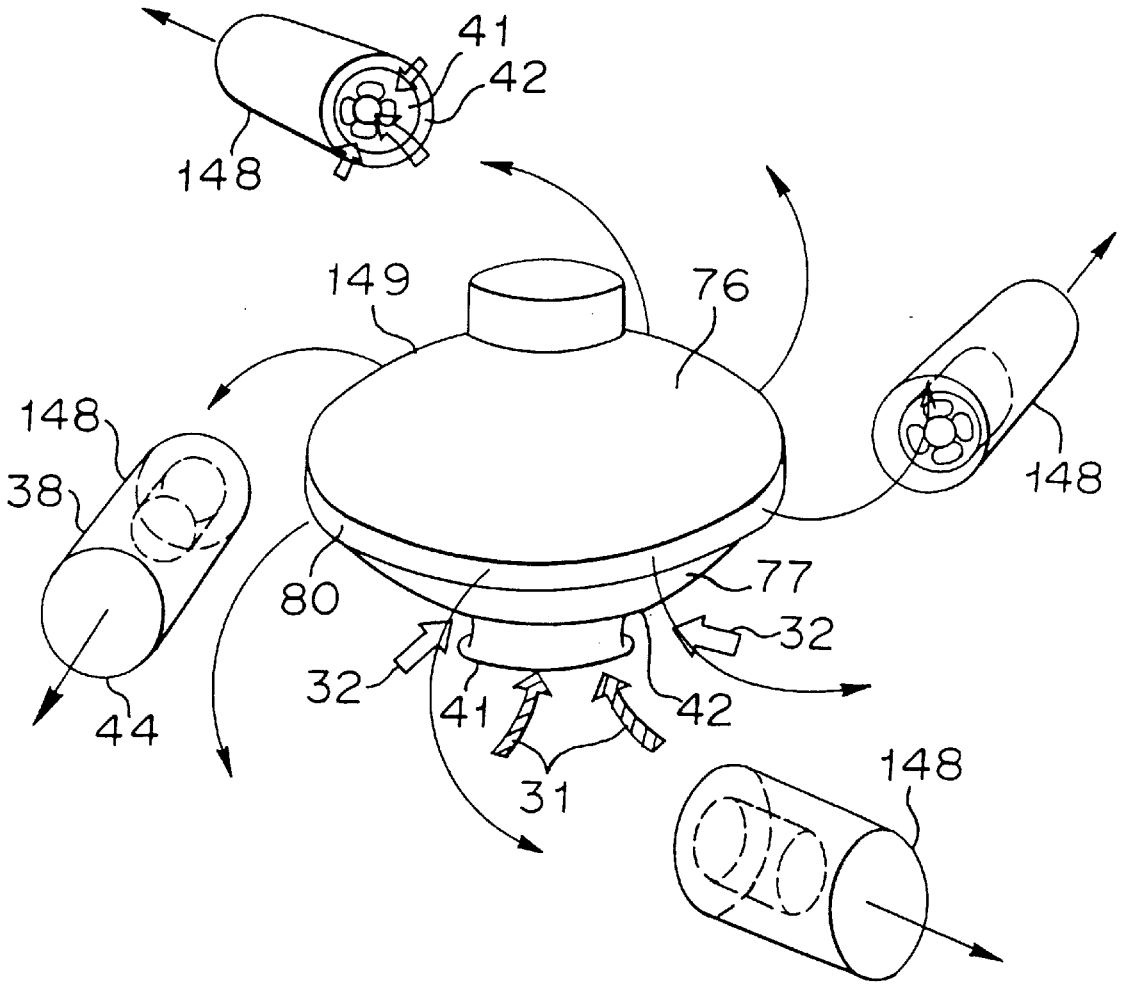
FIG. 58 is a positional arrangement of the system according to a twenty-fourth embodiment of the present invention.
Figure 59:
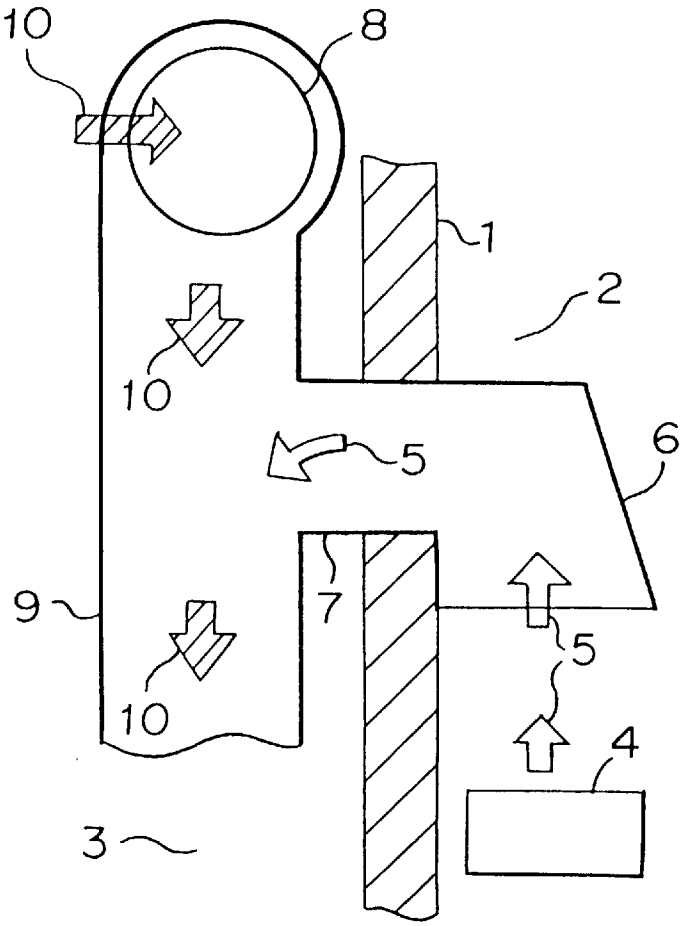
FIG. 59 is a schematic view of a conventional air ventilation or air supply system.
Figure 60:
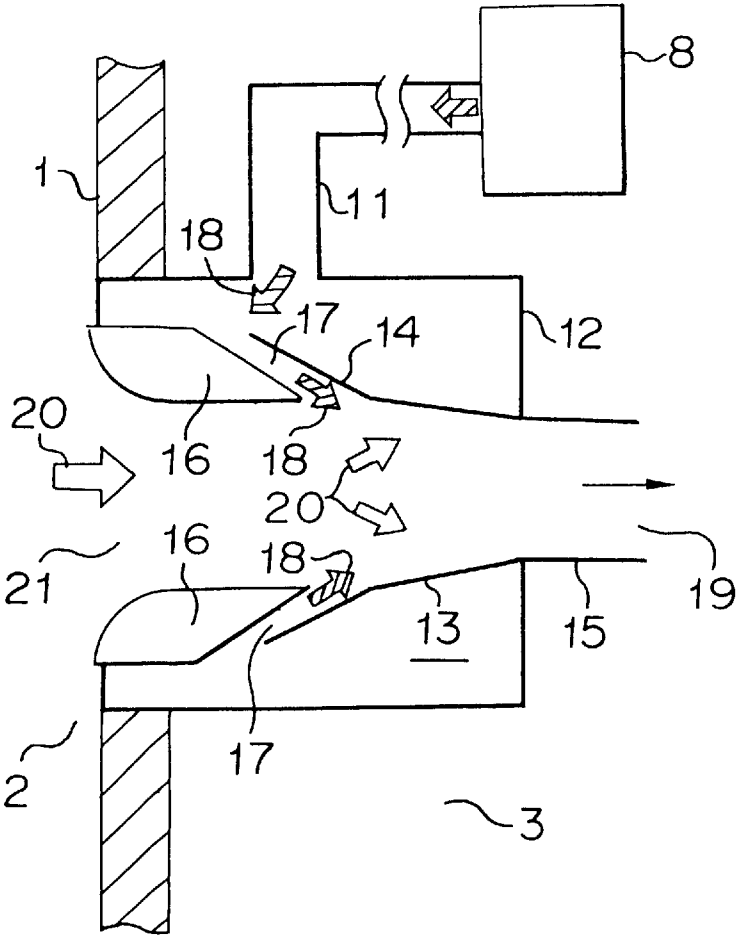
FIG. 60 is a schematic view of another conventional air ventilation or air supply system.

In the twenty-first through twenty-third embodiments, a plurality of the systems with an axial fan used therein according to the first embodiment are combined to form a circulator, a ductless air transfer system and an air ventilation air conditioning system. Now, another system arrangement wherein such an air supply system with an axial fan used therein is combined with the air ventilation or air supply system with a centrifugal fan used therein according to the fifth embodiment to carry out air transfer in a more effective way will be explained. In FIG. 58, there is shown a perspective view of the air ventilation or air supply system according to a twenty-fourth embodiment. In this figure, reference numeral 148 designates axial flow induction air ventilation or air supply systems as first air ventilation or air supply system. Reference numeral 149 designates a centrifugal flow induction air ventilation or air supply system as a second air ventilation or air supply system. The first system and the second system are the same as the one according to the first embodiment and the one according to the fifth embodiment, respectively. As explained with respect to the fifth embodiment, the centrifugal flow induction air ventilation or air supply system 149 has such a function that the air sucked from the primary flow inlet 41 and 80 the secondary flow inlet 42 is blown out of the outlet defined by the induction disk 77 and the guide plate 76 in radial directions. In order to make good use of this function, the centrifugal flow induction air ventilation or air supply system 149 is arranged on a ceiling so as to have the inlet directed to a floor, that is to say, is arranged on a ceiling in a reversed fashion with respect to the fashion shown in FIG. 11. In addition, the plural axial flow induction air ventilation or air supply systems 148 are arranged around the centrifugal flow induction air ventilation or air supply system so as to have respective axes thereof aligned with blowing directions of the centrifugal flow induction air ventilation or air supply system 149. The axial flow induction air ventilation or air supply systems have the primary flow inlets 41 and the secondary flow inlets 42 directed to the outlet 80 of the centrifugal flow induction air ventilation or air supply system.

In operation, when the axial flow induction air ventilation or air supply systems 148 and the centrifugal flow induction air ventilation or air supply system 149 are operated, the centrifugal flow induction air ventilation or air supply system 149 takes up air therebelow in the vertical direction and sucks it through the primary flow inlet 41 and the secondary flow inlet 42. At that time, the centrifugal flow induction air ventilation or air supply system 149 can effectively take up the air therebelow until a portion in the vicinity of the ceiling because the centrifugal flow induction air ventilation or air supply system is constructed so as to increase a suction airflow rate like the fifth embodiment. The air which has been taken into the centrifugal flow induction air ventilation or air supply system 149 is radially gushed out of the outlet formed at the downstream ends of the induction disk 77 and the guide plate 76 to be spread into a space around the centrifugal flow induction air ventilation or air supply system. The outlet air radially spread is sucked into the primary flow inlet 41 and the secondary flow inlet 42 of each of the axial flow induction air ventilation or air supply systems 148 which are arranged at positions ahead of where the flow rate of the outlet air becomes weak. The sucked air is conveyed toward further locations from the outlet 34 of the induction nozzle 38 of each of the axial flow induction air ventilation or air supply systems in such a way that the flow velocity of the air is increased by the axial flow induction air ventilation or air supply systems.

Although the single centrifugal flow induction air ventilation or air supply system 149 is combined with the four of axial flow induction air ventilation or air supply systems 148 in FIG. 58, the combination is not limited to the one shown in FIG. 58. More than the centrifugal flow induction air ventilation or air supply system 149 shown may be combined with more than the axial flow induction air ventilation or air supply systems 148 shown to carry out effective air transfer in a much wider range.

As explained, the plural axial flow induction air ventilation or air supply systems 148 can be combined with the centrifugal flow induction air ventilation or air supply system 149 to provide a system so as to establish an increase in transferring airflow and wider air transfer in an effective way.

What is claimed is:

1. An air ventilation or air supply system comprising:

an axial fan for producing a primary flow;

a primary flow guide surrounding the axial fan; and an induction portion including an induction nozzle which surrounds and is spaced from the primary flow guide and extends downstream of a downstream end of the primary flow guide to induce a secondary flow by entrainment by the primary flow on the outlet side of the primary flow guide, wherein the primary flow guide has an outlet with a diameter $D_0$, the induction nozzle has an outlet with a diameter $D_1$, the outlet of the induction nozzle is spaced from the outlet of the primary flow guide by a distance L in an axial direction of the primary flow guide, the primary flow has an expansion angle $\alpha_1$ at the outlet of the primary flow guide, and the relationship $$0.5 \leqq D_1/[D_0+2L \tan(\alpha_1)] \leqq 1.5$$

is satisfied.

2. A system according to claim 1 wherein the primary flow guide is cylindrical.

3. A system according to claim 2 including a rectifying member provided in the vicinity of an outlet of the induction nozzle to rectify a swirling component in the primary flow caused by revolution of the axial fan.

4. A system according to claim 2 including ducts arranged to direct a part of the primary flow from an inner portion in the primary flow guide to a peripheral portion of an outlet of the induction nozzle.

5. A system according to claim 2 including a hood smoothly connected to a downstream end of the induction nozzle to change directions of the primary flow and the secondary flow.

6. A system according to claim 1 wherein a secondary flow passage is formed between the primary flow guide and the induction nozzle to carry the secondary flow induced by the primary flow, the system including secondary flow passage opening and closing means for selectively opening and closing the secondary flow passage.

7. A system according to claim 1 including an air-permeable plate-shaped member disposed along an inner wall of the induction nozzle and spaced from the induction nozzle.

8. An air ventilation or air supply system comprising:

a centrifugal fan for producing a primary flow;

a primary flow guide including an inlet side guide arranged on an inlet side of the centrifugal fan;

a guide plate which has a larger outer size than an outer diameter of the centrifugal fan and which is arranged on a side of the centrifugal fan opposite to an inlet side of the centrifugal fan to guide the primary flow in a radial direction of the centrifugal fan; and an induction disk which surrounds and is spaced from the inlet side guide for inducing a secondary flow by entrainment by the primary flow on an outlet side of the primary flow guide.

9. A system according to claim 8 wherein a space between the guide plate and the induction disk is gradually narrowed toward outer peripheral edges of the space.

10. A system according to claim 8 wherein the centrifugal fan has a diameter $D_2$, the guide plate is circular with a diameter $D_3$, the centrifugal fan has an outlet width $H_0$, an outlet defined by the outer peripheral edges of the induction disk and the guide plate has a width $H_1$, the primary flow from the centrifugal fan has an expansion angle $\alpha_2$, and the relationship $$0.5 \leqq 2H_1/[2H_0+(D_3-D_2) \tan(\alpha_2)] \leqq 1.5$$

is satisfied.

11. A system according to claim 8 including a side plate for partially closing a portion between the guide plate and the induction disk in a circumferential direction of the centrifugal fan.

12. A system according to claim 8 wherein a secondary flow passage is formed between the inlet side guide and the induction disk to carry the secondary flow induced by the primary flow, the system including secondary flow passage opening and closing means for selectively opening and closing the secondary flow passage.

13. A system according to claim 6 wherein a static pressure in the secondary flow passage is detected to control the opening and closing means.

14. A system according to claim 6 wherein the opening and closing means is automatically opened and closed by a pressure action exerted from a static pressure in the passage so that when the static pressure is negative, the opening and closing means is closed, and when the static pressure is positive, the opening and closing means is opened.

15. A system according to claim 8 wherein an installation angle of the guide plate with respect to an axial direction of the centrifugal fan is adjustable.

16. A system according to claim 8 including a support for a cylindrical inlet which couples and supports the induction disk and the inlet side guide in the vicinity of an inlet side of the secondary flow induced by the primary flow, and a support for the induction disk which couples and supports the induction disk and the guide plate in the vicinity of the outlet.

17. A system according to claim 8 wherein the induction disk extends radially outwards with respect to the centrifugal fan farther than the inlet side guide.

18. A system according to claim 8 wherein the primary flow and second flow are guided between the guide plate and the induction disk primarily in a radially outward direction with respect to the centrifugal fan.

19. A system according to claim 8 wherein the inlet side guide introduces the primary flow axially into the inlet side of the centrifugal fan.

20. A system according to claim 8 wherein the induction disk has an upstream side formed in a bell mouth shape.

21. A system according to claim 8 wherein the induction disk has a plate-shaped downstream side.

22. An air ventilation or air supply system comprising:

a blower for producing a first primary flow;

a first primary flow guide surrounding the blower for guiding the first primary flow;

an induction nozzle which extends from an inlet side to an outlet side of the primary flow guide and surrounds and is spaced from the primary flow guide and extends downstream of a downstream end of the primary flow guide for inducing a first secondary flow by entrainment of the first primary flow on the outlet side of the primary flow guide;

a centrifugal fan for producing a second primary flow;

an inlet side guide arranged on an inlet side of the centrifugal fan for guiding the second primary flow into the centrifugal fan;

a guide plate which has a larger outer size than an outer diameter of the centrifugal fan and which is arranged on a side of the centrifugal fan opposite to an inlet side of the centrifugal fan to guide the second primary flow in a radial direction of the centrifugal fan; and an induction disk which is spaced from and surrounds the inlet side guide, a space between the induction disk and the inlet side guide defining a passage for a second secondary flow induced by the second primary flow, and a space between the induction disk and the guide plate defining an outlet for the second primary flow and the second secondary flow, wherein an axial direction of the first primary flow on an inlet side of the blower is aligned with a flow direction of outlet air from the outlet defined by the induction disk and the guide plate.

23. A system according to claim 22 wherein the blower comprises an axial fan.

* * * * *